US006325159B1

(12) United States Patent
Peterman et al.

(10) Patent No.: US 6,325,159 B1
(45) Date of Patent: Dec. 4, 2001

(54) OFFSHORE DRILLING SYSTEM

(75) Inventors: Charles P. Peterman; Riley G. Goldsmith, both of Houston; Keith C. Mott, deceased, late of Houston, all of TX (US); John Mark Danna, Atlanta, GA (US), legal representative; Kenneth L. Pelata, New Braunfels; Kenneth W. Colvin, Humble, both of TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 09/276,404

(22) Filed: Mar. 25, 1999

Related U.S. Application Data

(60) Provisional application No. 60/079,641, filed on Mar. 27, 1998.

(51) Int. Cl.[7] ..... E21B 7/128

(52) U.S. Cl. ..... 175/7; 175/213; 175/214; 175/217; 166/350; 166/359; 166/367

(58) Field of Search ..... 166/350, 359, 166/367, 374; 175/5, 7, 213, 214, 217

(56) References Cited

U.S. PATENT DOCUMENTS

| | | | |
|---|---|---|---|
| 2,419,993 | | 5/1947 | Green et al. . |
| 2,703,055 | | 3/1955 | Veth et al. . |
| 2,723,681 | | 11/1955 | MacGlashan, Jr. et al. . |
| 2,854,998 | | 10/1958 | MacGlashan, Jr. et al. . |
| 3,047,018 | | 7/1962 | Lucien . |
| 3,209,829 | | 10/1965 | Haeber . |
| 3,259,198 | | 7/1966 | Montgomery et al. . |
| 3,372,761 | | 3/1968 | van Gils . |
| 3,492,007 | | 1/1970 | Jones . |
| 3,587,734 | | 6/1971 | Shaffer . |
| 3,603,409 | | 9/1971 | Watkins . |
| 3,638,721 | * | 2/1972 | Harrison . |
| 3,815,673 | | 6/1974 | Bruce et al. . |
| 4,046,191 | | 9/1977 | Neath . |
| 4,063,602 | | 12/1977 | Howell et al. . |
| 4,099,583 | | 7/1978 | Maus . |
| 4,149,603 | | 4/1979 | Arnold . |
| 4,291,772 | | 9/1981 | Beynet . |
| 4,523,901 | | 6/1985 | Schippers et al. . |
| 4,527,632 | | 7/1985 | Chaudot . |

(List continued on next page.)

OTHER PUBLICATIONS

PCT International Search Report dated Jun. 14, 1999.

PCT International Search Report dated Oct. 19, 1999.

National Academy of Sciences—National Research Council; "Design of a Deep Ocean Drilling Ship"; pp. 114–121; undated.

Allen Gault, Conoco; "Riserless Drilling: circumventing the size/cost cycle in deepwater"; Offshore publication; May 1996.

PCT Search Report dated Jun. 11, 1999.

*Primary Examiner*—Roger Schoeppel
(74) *Attorney, Agent, or Firm*—Rosenthal & Osha L.L.P.

(57) ABSTRACT

A system for drilling a subsea well from a rig through a subsea wellhead below the rig includes a wellhead stack which is mounted on the subsea wellhead. The wellhead stack includes at least a subsea blowout preventer stack and a subsea diverter. A drill string extends from the rig through the wellhead stack into the well to conduct drilling fluid from the rig to a drill bit in the well. A riser which has one end coupled to the wellhead stack and another end coupled to the rig internally receives the drill string such that a riser annulus is defined between the drill string and the riser. A well annulus extends from the bottom of the well to the subsea diverter to conduct fluid away from the drill bit. A pump has a suction side in communication with the well annulus and a discharge side in communication with the rig and is operable to maintain a selected pressure gradient in the well annulus.

24 Claims, 49 Drawing Sheets

U.S. PATENT DOCUMENTS

| | | | | |
|---|---|---|---|---|
| 4,531,593 | | 7/1985 | Elliott et al. . | |
| 4,595,343 | | 6/1986 | Thompson et al. . | |
| 4,611,578 | | 9/1986 | Heimes . | |
| 4,611,661 | | 9/1986 | Hed et al. . | |
| 4,632,358 | | 12/1986 | Orth et al. . | |
| 4,649,704 | * | 3/1987 | Marsh | 60/415 |
| 4,705,462 | | 11/1987 | Balembois . | |
| 4,709,900 | * | 12/1987 | Dyhr | 251/5 |
| 4,755,111 | | 7/1988 | Cocchi et al. . | |
| 4,813,495 | | 3/1989 | Leach . | |
| 4,828,024 | | 5/1989 | Roche . | |
| 4,832,005 | | 5/1989 | Takamiya et al. . | |
| 4,832,126 | | 5/1989 | Roche . | |
| 5,149,055 | | 9/1992 | Huber et al. . | |
| 5,184,686 | | 2/1993 | Gonzalez . | |
| 5,263,514 | | 11/1993 | Reeves . | |
| 5,297,777 | | 3/1994 | Yie . | |
| 5,320,325 | | 6/1994 | Young et al. . | |
| 5,443,241 | | 8/1995 | Odaira et al. . | |
| 5,480,292 | | 1/1996 | Chevallier . | |
| 5,516,429 | | 5/1996 | Snodgrass et al. . | |
| 5,558,506 | | 9/1996 | Simmons et al. . | |
| 5,622,482 | | 4/1997 | Lee . | |
| 5,662,181 | | 9/1997 | Williams et al. . | |
| 5,924,448 | | 7/1999 | West . | |

* cited by examiner (Detail E)

(Detail D)

(Detail C)

| CONTROL POINT | SIGNAL TO CONTROL VALVE # | CHANGE VALVE POSITION TO: | SPLIT, FULL OR NO FLOW | FLOW SPLIT WITH VALVE # | IF NO FLOW, THEN FULL FLOW THROUGH VALVE # |
|---|---|---|---|---|---|
| A | 2038B | OPEN | SPLIT | 428B | |
| C | 428B | BLOCK | NONE | | 2038B |
| E | 428A | OPEN | SPLIT | 2038A | |
| G | 2038A | BLOCK | NONE | | 428A |
| I | 2038B | OPEN | SPLIT | 426B | |
| K | 426B | BLOCK | NONE | | 2038B |
| M | 426A | OPEN | SPLIT | 428A | |
| O | 428A | BLOCK | NONE | | 426A |
| Q | 428B | OPEN | SPLIT | 2038B | |
| S | 2038B | BLOCK | NONE | | 428B |
| U | 2038A | OPEN | SPLIT | 426B | |
| W | 426B | BLOCK | NONE | | 2038A |

FIG. 11C

OFFSHORE DRILLING SYSTEM

CROSS REFERENCE TO RELATED APPLICATIONS

This application claims priority from U.S. Provisional Application Ser. No. 60/079,641 filed on Mar. 27, 1998.

BACKGROUND OF THE INVENTION

1. Technical Field

The invention relates generally to offshore drilling systems which are employed for drilling subsea wells. More particularly, the invention relates to an offshore drilling system which maintains a dual pressure gradient, one pressure gradient above the well and another pressure gradient in the well, during a drilling operation.

2. Background Art

Deep water drilling from a floating vessel typically involves the use of a large-diameter marine riser, e.g. a 21-inch marine riser, to connect the floating vessel's surface equipment to a blowout preventer stack on a subsea wellhead. The floating vessel may be moored or dynamically positioned at the drill site. However, dynamically-positioned drilling vessels are predominantly used in deep water drilling. The primary functions of the marine riser are to guide the drill string and other tools from the floating vessel to the subsea wellhead and to conduct drilling fluid and earth-cuttings from a subsea well to the floating vessel. The marine riser is made up of multiple riser joints, which are special casings with coupling devices that allow them to be interconnected to form a tubular passage for receiving drilling tools and conducting drilling fluid. The lower end of the riser is normally releasably latched to the blowout preventer stack, which usually includes a flexible joint that permits the riser to angularly deflect as the floating vessel moves laterally from directly over the well. The upper end of the riser includes a telescopic joint that compensates for the heave of the floating vessel. The telescopic joint is secured to a drilling rig on the floating vessel via cables that are reeved to sheaves on riser tensioners adjacent the rig's moon pool.

The riser tensioners are arranged to maintain an upward pull on the riser. This upward pull prevents the riser from buckling under its own weight, which can be quite substantial for a riser extending over several hundred feet. The riser tensioners are adjustable to allow adequate support for the riser as water depth and the number of riser joints needed to reach the blowout preventer stack increases. In very deep water, the weight of the riser can become so great that the riser tensioners would be rendered ineffective. To ensure that the riser tensioners work effectively, buoyant devices are attached to some of the riser joints to make the riser weigh less when submerged in water. The buoyant devices are typically steel cylinders that are filled with air or plastic foam devices.

The maximum practical water depth for current drilling practices with a large diameter marine riser is approximately 7,000 feet. As the need to add to energy reserves increases, the frontiers of energy exploration are being pushed into ever deeper waters, thus making the development of drilling techniques for ever deeper waters increasingly more important. However, several aspects of current drilling practices with a conventional marine riser inherently limit deep water drilling to water depths less than approximately 7,000 feet.

The first limiting factor is the severe weight and space penalties imposed on a floating vessel as water depth increases. In deep water drilling, the drilling fluid or mud volume in the riser constitutes a majority of the total mud circulation system and increases with increasing water depth. The capacity of the 21-inch marine riser is approximately 400 barrels for every 1,000 feet. It has been estimated that the weight attributed to the marine riser and mud volume for a rig drilling at a water depth of 6,000 feet is 1,000 to 1,500 tons. As can be appreciated, the weight and space requirements for a drilling rig that can support the large volumes of fluids required for circulation and the number of riser joints required to reach the seafloor prohibit the use of the 21-inch riser, or any other large-diameter riser, for drilling at extreme water depths using the existing offshore drilling fleet.

The second limiting factor relates to the loads applied to the wall of a large-diameter riser in very deep water. As water depth increases, so does the natural period of the riser in the axial direction. At a water depth of about 10,000 feet, the natural period of the riser is around 5 to 6 seconds. This natural period coincides with the period of the water waves and can result in high levels of energy being imparted on the drilling vessel and the riser, especially when the bottom end of the riser is disconnected from the blowout preventer stack. The dynamic stresses due to the interaction between the heave of the drilling vessel and the riser can result in high compression waves that may exceed the capacity of the riser.

In water depths 6,000 feet and greater, the 21-in riser is flexible enough that angular and lateral deflections over the entire length of the riser will occur due to the water currents acting on the riser. Therefore, in order to keep the riser deflections within acceptable limits during drilling operations, tight station keeping is required. Frequently, the water currents are severe enough that station keeping is not sufficient to permit drilling operations to continue. Occasionally, water currents are so severe that the riser must be disconnected from the blowout preventer stack to avoid damage or permanent deformation. To prevent frequent disconnection of the riser, an expensive fairing may have to be deployed or additional tension applied to the riser. From an operational standpoint, a fairing is not desirable because it is heavy and difficult to install and disconnect. On the other hand, additional riser tensioners may over-stress the riser and impose even greater loads on the drilling vessel.

A third limiting factor is the difficulty of retrieving the riser in the event of a storm. Based on the large forces that the riser and the drilling vessel are already subjected to, it is reasonable to conclude that neither the riser nor the drilling vessel would be capable of sustaining the loads imposed by a hurricane. In such a condition, if the drilling vessel is a dynamically positioned type, the drilling vessel will attempt to evade the storm. Storm evasion would be impossible with 10,000 feet of riser hanging from the drilling vessel. Thus, in such a situation, the riser would have to be pulled up entirely.

In addition, before disconnecting the riser from the blowout preventer stack, operations must take place to condition the well so that the well may be safely abandoned. This is required because the well depends on the hydrostatic pressure of the mud column extending from the top end of the riser to the bottom of the well to overcome the pore pressures of the formation. When the mud column in the riser is removed, the hydrostatic pressure gradient is significantly reduced and may not be sufficient to prevent formation fluid influx into the well. Operations to contain well pressure may include setting a plug, such as a storm packer, in the well and closing the blind ram in the blowout preventer stack.

After the storm, the drilling vessel would return to the drill site and deploy the riser to reconnect and resume drilling. In locations like Gulf of Mexico where the average annual number of hurricanes is 2.8 and the maximum warning time of an approaching hurricane is 72 hours, it would be necessary to disconnect and retrieve the riser every time there is a threat of hurricane in the vicinity of the drilling location. This, of course, would translate to huge financial losses to the well operator.

A fourth limiting factor relates to emergency disconnects such as when a dynamically positioned drilling vessel experiences a drive off. A drive off is a condition when a floating drilling vessel loses station keeping capability, loses power, is in imminent danger of colliding with another marine vessel or object, or experiences other conditions requiring rapid evacuation from the drilling location. As in the case of the storm disconnect, well operations are required to condition the well for abandoning. However, there is usually insufficient time in a drive off to perform all of the necessary safe abandonment procedures. Typically, there is only sufficient time to hang off the drill string from the pipe/hanging rams and close the shear/blind rams in the blowout preventer before disconnecting the riser from the blowout preventer stack.

The well hydrostatic pressure gradient derived from the riser height is trapped below the closed blind rams when the riser is disconnected. Thus, the only barrier to the influx of formation fluid into the well is the closed blind rams since the column of mud below the blind rams is insufficient to prevent influx of formation fluid into the well. Prudent drilling operations require two independent barriers to prevent loss of well control. When the riser is disconnected from the blowout preventer stack, large volumes of mud will be dumped onto the seafloor. This is undesirable from both an economic and environmental standpoint.

A fifth limiting factor relates to marginal well control and the need for numerous casing points. In any drilling operation, it is important to control the influx of formation fluid from subsurface formations into the well to prevent blowout. Well control procedures typically involve maintaining the hydrostatic pressure of the drilling fluid column above the "open hole" formation pore pressure but, at the same time, not above the formation fracture pressure. In drilling the initial section of the well, the hydrostatic pressure is maintained using seawater as the drilling fluid with the drilling returns discharged onto the seafloor. This is possible because the pore pressures of the formations near the seafloor are close to the seawater hydrostatic pressure at the seafloor.

While drilling the initial section of the well with seawater, formations having pore pressures greater than the seawater hydrostatic pressure may be encountered. In such situations, formation fluids may flow freely into the well. This uncontrolled flow of formation fluids into the well may be so great as to cause washouts of the drilled hole and, possibly, destroy the drilling location. To prevent formation fluid flow into the well, the initial section of the well may be drilled with weighted drilling fluids. However, the current practice of discharging fluid to the seafloor while drilling the initial section of the well does not make this option very attractive. This is because the large volumes of drilling fluids dumped onto the seafloor are not recovered. Large volumes of unrecovered weighted drilling fluids are expensive and, possibly, environmentally undesirable.

After the initial section of the well is drilled to an acceptable depth, using either seawater or weighted drilling fluid, a conductor casing string with a wellhead is run and cemented in place. This is followed by running a blowout preventer stack and marine riser to the seafloor to permit drilling fluid circulation from the drilling vessel to the well and back to the drilling vessel in the usual manner.

In geological areas characterized by rapid sediment deposition and young sediments, fracture pressure is a critical factor in well control. This is because fracture pressure at any point in the well is related to the density of the sediments resting above that point combined with the hydrostatic pressure of the column of seawater above. These sediments are significantly influenced by the overlying body of water and the circulating mud column need only be slightly denser than seawater to fracture the formation. Fortunately, because of the higher bulk density of the rock, the fracture pressure rapidly increases with the depth of penetration below the seafloor and will present a less serious problem after the first few thousand feet are drilled. However, abnormally high pore pressures which are routinely encountered up to 2,000 feet below the seafloor continue to present a problem both when drilling the initial section of the well with seawater and when drilling beyond the initial section of the well with seawater or weighted drilling fluid.

The challenge then becomes balancing the internal pressures of the formation with the hydrostatic pressure of the mud column while continuing drilling of the well. The current practice is to progressively run and cement casings, the next inside the previous, into the hole to protect the "open hole" sections possessing insufficient fracture pressure while allowing weighted drilling fluids to be used to overcome formation pore pressures. It is important that the well be completed with the largest practical casing through the production zone to allow production rates that will justify the high-cost of deep-water developments. Production rates exceeding 10,000 barrels per day are common for deep-water developments, and too small a production casing would limit the productivity of the well, making it uneconomical to complete.

The number of casings run into the hole is significantly affected by water depth. The multiple casings needed to protect the "open hole" while providing the largest practical casing through the production zone requires that the surface hole at the seafloor be larger. A larger surface hole in turn requires a larger subsea wellhead and blowout preventer stack and a larger blowout preventer stack requires a larger marine riser. With a larger riser, more mud is required to fill the riser and a larger drilling vessel is required to carry the mud and support the riser. This cycle repeats itself as water depth increases.

It has been identified that the key to breaking this cycle lies in reducing the hydrostatic pressure of the mud in the riser to that of a column of seawater and providing mud with sufficient weight in the well to maintain well control. Various concepts have been presented in the past for achieving this feat; however, none of these concepts known in the prior art have gained commercial acceptance for drilling in ever deeper waters. These concepts can be generally grouped into two categories: the mud lift drilling with a marine riser concept and the riserless drilling concept.

The mud lift drilling with a marine riser concept contemplates a dual-density mud gradient system which includes reducing the density of the mud returns in the riser so that the return mud pressure at the seafloor more closely matches that of seawater. The mud in the well is weighted to maintain well control. For example, U.S. Pat. No. 3,603,409 to Watkins et al. and U.S. Pat. No. 4,099,583 to Maus et al. disclose methods of injecting gas into the mud column in the marine riser to lighten the weight of the mud.

The riserless drilling concept contemplates eliminating the large-diameter marine riser as a return annulus and replacing it with one or more small-diameter mud return lines. For example, U.S. Pat. No. 4,813,495 to Leach removes the marine riser as a return annulus and uses a centrifugal pump to lift mud returns from the seafloor to the surface through a mud return line. A rotating head isolates the mud in the well annulus from the open seawater as the drill string is run in and out of the well.

Drilling rates are significantly affected by the magnitude of the difference between formation pore pressure and mud column pressure. This difference, commonly called "overbalance", is adjusted by changing the density of the mud column. Overbalance is estimated as the additional pressure required to prevent the well from kicking, either during drilling or when pulling a drill string out of the well. This overbalance estimate usually takes into account factors like inaccuracies in predicting formation pore pressures and pressure reductions in the well as a drill string is pulled from the well. Typically, a minimum of 300 to 700 psi overbalance is maintained during drilling operations. Sometimes the overbalance is large enough to damage the formation. The effect of overbalance on drilling rates varies widely with the type of drill bit, formation type, magnitude of overbalance, and many other factors. For example, in a typical drill bit and formation combination with a drilling rate of 30 feet per hour and an overbalance of 500 psi, it is common for the drilling rate to double to 60 feet per hour if the overbalance is reduced to zero. An even greater increase in drilling rate can be achieved if the mud column pressure is decreased to an underbalanced condition, i.e. mud column pressure is less than formation pressure. Thus, to improve drilling rates, it may be desirable to drill a well in an underbalanced mode or with a minimum of overbalance.

In conventional drilling operations, it is impractical to reduce the mud density to allow faster drilling rates and then increase the mud density to permit tripping the drill string. This is because the circulation time for the complete mud system lasts for several hours, thus making it expensive to repeatedly decrease and increase mud density. Furthermore, such a practice would endanger the operation because a miscalculation could result in a kick.

SUMMARY OF THE INVENTION

In general, in one aspect, a system for drilling a subsea well from a rig through a subsea wellhead below the rig comprises a wellhead stack mounted on the subsea wellhead. The wellhead stack comprises at least a subsea blowout preventer stack and a subsea diverter. A drill string extends from the rig through the wellhead stack into the well to conduct drilling fluid from the rig to a drill bit in the well. A riser having one end coupled to the wellhead stack and another end coupled to the rig internally receives the drill string such that a riser annulus is defined between the drill string and the riser. A well annulus extends from the bottom of the well to the subsea diverter to conduct fluid away from the drill bit. The well annulus is separated from the riser annulus by the subsea diverter. A pump having a suction side in communication with the well annulus and a discharge side in communication with the rig is operable to maintain a selected pressure gradient in the well annulus.

Other aspects and advantages of the invention will be apparent from the following description and the appended claims.

BRIEF DESCRIPTION OF THE DRAWINGS

FIG. 11C summarizes a control sequence for the pump system shown in FIG 11A.

DETAILED DESCRIPTION

Figure 1:
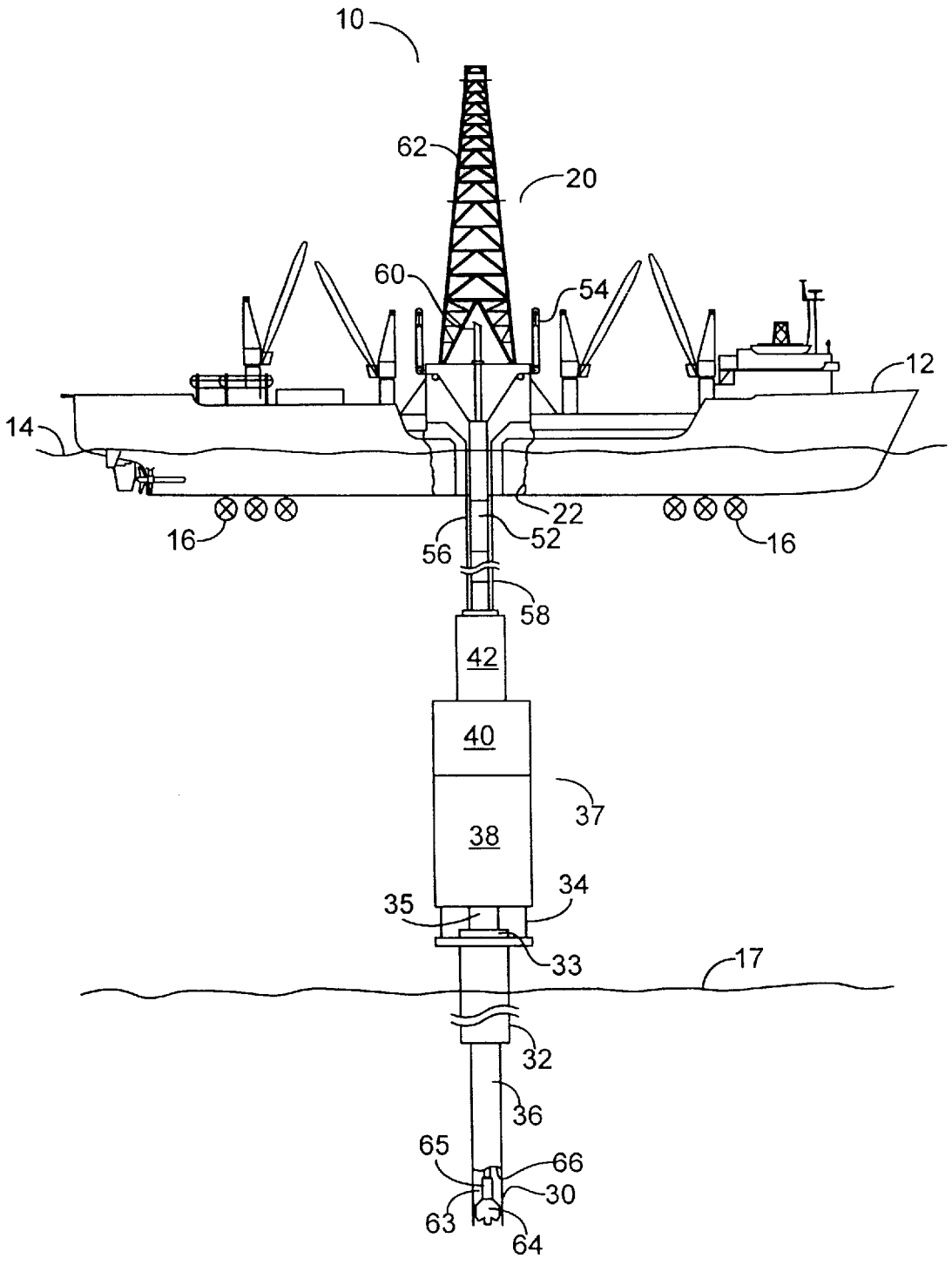
FIG. 1 illustrates an offshore drilling system.

FIG. 1 illustrates an offshore drilling system 10 where a drilling vessel 12 floats on a body of water 14 which overlays a pre-selected formation. The drilling vessel 12 is dynamically positioned above the subsea formation by thrusters 16 which are activated by on-board computers (not shown). An array of subsea beacons (not shown) on the seafloor 17 sends signals which are indicative of the location of the drilling vessel 12 to hydrophones (not shown) on the hull of the drilling vessel 12. The signals received by the hydrophones are transmitted to on-board computers. These on-board computers process the data from the hydrophones along with data from a wind sensor and other auxiliary position-sensing devices and activate the thrusters 16 as needed to maintain the drilling vessel 12 on station. The drilling vessel 12 may also be maintained on station by using several anchors that are deployed from the drilling vessel to the seafloor. Anchors, however, are generally practical if the water is not too deep.

A drilling rig 20 is positioned in the middle of the drilling vessel 12, above a moon pool 22. The moon pool 22 is a walled opening that extends through the drilling vessel 12 and through which drilling tools are lowered from the drilling vessel 12 to the seafloor 17. At the seafloor 17, a conductor pipe 32 extends into a well 30. A conductor housing 33, which is attached to the upper end of the conductor pipe 32, supports the conductor pipe 32 before the conductor pipe 32 is cemented in the well 30. A guide structure 34 is installed around the conductor housing 33 before the conductor housing 33 is run to the seafloor 17. A wellhead 35 is attached to the upper end of a surface pipe 36 that extends through the conductor pipe 32 into the well 30. The wellhead 35 is of conventional design and provides a method for hanging additional casing strings in the well 30. The wellhead 35 also forms a structural base for a wellhead stack 37.

The wellhead stack 37 includes a well control assembly 38, a mud lift module 40, and a pressure-balanced mud tank 42. A marine riser 52 between the drilling rig 20 and the wellhead stack 37 is positioned to guide drilling tools, casing strings, and other equipment from the drilling vessel 12 to the wellhead stack 37. The lower end of the marine riser 52 is releasably latched to the pressure-balanced mud tank 42, and the upper end of the marine riser 52 is secured to the drilling rig 20. Riser tensioners 54 are provided to maintain an upward pull on the marine riser 52. Mud return lines 56 and 58, which may be attached to the outside of the marine riser 52, connect flow outlets (not shown) in the mud lift module 40 to flow ports in the moon pool 22. The flow ports in the moon pool 22 serve as an interface between the mud return lines 56 and 58 and a mud return system (not shown) on the drilling vessel 12. The mud return lines 56 and 58 are also connected to flow outlets (not shown) in the well control assembly 38, thus allowing them to be used as choke/kill lines. Alternatively, the mud return lines 56 and 58 may be existing choke/kill lines on the riser.

A drill string 60 extends from a derrick 62 on the drilling rig 20 into the well 30 through the marine riser 52 and the wellhead stack 37. Attached to the end of the drill string 60 is a bottom hole assembly 63, which includes a drill bit 64 and one or more drill collars 65. The bottom hole assembly 63 may also include stabilizers, mud motor, and other selected components required for drilling a planned trajectory, as is well known in the art. During normal drilling operations, the mud pumped down the bore of the drill string 60 by a surface pump (not shown) is forced out of the nozzles of the drill bit 64 into the bottom of the well 30. The mud at the bottom of the well 30 rises up the well annulus 66 to the mud lift module 40, where it is diverted to the suction ends of subsea mud pumps (not shown). The subsea mud pumps boost the pressure of the returning mud flow and discharge the mud into the mud return lines 56 and/or 58. The mud return lines 56 and/or 58 then conduct the discharged mud to the mud return system (not shown) on the drilling vessel 12.

The drilling system 10 is illustrated with two mud return lines 56 and 58, but it should be clear that a single mud return line or more than two mud return lines may also be used. Clearly the diameter and number of the return lines will affect the pumping requirements for the subsea mud pumps in the mud lift module 40. The subsea mud pumps must provide enough pressure to the returning mud flow to overcome the frictional pressure losses and the hydrostatic head of the mud column in the return lines. The wellhead stack 37 includes subsea diverters (not shown) which seal around the drill string 60 and form a separating barrier between the riser 52 and the well annulus 66. The riser 52 is filled with seawater so that the hydrostatic pressure of the fluid column at the seafloor or mudline or separating barrier formed by the subsea diverters is that of seawater. Filling the riser with seawater, as opposed to mud, reduces the riser tension requirements. The riser may also be filled with other fluids which have a lower specific gravity than the mud in the well annulus.

Well Control Assembly

Figure 2B:
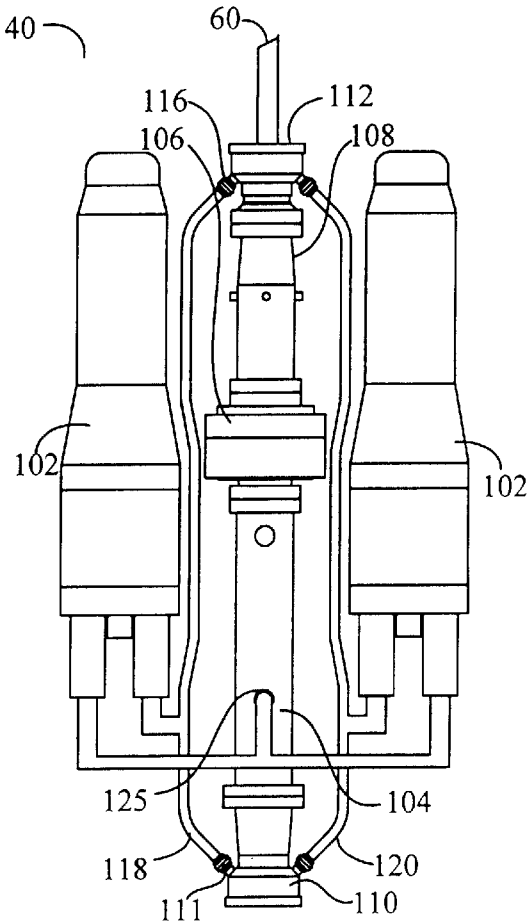
FIG. 2B is a detailed view of the mud lift module shown in FIG. 1.
Figure 2A:
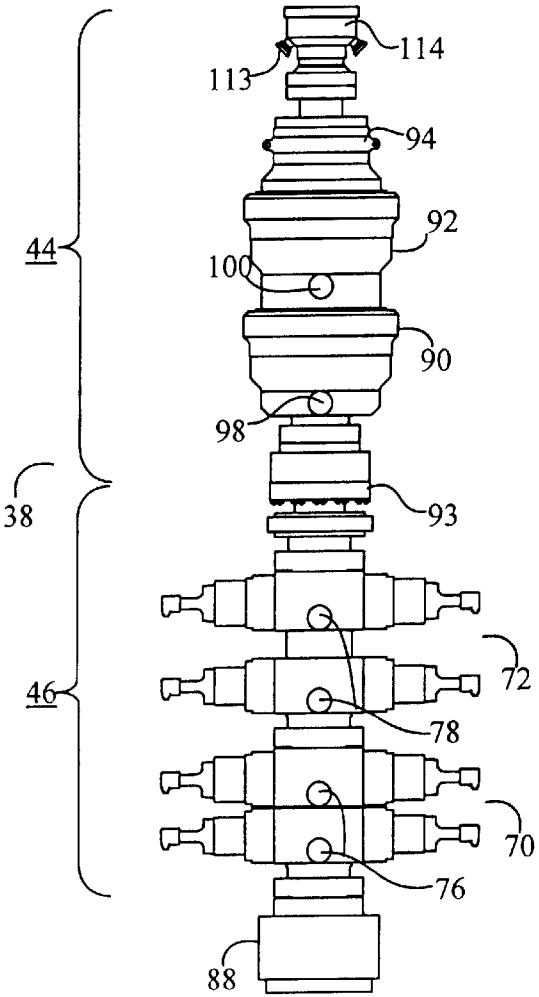
FIG. 2A is a detailed view of the well control assembly shown in FIG. 1.

FIG. 2A shows the components of the well control assembly 38 which was previously illustrated in FIG. 1. As shown, the well control assembly 38 includes a lower marine riser package (LMP) 44 and a subsea blowout preventer (BOP) stack 46. The BOP stack 46 includes a pair of dual ram preventers 70 and 72. However, other combinations, such as, a triple ram preventer combined with a single ram preventer may be used. Additional preventers may also be required depending on the preferences of the drilling operator. The ram preventers are equipped with pipe rams for sealing around a pipe and shear/blind rams for shearing the pipe and sealing the well. The ram preventers 70 and 72 have flow ports 76 and 78, respectively, that may be connected to choke/kill lines (not shown). A wellhead connector 88 is secured to the lower end of the ram preventer 70. The wellhead connector 88 is adapted to mate with the upper end of the wellhead 35 (shown in FIG. 1).

The LMRP 44 includes annular preventers 90 and 92 and a flexible joint 94. However, the LMRP 44 may take on other configurations, e.g., a single annular preventer and a flexible joint. The annular preventers 90 and 92 have flow ports 98 and 100 that may be connected to choke/kill lines (not shown). The lower end of the annular preventer 90 is connected to the upper end of the ram preventers 72 by a LMRP connector 93. The flexible joint 94 is mounted on the upper end of the annular preventer 92. A riser connector 114 is attached to the upper end of the flexible joint 94. The riser connector 114 includes flow ports 113 which may be hydraulically connected to the flow ports 76, 78, 98, and 100. The LMRP 44 includes control modules (not shown) for operating the ram preventers 70 and 72, the annular preventers 90 and 92, various connectors and valves in the wellhead stack 37, and other controls as needed. Hydraulic fluid is supplied to the control modules from the surface through hydraulic lines (not shown) that may be attached to the outside of the riser 52 (shown in FIG. 1).

Mud lift module

FIG. 2B shows the components of the mud lift module 40 which was previously illustrated in FIG. 1. As shown, the mud lift module 40 includes subsea mud pumps 102, a flow tube 104, a non-rotating subsea diverter 106, and a rotating subsea diverter 108.

The lower end of the flow tube 104 includes a riser connector 110 which is adapted to mate with the riser connector 114 (shown in FIG. 2A) at the upper end of the flexible joint 94. When the riser connector 110 mates with the riser connector 114, the flow ports 111 in the riser connector 110 are in communication with the flow ports 113 (shown in FIG. 2A) in the riser connector 114. A riser connector 112 is mounted at the upper end of the subsea diverter 108. The flow ports 111 in the riser connector 110 are connected to flow ports 116 in the riser connector 112 by pipes 118 and 120, and the pipes 118 and 120 are in turn hydraulically connected to the discharge ends of the subsea mud pumps 102. The suction ends of the subsea mud pumps 102 are hydraulically connected to flow outlets 125 in the flow tube 104.

The subsea diverters 106 and 108 are arranged to divert mud from the well annulus 66 (shown in FIG. 1) to the suction ends of the subsea mud pumps 102. The diverters 106 and 108 are also adapted to slidingly receive and seal around a drill string, e.g., drill string 60. When the diverters seal around the drill string 60, the fluid in the flow tube 104 or below the diverters is isolated from the fluid in the riser 52 (shown in FIG. 1) or above the diverters. The diverters 106 and 108 may be used alternately or together to sealingly engage a drill string and, thereby, isolate the fluid in the annulus of the riser 52 from the fluid in the well annulus 66. It should be clear that either the diverter 106 or 108 may be used alone as the separating medium between the fluid in the riser 52 and the fluid in the well annulus 66. A rotating blowout preventer (not shown), which could be included in the well control assembly 38 (shown in FIG. 2A), may also be used in place of the diverters. The diverter 108 may also be mounted on the annular preventer 92 (shown in FIG. 2A), and mud flow into the suction ends of the subsea pumps 102 may be taken from a point below the diverter.

Non-Rotating Subsea Diverter

Figure 3A:
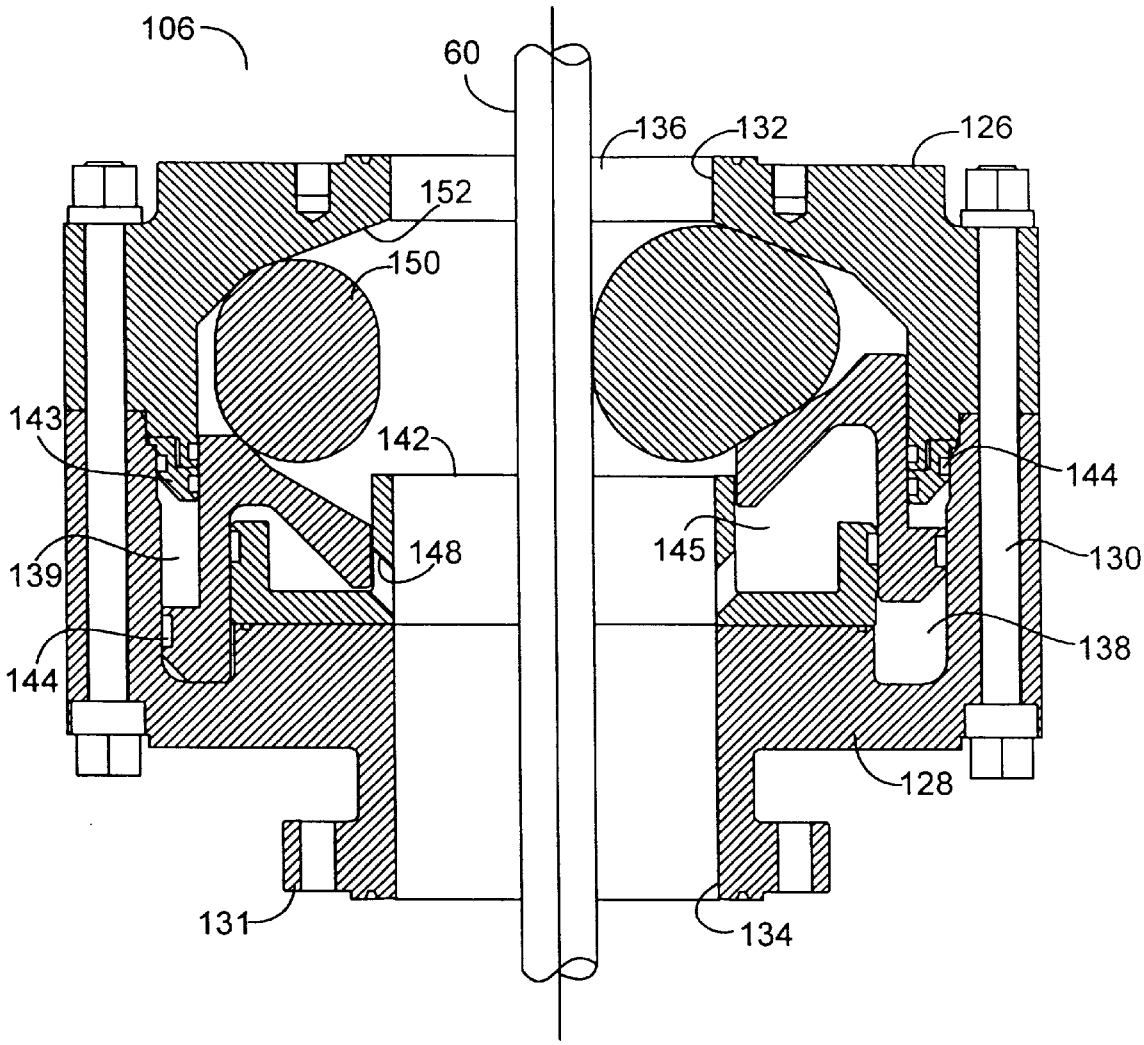
FIGS. 3A and 3B are cross sections of non-rotating subsea diverters.

FIG. 3A shows a vertical cross section of the non-rotating subsea diverter 106 which was previously illustrated in FIG. 2B. As shown, the non-rotating subsea diverter 106 includes a head 126 that is fastened to a body 128 by bolts 130. However, other means, such as a screwed or radial latched connection, may be used in place of bolts 130. The body 128 has a flange 131 that may be bolted to the upper end of the flow tube 104, as shown in FIG. 2B. The head 126 and body 128 are provided with bores 132 and 134, respectively. The bores 132 and 134 form a passageway 136 for receiving a drill string, e.g., drill string 60. The body 128 has a closing cavity 138 and an opening cavity 139. A piston 140 is arranged to move inside the cavities 138 and 139 in response to pressure of the hydraulic fluid fed into these cavities. At the upper end of the body 128 is a sleeve 142 and cover 143 which guide the piston 140 as it moves inside the cavities 138 and 139.

The cavity 138 is enveloped by the body 128, the piston 140, and the sleeve 142. The cavity 139 is enveloped by the body 128, the piston 140, and cover 143. As the piston 140 moves inside the cavities 138 and 139, seal rings 144 contain hydraulic fluid in the cavities. The sleeve 142 is provided with holes 148 for venting fluid out of a cavity 145 below the piston 140. A resilient, elastomeric, toroid-shaped, sealing element 150 is located between the upper end of the piston 140 and a tapered portion 152 of the internal wall of the head 126. The sealing element 150 may be actuated to seal around a drill string, e.g., drill string 60, in the passageway 136.

The piston 140 moves downwardly to open the passageway 136 when hydraulic fluid is supplied to the opening cavity 139. As illustrated in the left half of the drawing, when the piston 140 sits on the body 128, the sealing element 150 does not extrude into the passageway 136 and the diverter 106 is fully open. When the diverter 106 is fully open, the passageway 136 is large enough to receive a bottom hole assembly and other drilling tools. When hydraulic fluid is fed into the cavity 138, the piston 140 moves upwardly to close the diverter 106. As illustrated in the right half of the drawing, when the piston 140 moves upwardly, the sealing element 150 is extruded into the passageway 136. If there is a drill string in the passageway 136, the extruded sealing element 150 would contact the drill string and seal the annulus between the passageway 136 and the drill string.

Figure 3B:
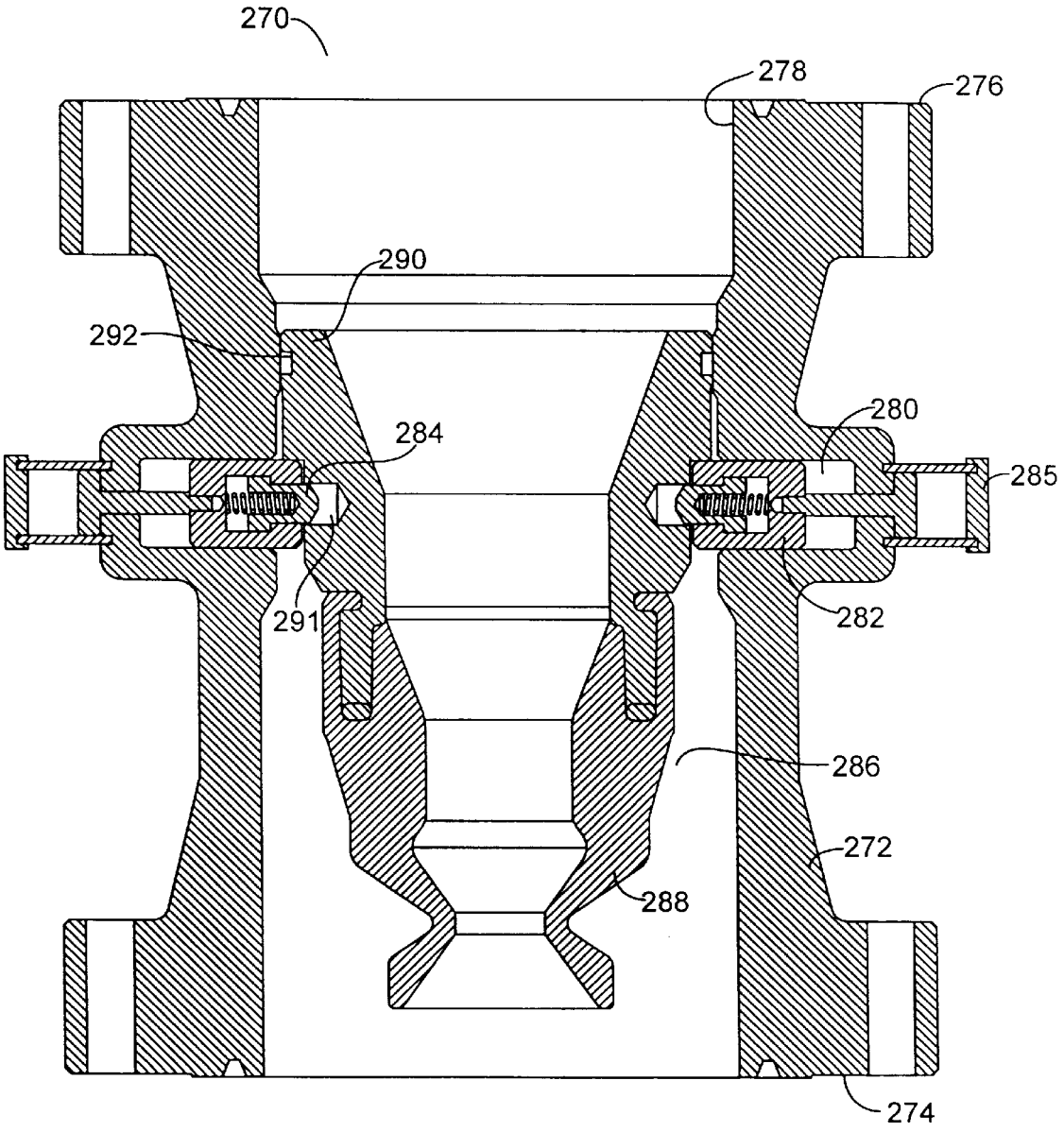

FIG. 3B shows a vertical cross section of another non-rotating subsea diverter, i.e., subsea diverter 270, that may be used in place of the non-rotating subsea diverter 106. The subsea diverter 270 includes a housing body 272 with flanges 274 and 276 which are provided for connection with other components of the wellhead stack 37, e.g., the flow tube 104 and the subsea diverter 108 (shown in FIG. 2B). The housing body 272 is provided with a bore 278 and pockets 280. The pockets 280 are distributed along a circumference of the housing body 272. Inside each pocket 280 is a retractable landing shoulder 282 and a lock 284.

Hydraulic actuators 285 are provided to actuate the locks 284 to engage a retrievable stripper element 286 which is disposed within the bore 278 of the housing body 272.

The stripper element 286 includes a stripper rubber 288 that is bonded to a metal body 290. The locks 284 slide into recesses 291 in the metal body 290 to lock the metal body 290 in place inside the housing body 272. A seal 292 on the metal body 290 forms a seal between the housing body 272 and the metal body 290. The stripper rubber 288 sealingly engages a drill string that is received inside the bore 278 while permitting the drill string to rotate and move axially inside the bore 278. The stripper rubber 288 does not rotate with the drill string so the rubber 288 is subjected to friction forces associated with both the rotational and vertical motions of the drill string. The stripper element 286 may be carried into and out of the housing body 272 on a handling tool which may be positioned above the bottom hole assembly of the drill string.

Rotating Subsea Diverter

Figure 4A:
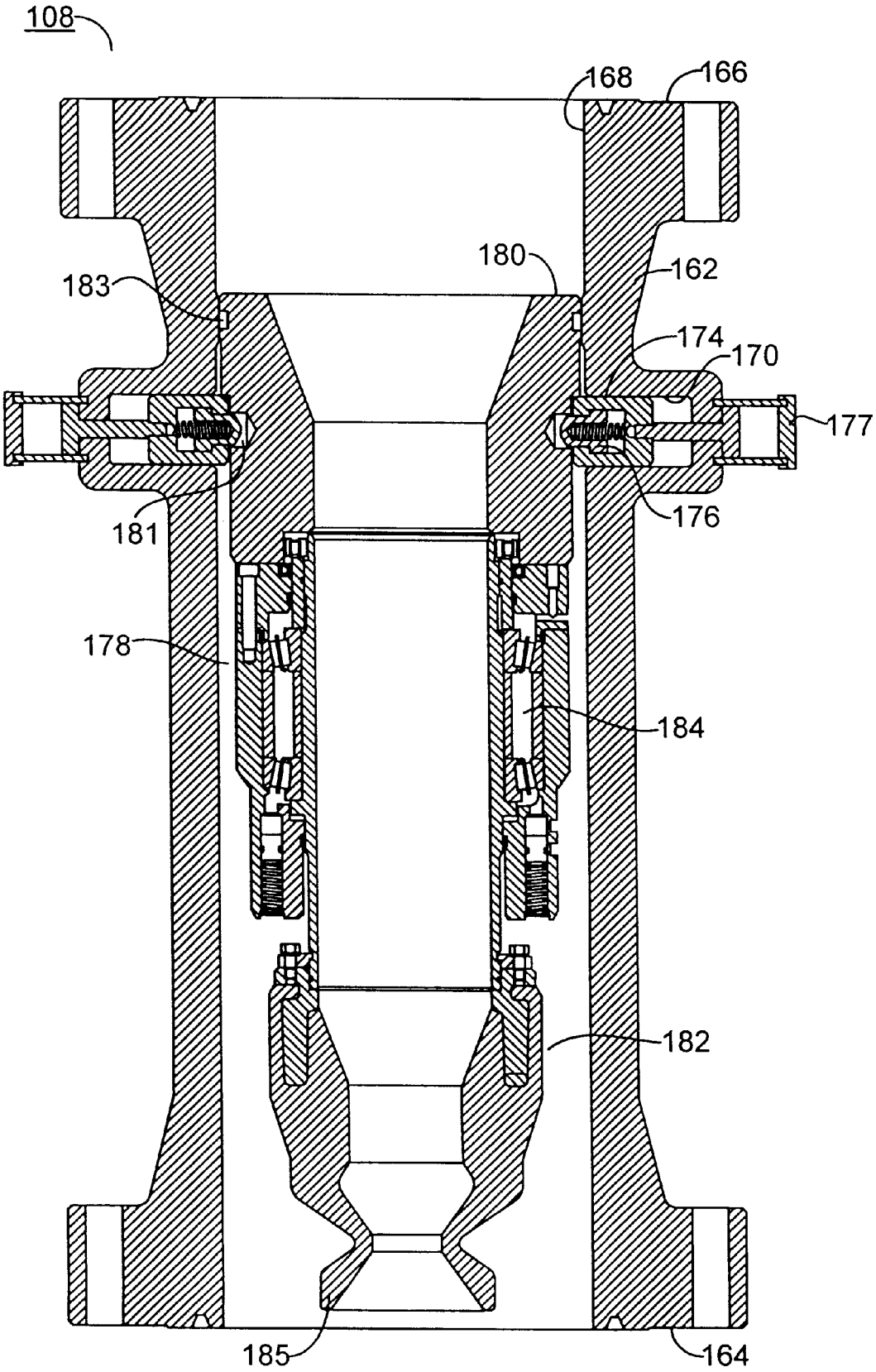
FIGS. 4A–4F are cross sections of rotating subsea diverters.

FIG. 4A shows a vertical cross section of the rotating subsea diverter 108 which was previously illustrated in FIG. 2B. As shown, the rotating subsea diverter 108 includes a housing body 162 with flanges 164 and 166. The flange 164 is arranged to mate with the upper end of the diverter 106 (shown in FIG. 3A). The housing body 162 is provided with a bore 168 and pockets 170. The pockets 170 are distributed along a circumference of the housing body 162. Inside each pocket 170 is a retractable landing shoulder 174 and a lock 176. Hydraulic actuators 177 are provided to operate the locks 176. Although the lock 176 is shown as being hydraulically actuated, it should be clear that the lock 176 may be actuated by other means, e.g., the lock 176 may be radially loaded with springs. The lock 176 may also incorporate a mechanism that permits intervention by a remote operated vehicle (ROV) such as a "T" handle in series with the actuator for gripping by the ROV manipulator.

A retrievable spindle 178 is disposed in the bore 168 of the housing body 162. The spindle 178 has an upper portion 180 and a lower portion 182. The upper portion 180 has recesses 181 into which the locks 176 may slide to lock the upper portion 180 in place inside the housing body 162. A seal 183 on the upper portion 180 seals between the housing body 162 and the upper portion 180. A bearing assembly 184 is attached to the upper portion 180. The bearing assembly 184 has bearings which support the lower portion 182 of the spindle 178 for rotation inside the housing body 162. A stripper rubber 185 is bonded to the lower portion 182 of the spindle 178. The stripper rubber 185 rotates with and sealingly engages a drill string (not shown) that is received in the bore 168 while permitting the drill string to move vertically.

In operation, the spindle 178 is carried into the housing body 162 on a handling tool that is mounted on the drill string. When the spindle 178 lands on the shoulder 174, the drill string is rotated until the locks 176 are aligned with the recesses 181 in the upper portion 180 of the spindle 178. Then the hydraulic actuators 177 are operated to push the locks 176 into the recesses 181. The stripper rubber 185 seals against the drill string while allowing the drill string to be lowered into the well. During drilling, friction between the rotating drill string and the stripper rubber 185 provides sufficient force to rotate the lower portion 182 of the spindle 178. While the lower portion 182 is rotated, the stripper rubber 185 is only subjected to the friction forces associated with the vertical motion of the drill string. This has the effect of prolonging the wear life of the stripper rubber 185. When the drill string is pulled out of the well, the hydraulic actuators 177 may be operated to release the locks 176 from the recesses 181 so that the handling tool on the drill string can engage the spindle 178 and pull the spindle 178 out of the housing body 162.

Figure 4B:
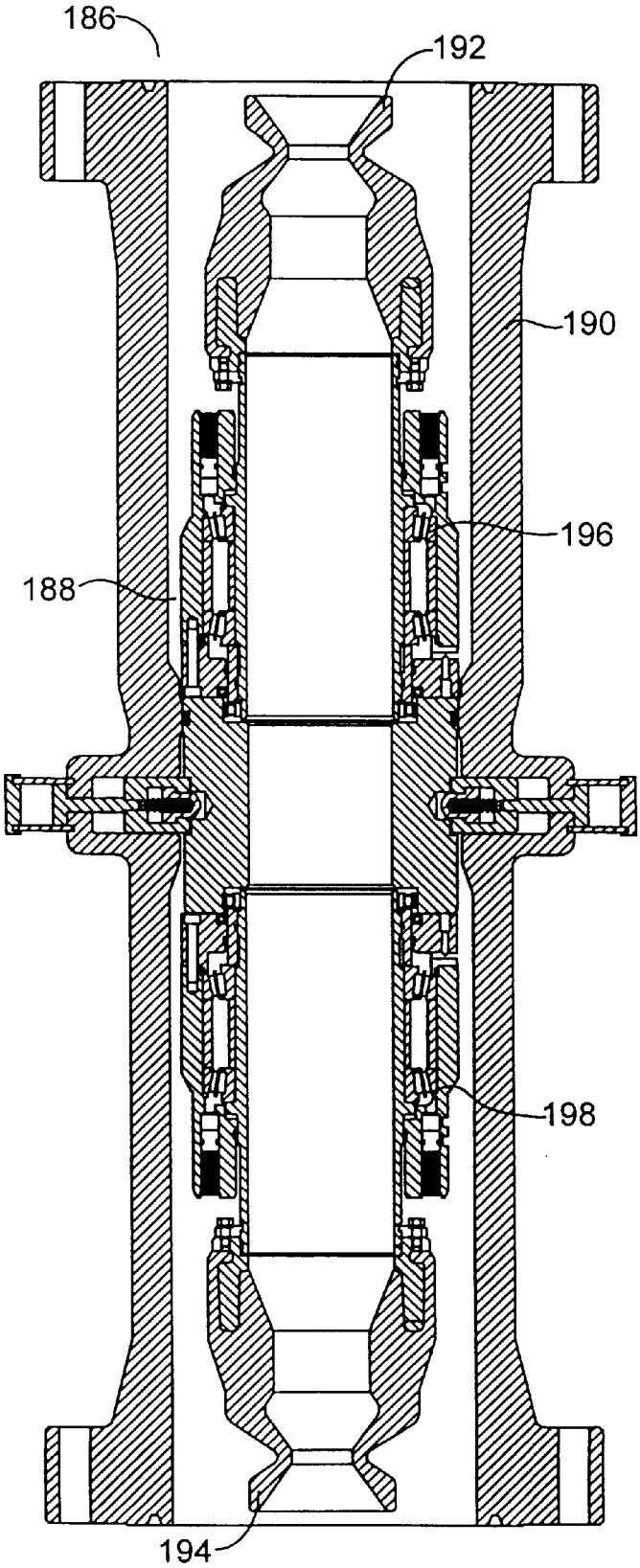

FIG. 4B shows a vertical cross section of another rotating subsea diverter, i.e., rotating subsea diverter 186, that may be used in place of the rotating subsea diverter 108. The subsea diverter 186 includes a retrievable spindle 188 which is disposed in a housing body 190. The spindle 188 includes two opposed stripper rubbers 192 and 194. The stripper rubber 192 is oriented to effect a seal around a drill string when the pressure above the spindle 188 is greater than the pressure below the spindle 188. The spindle 188 includes two bearing assemblies 196 and 198 which support the stripper rubbers 192 and 194, respectively, for rotation.

Figure 4C:
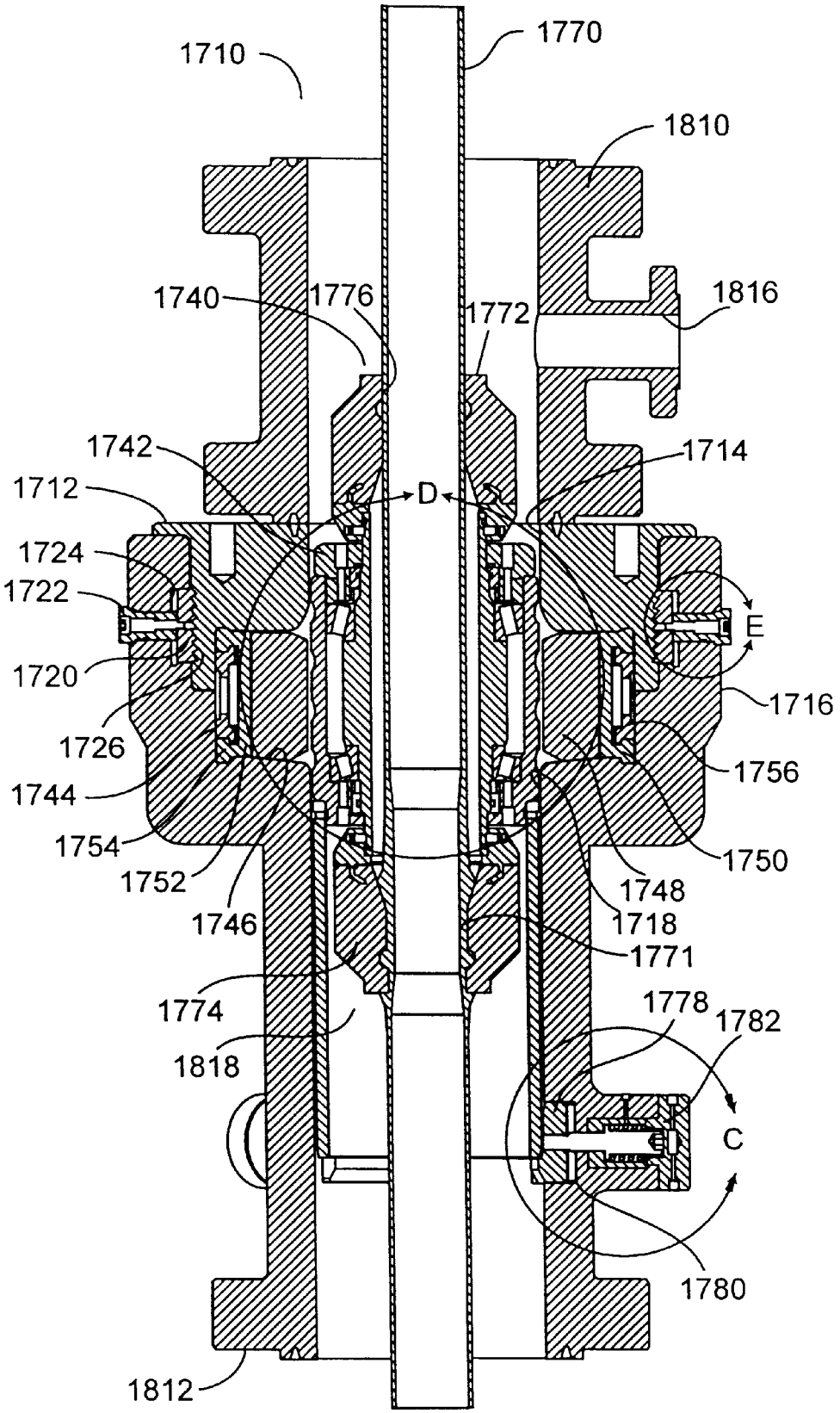
Figure 4D:
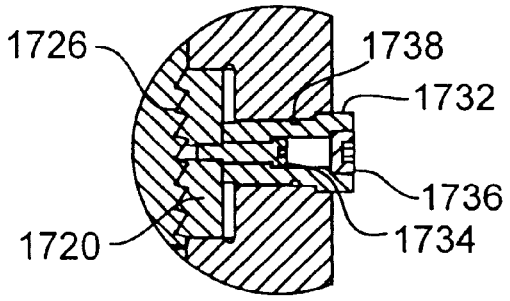

FIG. 4C shows a vertical cross section of another rotating subsea diverter, i.e., rotating subsea diverter 1710, which may be used in place of the rotating subsea diverter 108 and/or the non-rotating subsea diverter 106. The rotating subsea diverter 1710 includes a head 1712 which has a vertical bore 1714 and a body 1716 which has a vertical bore 1718. The head 1712 and the body 1716 are held together by a radial latch 1720 and locks 1722. The radial latch 1720 is disposed in an annular cavity 1724 in the body 1716 and is secured to the head 1712 by a series of interlocking grooves 1726. The locks 1722 are distributed in pockets 1730 along a circumference of the body 1716. As shown in FIG. 4D, each lock 1722 includes a clamp 1732 which is secured to the radial latch 1720 by a screw 1734. A plug 1736 and a seal 1738 are provided to keep fluid and debris out of each pocket 1730.

A retrievable spindle assembly 1740 is disposed in the vertical bores 1714 and 1718. The spindle assembly 1740 includes a spindle housing 1742 which is secured to the body 1716 by an elastomer clamp 1744. The elastomer clamp 1744 is disposed in an annular cavity 1746 in the body 1716 and includes an inner elastomeric element 1748 and an outer elastomeric element 1750. The inner elastomeric element 1748 may be made of a different material than the outer elastomeric element 1750. The outer elastomeric element 1750 has an annular body 1752 with flanges 1754. A ring holder 1756 is arranged between the flanges 1754 to support and add stiffness to the outer elastomeric element 1750. The inner elastomeric element 1748 is formed in the shape of a torus and arranged within the outer elastomeric element 1750. When fluid pressure is fed to the outer elastomeric element 1750 through a port (not shown) in the body 1716, the outer elastomeric element 1750 inflates and applies force to the inner elastomeric element 1748, extruding the inner elastomeric element 1748 to engage and seal against the spindle housing 1742.

Figure 4E:
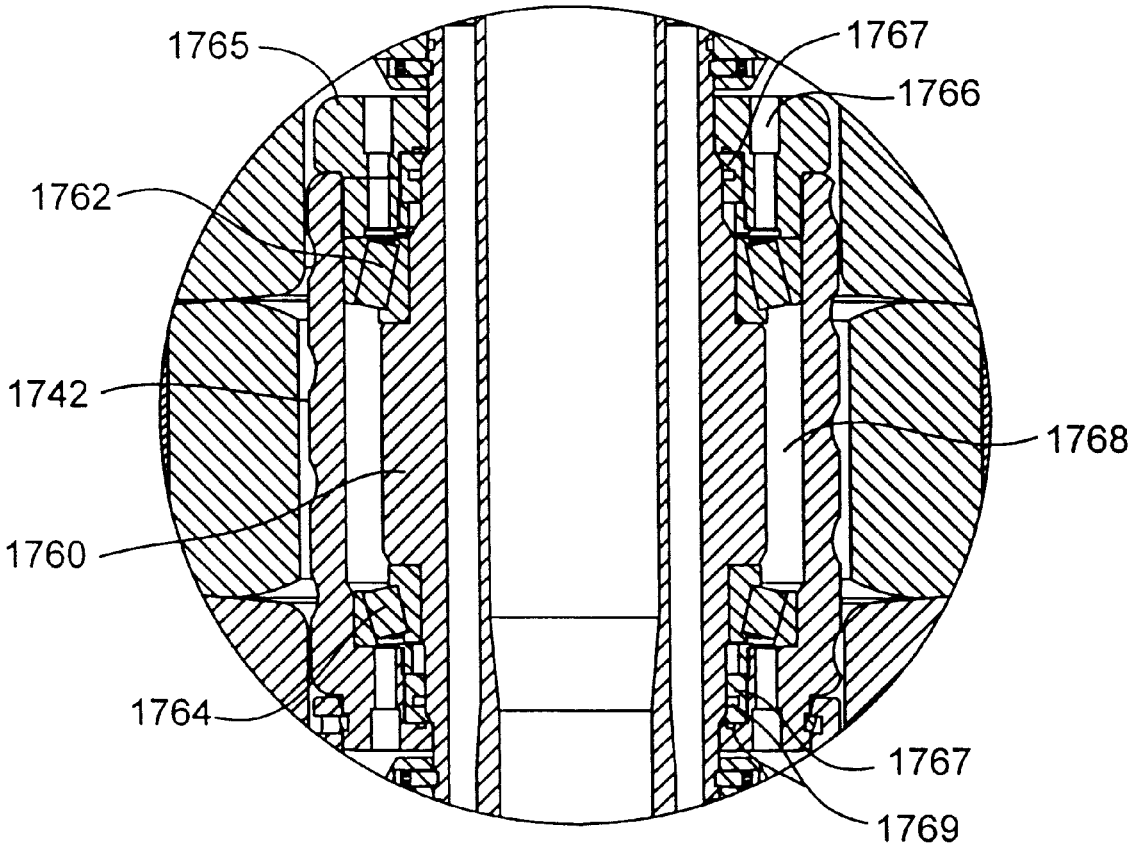

As shown in FIG. 4E, the spindle assembly 1740 further comprises a spindle 1760 which extends through the spindle housing 1742. The spindle 1760 is suspended in the spindle housing 1742 by bearings 1762 and 1764. The bearing 1762 is secured between the spindle housing 1742 and the spindle 1760 by a bearing cap 1765. The spindle housing 1742, the spindle 1760, and the bearings 1762 and 1764 define a chamber 1768 which holds lubricating fluid for the bearings. The bearing cap 1765 may be removed to access the chamber 1768. Pressure intensifiers 1766 are provided to boost the pressure in the chamber 1768 as necessary so that the pressure in the chamber 1768 balances or exceeds the pressure above and below the spindle 1760. Referring back to FIG. 4C, the spindle 1760 includes an upper packer element 1772, a lower packer element 1774, and a central passageway 1776 for receiving a drill string, e.g., drill string 1770.

Figure 4F:
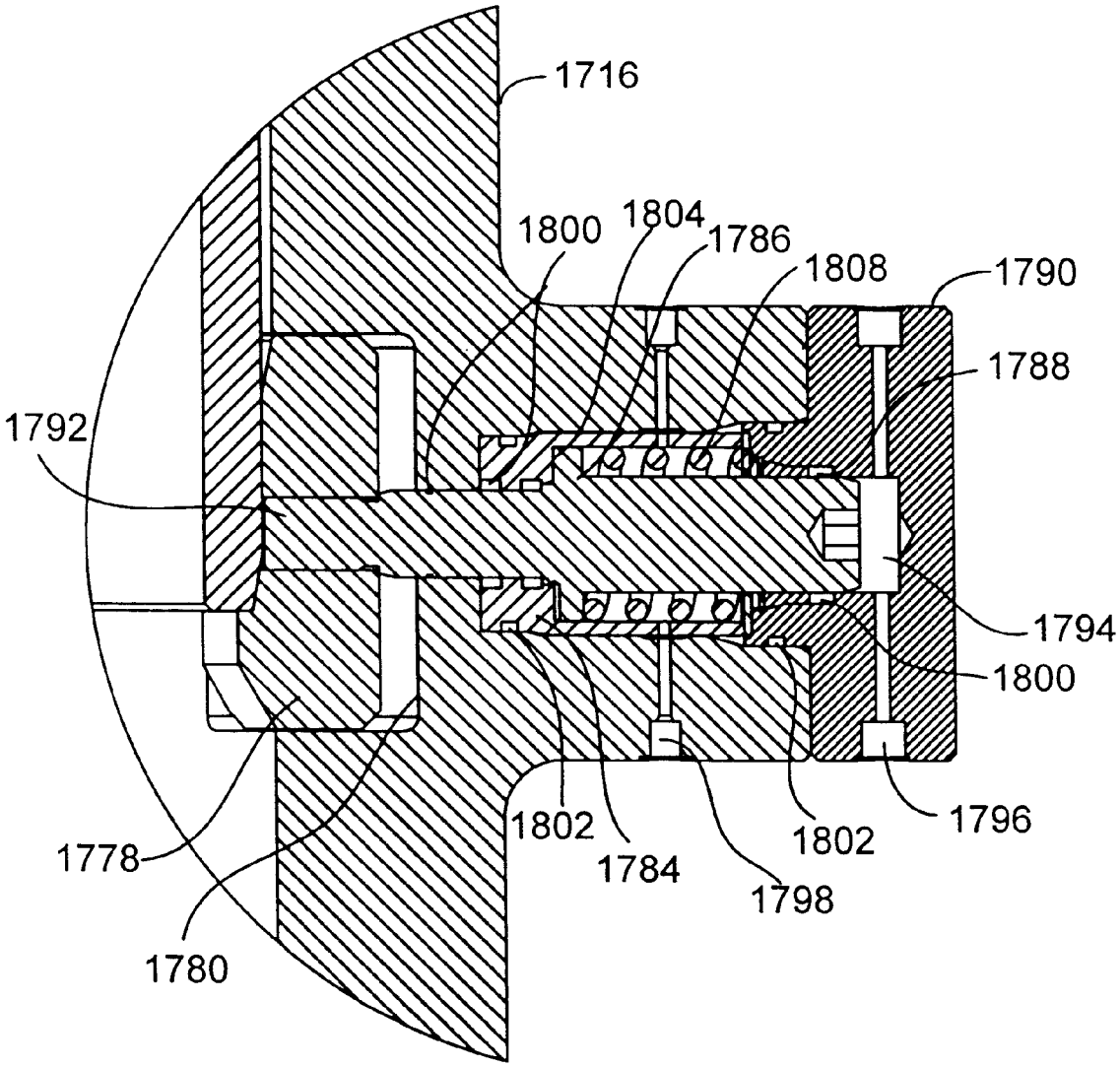

A landing shoulder 1778 is disposed in a pocket 1780 in the body 1716. The landing shoulder 1778 may be extended out of the pocket 1780 or retracted into the pocket 1780 by a hydraulic actuator 1782. When the landing shoulder 1778 is extended out of the pocket 1780, it prevents the spindle assembly 1740 from falling out of the body 1716. As shown in FIG. 4F, the hydraulic actuator 1782 comprises a cylinder 1784 which houses a piston 1786. The cylinder 1784 is arranged in a cavity 1788 on the outside of the body 1716 and held in place by a cap 1790. A threaded connection 1792 attaches one side of the piston 1786 to the landing shoulder 1778. The piston 1786 extends from the landing shoulder 1778 into a cavity 1794 in the cap 1790. The cap 1790 and the cylinder 1784 include ports 1796 and 1798 through which fluid may be fed into or discharged from the cavity 1794 and the interior of the cylinder 1784, respectively. Dynamic seals 1800 are provided on the piston 1786 to contain fluid in the cylinder 1784 and the cavity 1794. Additional static seals 1802 are provided between the cylinder 1784 and cap 1790 and the body 1716 to keep fluid and debris out of the cylinder 1784.

The landing shoulder 1778 is in the fully extended position when the piston 1786 touches a surface 1804 in the cylinder 1784. The landing shoulder 1778 is in the fully retracted position when it touches a surface 1806 in the body 1716. The piston 1786 is normally biased toward the surface 1804 by a spring 1808. In this position, the landing shoulder 1778 is fully extended and the spindle assembly 1740 seats on the landing shoulder 1778. The spring force must overcome the force due to the pressure at the lower end of the spindle 1760 to keep the piston 1786 in contact with the surface 1804. If the spring force is not sufficient, fluid may be fed into the cavity 1794 at a higher pressure than the fluid pressure in the cylinder 1784. The pressure differential between the cavity 1794 and the cylinder 1784 would provide the additional force necessary to move the piston 1786 against the surface 1804 and retain the landing shoulder 1778 in the fully extended position.

When it is desired to retract the landing shoulder 1778, fluid pressure may be fed into the cylinder 1784 at a higher pressure than the fluid pressure in the cavity 1794. The pressure differential between the cylinder 1784 and cavity 1794 moves the piston 1786 to the retracted position. The ports 1796 in the cap 1790 allow fluid to be exhausted from the cavity 1794 as the piston 1786 moves to the retracted position. Again, to move the piston 1786 back to the extended position, fluid pressure is released from the cylinder 1784, and, if necessary, additional fluid pressure is introduced into the cavity 1794. Pressure sensors may be used to monitor the pressure below the spindle assembly 1740 and in the cavity 1794 and cylinder 1784 to help determine how pressure may be applied to fully extend or retract the landing shoulder 1778. A position indicator (not shown) may be added to signal the drilling operator that the piston is in the extended or retracted position.

A connector 1810 on the head 1712 and the mounting flange 1812 at the lower end of the body 1716 allow the diverter 1710 to be interconnected in the wellhead stack 37. In one embodiment, the mounting flange 1812 may be attached to the upper end of the flow tube 104 (shown in FIG. 2B) and the connector 1810 may provide an interface between the mud lift module 40 (shown in FIG. 1) and the pressure-balanced mud tank 42 or the riser 52 (shown in FIG. 1). When the mounting flange 1812 is attached to the upper end of the flow tube 104, the space 1818 below the packer 1774 is in fluid communication with the well annulus 66 (shown in FIG. 1).

The diameters of the vertical bores 1714 and 1718 are such that any tool that can pass through the marine riser 52 (shown in FIG. 1) can also pass through them. The retractable landing shoulder 1778 may be retracted to allow passage of large tools and may be extended to allow proper positioning of the spindle assembly 1740 within the bores 1714 and 1718. The spindle assembly 1740 can be appropriately sized to pass through the marine riser 52 and can be run into and retrieved from the vertical bores 1714 and 1718 on a drill string, e.g., drill string 1770. As shown, a handling tool 1771 on the drill string 1770 is adapted to engage the lower packer element 1774 of the spindle 1760 such that the spindle assembly 1740 can be run into the vertical bores 1714 and 1718. When the spindle assembly 1740 lands on the landing shoulder 1774, the inner elastomeric element 1748 is energized to engage the spindle assembly 1740. Once the spindle assembly 1740 is engaged, the handling tool 1771 can be disengaged from the spindle assembly 1740 by further lowering the drill string 1770. The handling tool 1771 will again engage the spindle assembly 1740 when it is pulled to the lower packer element 1774, thus allowing the spindle assembly 1740 to be retrieved to the surface.

Pressure-Balanced Mud Tank

Figure 2C:
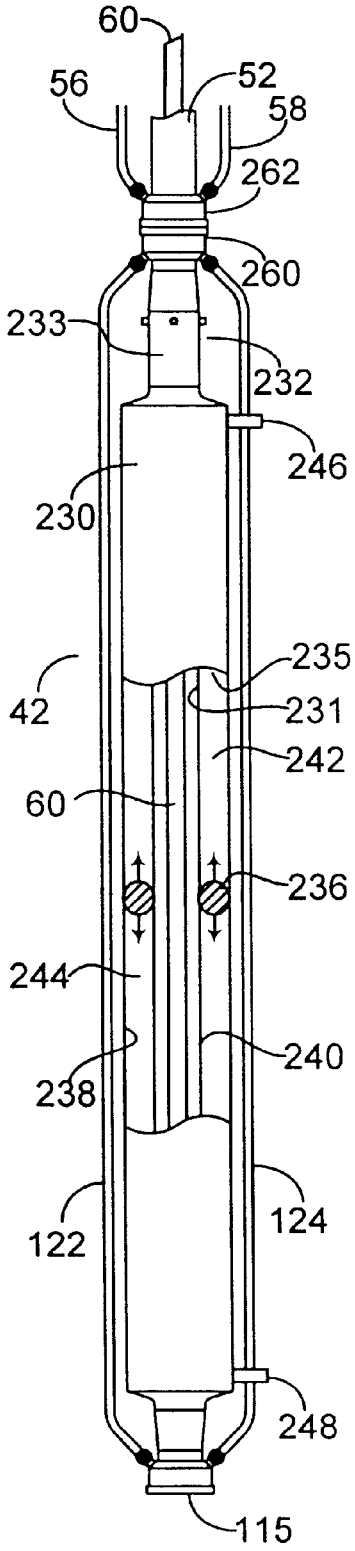
FIG. 2C is a detailed view of the pressure-balanced mud tank shown in FIG. 1.

FIG. 2C shows the pressure-balanced mud tank 42, which was previously illustrated in FIG. 1, in greater detail. As shown, the pressure-balanced mud tank 42 includes a generally cylindrical body 230 with a bore 231 running through it. The bore 231 is arranged to receive a drill string, e.g., drill string 60, a bottom hole assembly, and other drilling tools. An annular chamber 235 which houses an annular piston 236 is defined inside the body 230. The annular piston engages and seals against the inner walls 238 and 240 of the body 230 to define a seawater chamber 242 and a mud chamber 244 in the mud tank 42. The seawater chamber 242 is connected to open seawater through the port 246. This allows ambient seawater pressure to be maintained in the seawater chamber 242 at all times. Alternatively, a pump (not shown) may be provided at the port 246 to allow the pressure in the seawater chamber 242 to be maintained at, above, or below that of ambient seawater pressure. The mud chamber 244 is connected through a port 248 to the piping that connects the well annulus 66 to the suction ends of the subsea pumps 102.

The piston 236 reciprocates axially inside the annular chamber 235 when a pressure differential exists between the seawater chamber 242 and the mud chamber 244. A flow meter (not shown) arranged at the port 246 measures the rate at which seawater enters or leaves the seawater chamber 242 as the piston 236 reciprocates inside the chamber 235. Flow readings from the flow meter provide the necessary information to determine mud level changes in the mud tank 42. A position locator (not shown) may also be provided to track the position of the piston 236 inside the annular chamber 235. The position of the piston 236 may then be used to calculate the mud volume in the mud tank 42.

Figure 5:
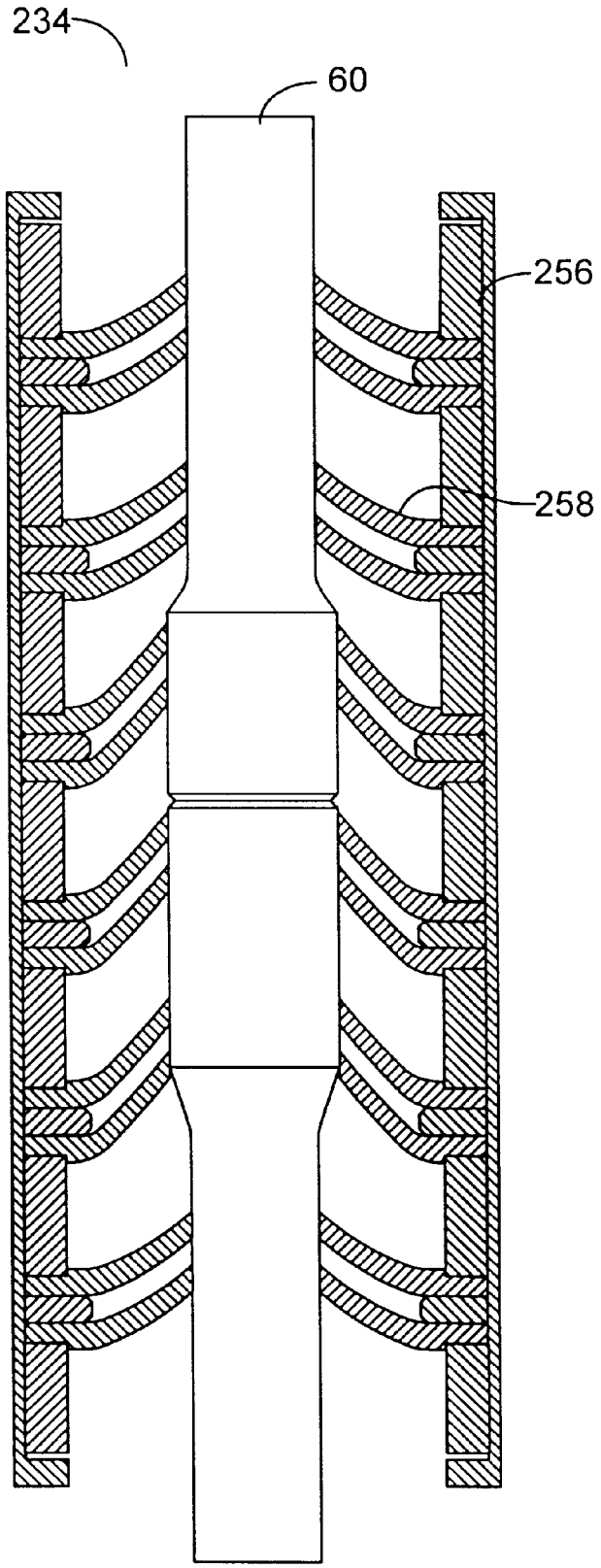
FIG. 5 is a cross section of a wiper.

A wiper 232 is mounted on the body 230. The wiper 232 includes a wiper receptacle 233 which houses a wiper element 234 (shown in FIG. 5). As shown in FIG. 5, the wiper element 234 includes a cartridge 256 which is made of a stack of multiple elastomer disks 258. The elastomer disks 258 are arranged to receive and provide a low-pressure pack-off around a drill string, e.g., drill string 60. The elastomer disks 258 also wipe mud off the drill string as the drill string is pulled through the wiper element 234.

The arrangement of the elastomer disks 258 gives a step-type seal which allows each disk to contain only a fraction of the overall pressure differential across the wiper element 234. The wiper element 234 will be carried into and out of the wiper receptacle 233 on a handling tool (not shown) that is mounted on the drill string 60.

Referring back to FIG. 2C, a riser connector 260 is mounted on the wiper receptacle 233. The riser connector 260 mates with a riser connector 262 at the lower end of the marine riser 52. A riser connector 115 is also provided at the lower end of the body 230. The riser connector 115 is arranged to mate with the riser connector 112 (shown in FIG. 2B) in the mud lift module 40. Flow ports in the riser connector 115 are connected to the mud return lines 56 and 58 through the pipes 122 and 124 and flow ports in the riser connectors 260 and 262. When the riser connector 115 mates with the riser connector 112, the pipes 122 and 124 are in communication with the pipes 118 and 120.

Referring now to FIGS. 2A–2C, when the mud lift module 40, the pressure-balanced mud tank 42, and the riser 52 are mounted on the well control assembly 38, the flexible joint 94 permits angular movement of these assemblies as the drilling vessel 12 (shown in FIG. 1) moves laterally. The angular movement or pivoting of the mud lift module 40 can be prevented by removing the flexible joint 94 from the LMRP 44 and locating it between the mud lift module 40 and the pressure-balanced mud tank 42 or between the pressure-balanced mud tank 42 and the riser 52. When the flexible joint 94 is removed from the LMRP 44, the mud lift module 40 may then be mounted on the LMRP 44 by connecting the flow tube 104 to the upper end of the annular preventer 92.

Figure 6:
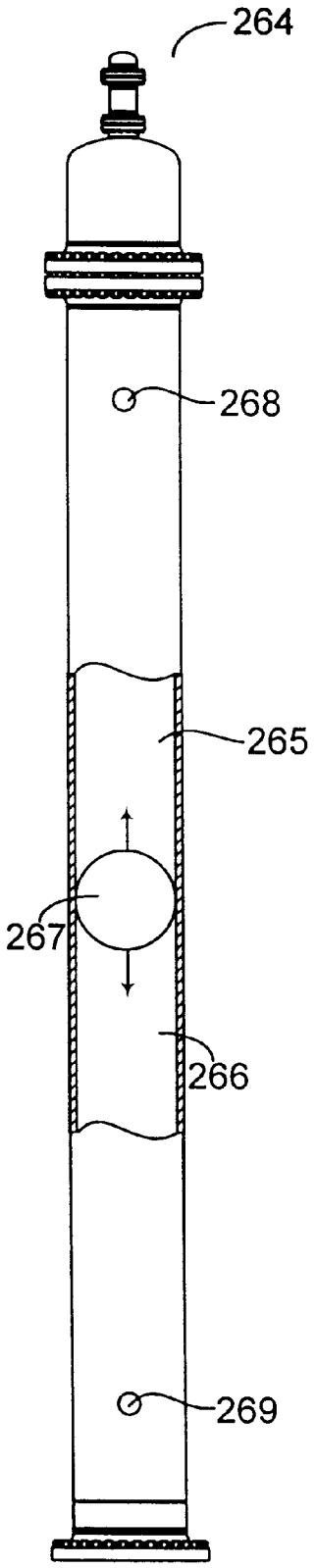
FIG. 6 is an elevation view of another pressure-balanced mud tank.

The height of the wellhead stack 37 (illustrated in FIG. 1) may be reduced by replacing the pressure-balanced mud tank 42 with smaller pressure-balanced mud tanks which may be incorporated with the mud lift module 40. In this embodiment, the connector 262 at the lower end of the riser 52 would then mate with the connector 112 on the rotating subsea diverter 108. Instead of directly connecting the connector 262 to the connector 112, a flexible joint, similar to the flexible joint 94, may be mounted between the connectors 112 and 262. As shown in FIG. 6, a smaller pressure-balanced mud tank 234 includes a seawater chamber 265 which is separated from a mud chamber 266 by a floating, inflatable elastomer sphere 267. Of course, any other separating medium, such as a floating piston, may be used to isolate the seawater chamber 265 from the mud chamber 266.

Seawater may enter or leave the seawater chamber 265 through a port 268. One or more pumps (not shown) may be connected to port 268 to maintain the pressure in the chamber 265 at, above, or below that of ambient seawater pressure. A flow meter (not shown) may be connected to port 268 to measure the rate at which seawater enters or leaves the seawater chamber 265. Mud may enter or be discharged from the mud chamber 266 through a port 269. The port 269 could be connected to the piping that links the well annulus to the suction ends of the subsea pumps 102 (shown in FIG. 2B) or to the flow outlet 125 in the flow tube 104 (shown in FIG. 2B). A position locator (not shown) may also be incorporated to monitor the position of the separating medium as previously explained for the pressure-balanced mud tank 42.

The height of the wellhead stack 37 (illustrated in FIG. 1) may also be reduced by eliminating the pressure-balanced mud tank 42 and employing the riser 52 to perform the function of the pressure-balanced mud tank. As shown in FIG. 7, when the pressure-balanced mud tank 42 is eliminated, a subsea diverter, e.g., the rotating subsea diverter 1710 which was previously illustrated in FIG. 4C, may provide the interface between the mud lift module 40 and the riser 52. In this embodiment, the connector 1810 at the upper end of the rotating subsea diverter 1710 mates with the connector 262, and the mounting flange 1812 mates with the upper end of the flow tube 104. The outlet 1816 in the connector 1810 is connected to a port 1820 in the flow tube 104 by piping 1822 so that mud from the well annulus 66 may flow into the riser 52. Because the mud in the well annulus 66 is heavier than the seawater in the riser 52, the mud 1821 from the well annulus 66 will remain at the bottom of the riser 52 with the seawater 1823 floating on top. This allows the bottom of the riser 52 to function as a chamber for holding mud from the well annulus 66. Mud may be discharged from the riser 52 to the well annulus 66 as necessary. A bypass valve 1824 in the piping 1822 may be operated to control fluid communication between the well annulus 66 and the riser 52.

Figure 7A:
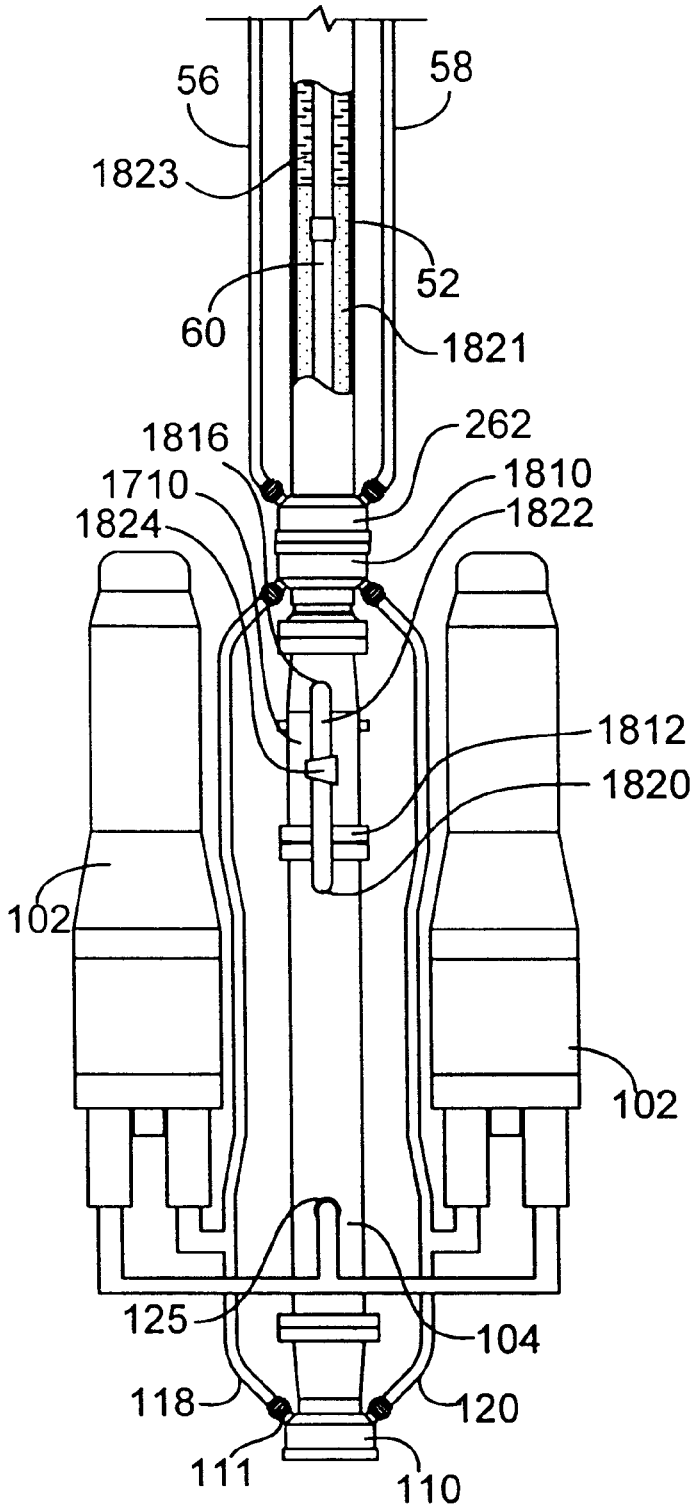
FIGS. 7A and 7B show a riser functioning as a pressure-balanced mud tank.
Figure 7B:
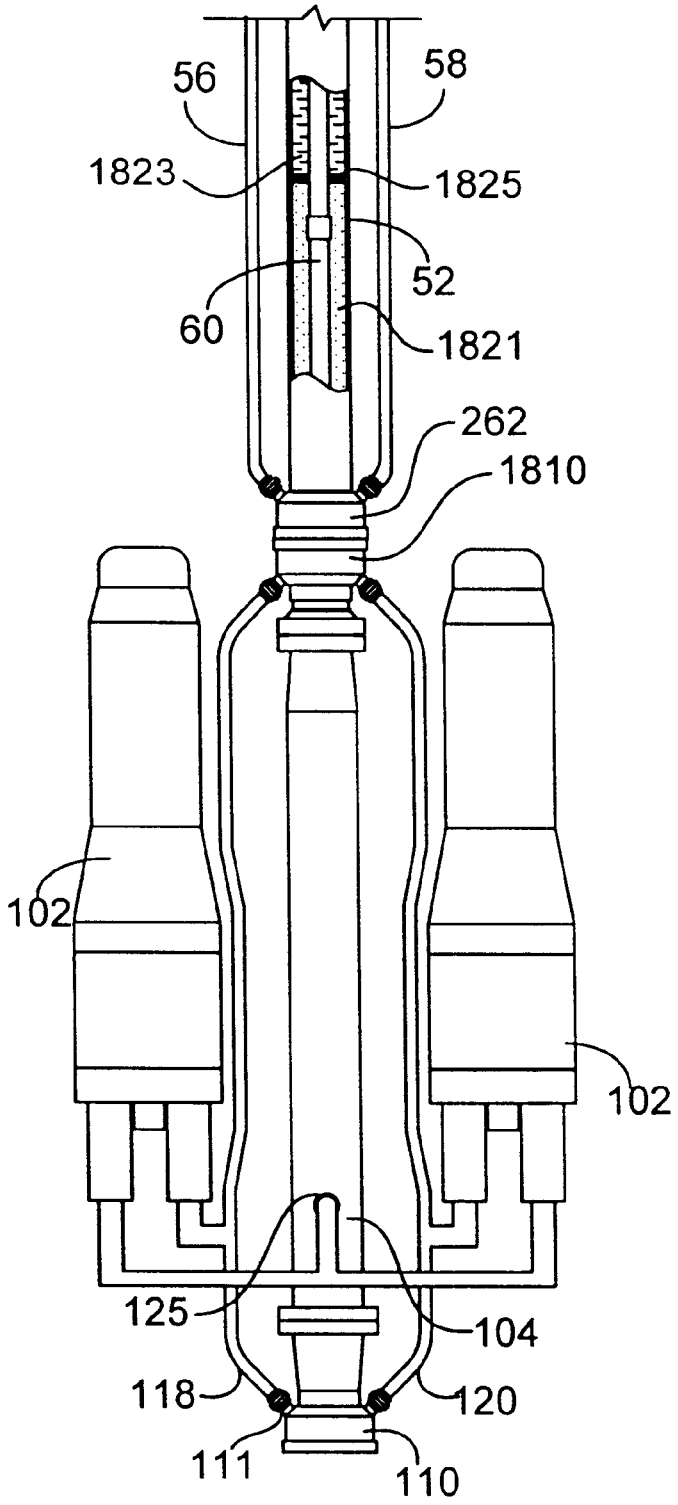

In another embodiment, as shown in FIG. 7B, a floating barrier 1825 which has a bore for receiving a drill string, e.g., drill string 60, may be disposed in the riser 52 to separate the seawater in the riser from the drilling mud. The floating barrier 1825 may have a specific gravity greater than the specific gravity of seawater but less than the specific gravity of the drilling mud so that it floats on the drilling mud and, thereby, separates the drilling mud 1821 from the seawater 1823. In this way, the mixing action created by rotation of the drill string in the riser can be minimized. Means, e.g., spring-loaded ribs, can be provided between the floating barrier 1825 and the riser 52 to reduce the rotation of the floating barrier within the riser. When the floating barrier 1825 is disposed in the riser 52 as shown, the diverter 1710 (shown in FIG. 7A) may be eliminated from the mud lift module. However, it may also be desirable to use the floating barrier 1825 in the embodiment shown in FIG. 7A because the fluids in the riser are also subject to mixing as the drill string is rotated.

Referring now to FIGS. 1–5, preparation for drilling begins with positioning the drilling vessel 12 at a drill site and may include installing beacons or other reference devices on the seafloor 17. It may be necessary to provide remotely operated vehicles, underwater cameras or other devices to guide drilling equipment to the seafloor 17. The use of guidelines to guide the drilling equipment to the seafloor may not be practical if the water is too deep. After positioning of the drilling vessel 12 is completed, drilling operations usually begin with lowering the guide structure 36, conductor housing 33, and conductor pipe 32 on a running tool attached above a bottom hole assembly. The bottom hole assembly, which includes a drill bit and other selected components to drill a planned trajectory, is attached to a drill string that is supported by the drilling rig 20. The bottom hole assembly is lowered to the seafloor and the conductor pipe 32 is jetted into place in the seafloor.

After jetting the conductor pipe 32 in place, the bottom hole assembly is unlocked to drill a hole for the surface pipe 36. Drilling of the hole starts by rotating the drill bit using a rotary table or a top drive. A mud motor located above the drill bit may alternatively be used to rotate the drill bit. While the drill bit is rotated, fluid is pumped down the bore of the drill string. The fluid in the drill string jets out of the nozzles of the drill bit, flushing drill cuttings away from the drill bit. In this initial drilling stage, the fluid pumped down the bore of the drill string may be seawater. After the hole for the surface pipe 36 is drilled, the drill string and the bottom hole assembly are retrieved. Then, the surface pipe 36 is run into the hole and cemented in place. The surface pipe 36 has the subsea wellhead 35 secured to its upper end. The subsea wellhead 35 is locked in place inside the conductor housing 33.

The mud lift drilling operations begin by lowering the wellhead stack 37 to the seafloor through the moon pool 22. This is accomplished by latching the lower end of the marine riser 52 to the upper end of the mud tank 42 at the top of the wellhead stack 37. Then, the marine riser 52 is run towards the seafloor 17 until the subsea BOP stack 406 at the bottom of the wellhead stack 37 lands on and latches to the wellhead 35. The seawater chamber 242 of the mud tank 42 fills with seawater as the wellhead stack 37 is lowered. The mud return lines 56 and 58 are connected to the flow ports in the moon pool 22 after the wellhead stack 37 is secured in place on the wellhead 35.

The drill string 60 with the spindle 178 is lowered through the riser 52 into the housing body 162 of the stripper 108. When the spindle 178 lands on the retractable landing shoulder 174 inside the housing body 162, the drill string is rotated to allow the locks in the housing body to latch into the recesses in the spindle 178. Then the drill string is lowered to the bottom of the well through the diverter 106, the flow tube 104, and the well control assembly 38. When the drill bit 64 touches the bottom of the well 30, the surface pump is started and mud is pumped down the bore of the drill string 60 from the drilling vessel 12. The drill string 60 is rotated from the surface by a rotary table or top drive. A mud motor located above the drill bit may alternatively be used to rotate the drill bit. As the drill string 60 or the drill bit 64 is rotated, the drill bit 64 cuts the formation.

The mud pumped into the bore of the drill string 60 is forced through the nozzles of the drill bit 64 into the bottom of the well. The mud jetting from the bit 64 rises back up through the well annulus 66 to the stripper 108, where it gets diverted to the suction ends of the subsea pumps 102 and to the port 248 of the mud chamber 244 of the mud tank 42. The pumps 102 discharge the mud to the mud return lines 56 and 58. The mud return lines 56 and 58 carry the mud to the mud return system on the drilling vessel 12. The pressure-balanced mud tank 42 is open to receive mud from the well annulus 66 when the pressure of mud at the inlet of the mud chamber 244 is higher than the seawater pressure inside the seawater chamber 242. The riser annulus is filled with seawater so that the pressure of the fluid column in the riser matches that of seawater at any given depth. Of course, any other lightweight fluid may also be used to fill the riser annulus.

Subsea Mud Pump

Figure 8:
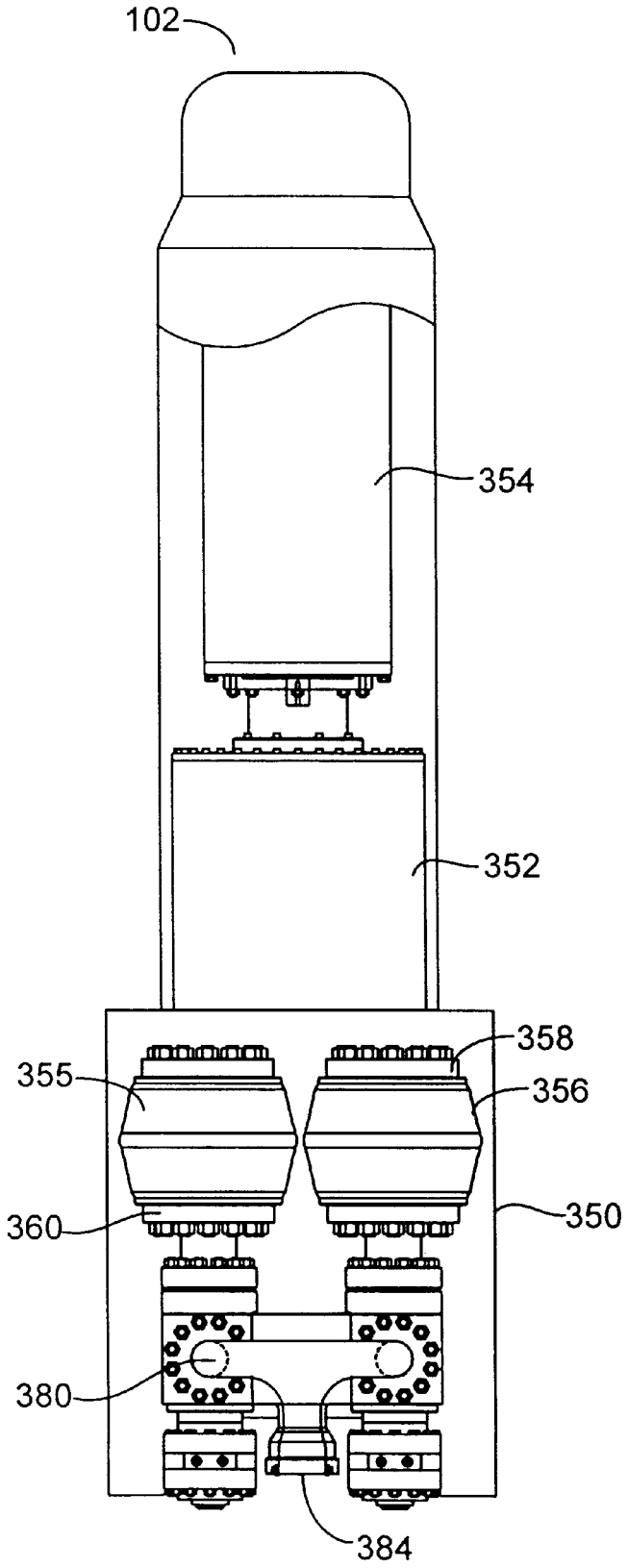
FIG. 8 is an elevation view of a subsea mud pump.

FIG. 8 shows the components of the subsea mud pump 102 which was previously illustrated in FIG. 2B. As shown, the subsea mud pump 102 includes a multi-element pump 350, a hydraulic drive 352, and an electric motor 354. The electric motor 354 supplies power to the hydraulic drive 352 which delivers pressurized hydraulic fluid to the multi-element pump 350. The multi-element pump 350 includes diaphragm pumping elements 355. However, other types of pumping elements, as will be subsequently described, may be used in place of the diaphragm pumping elements 355.

Diaphragm Pumping Element

Figure 9A:
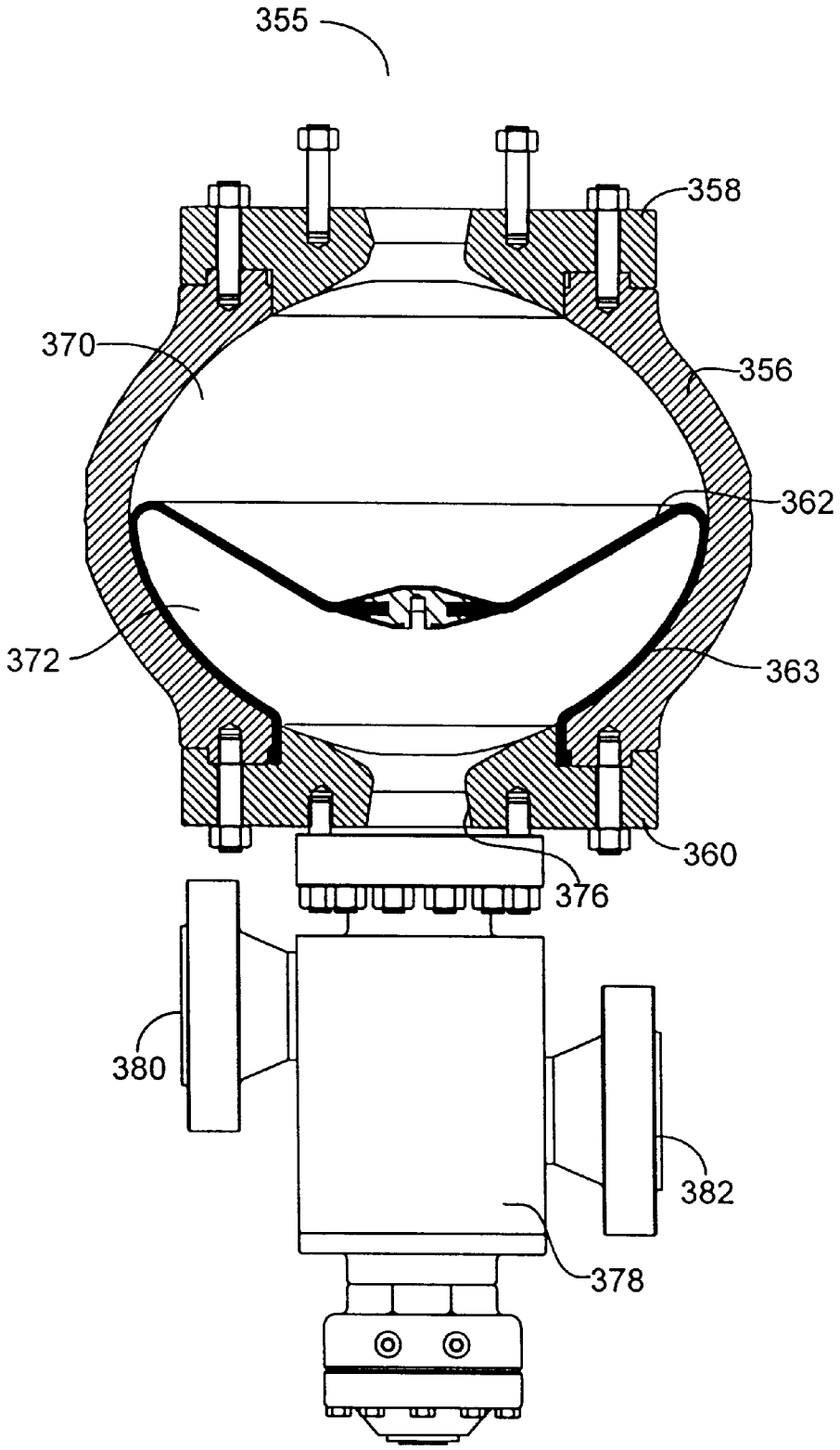
FIG. 9A is a cross section of a diaphragm pumping element.

FIG. 9A shows a vertical cross section of the diaphragm pumping element 355 which was previously illustrated in FIG. 8. As shown, the diaphragm pumping element 355 includes a spherical pressure vessel 356 with end caps 358 and 360. An elastomeric diaphragm 362 is mounted in the lower portion of the pressure vessel 356. The elastomeric diaphragm 362 isolates a hydraulic power chamber 370 from a mud chamber 372 and displaces fluid inside the vessel 356 in response to pressure differential between the hydraulic power chamber 370 and the mud chamber 372. The elastomeric diaphragm 362 also protects the vessel 356 from the abrasive and corrosive mud that maybe received in the mud chamber 372.

The end cap 358 includes a port 374 through which hydraulic fluid may be fed into or discharged from the hydraulic power chamber 370. The end cap 360 includes a port 376 through which fluid may be fed into or discharged from the mud chamber 372. The end cap 360 is preferably constructed from a corrosion-resistant material to protect the port 376 from the abrasive mud entering and leaving mud chamber 372. The end cap 360 is connected to a valve manifold 378 which includes suction and discharge valves for controlling mud flow into and out of the mud chamber 372. The valve manifold 378 has an inlet port 380 and an outlet port 382. The ports 380 and 382 may be selectively connected to the port 376 in the end cap 360. As shown in FIG. 8, the inlet ports 380 are linked to a conduit 384 which may be connected to the flow outlet 125 in the flow tube (shown in FIG. 2B). Although not shown, the outlet ports 382 are also linked to a conduit which may be connected to the mud return lines 56 and 58.

Piston Pumping Element

Figure 9B:
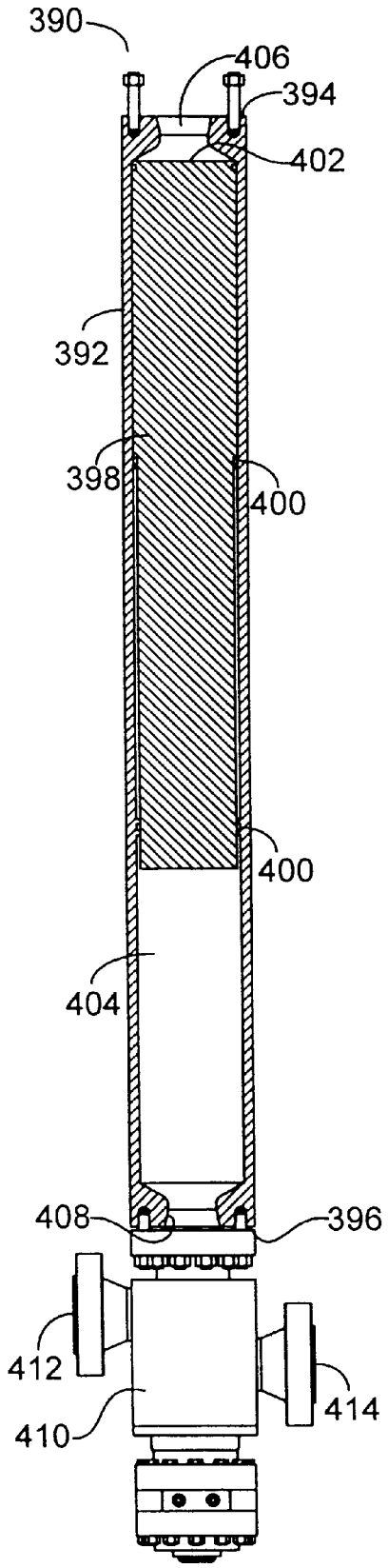
FIG. 9B is a cross section of a piston pumping element.

FIG. 9B shows a piston pumping element 390 that may be used in place of the diaphragm pumping element 355 which was previously illustrated in FIG. 8. As shown, the piston pumping element 390 includes a cylindrical pressure vessel 392 with an upper end 394 and a lower end 396. A piston 398 is disposed inside the vessel 392. Seals 400 seal between the piston 398 and the pressure vessel 392. The piston 398 defines a hydraulic power chamber 402 and a mud chamber 404 inside the pressure vessel 392 and moves axially within the vessel 392 in response to pressure differential between the chambers 402 and 404. The piston 398 and pressure vessel 392 are preferably constructed from a corrosion resistant material. Hydraulic fluid may be fed into or discharged from the hydraulic power chamber 402 through a port 406 at the end 394 of the vessel 392. Mud may be fed into or discharged from the mud chamber 404 through a port 408 at the end 396 of the vessel 392. A valve manifold 410 is connected to the end 396 of the vessel 392. The valve manifold 410 includes suction and discharge valves for controlling mud flow into and out of the mud chamber 404. The valve manifold 410 has an inlet port 412 and an outlet port 414 which are in selective communication with the port 408.

Diaphragm Pumping Element with Diaphragm Position Locator

Figure 9C:
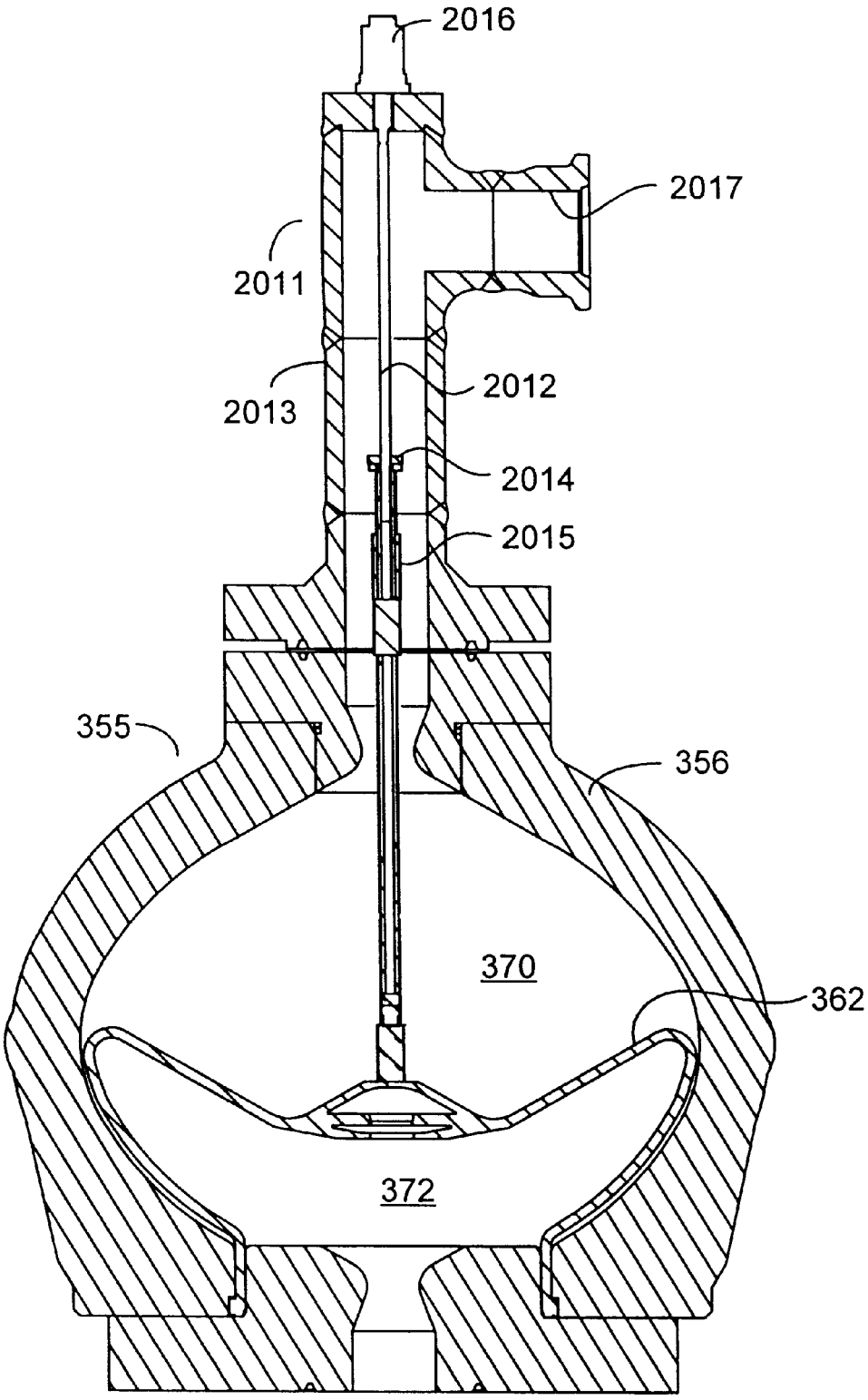
FIG. 9C shows the diaphragm pumping element of FIG. 9A with a diaphragm position locator.

FIG. 9C shows the diaphragm pumping element 355, which was previously illustrated in FIG. 9A, with a diaphragm position locator, e.g., a magnetostrictive linear displacement transducer (LDT) 2011. The magnetostrictive LDT 2011 includes a magnetostrictive waveguide tube 2012 which is located within a housing 2013 on the upper end of the diaphragm pumping element 355. A ring-like magnet assembly 2014 is located about and spaced from the magnetostrictive waveguide tube 2012. The magnet assembly 2014 is mounted on one end of a magnet carrier 2015. The other end of the magnet carrier 2015 is coupled to the center of the elastomeric diaphragm 362. The magnet carrier 2015 is arranged to move along the length of the magnetostrictive waveguide tube 2012 as the elastomeric diaphragm 362 moves within the spherical vessel 356. A conducting wire (not shown) is located inside the magnetostrictive waveguide tube 2012. The conducting wire and the magnetostrictive waveguide tube 2012 are connected to a transducer 2016 which is located external to the housing 2013. The transducer 2016 includes means for placing an interrogation electrical current pulse on the conducting wire in the magnetostrictive waveguide tube 2012.

The hydraulic power chamber 370 is in communication with the interior of the housing 2013. A port 2017 in the housing allows hydraulic fluid to be supplied to and withdrawn from the hydraulic power chamber 370. In operation, as hydraulic fluid is alternately supplied to and withdrawn from the hydraulic power chamber 370, the center of the elastomeric diaphragm 360 moves vertically within the pressure vessel 356. As the center of the elastomeric diaphragm 360 moves, the magnetic assembly 2014 also moves the same distance along the magnetostrictive waveguide tube 2012. The magnetostrictive waveguide tube 2012 has an area within the magnetic assembly 2014 that is magnetized as the magnet assembly is translated along the magnetostrictive waveguide tube. The conducting wire in the magnetostrictive waveguide tube 2012 periodically receives an interrogation current pulse from the transducer 2016. This interrogation current pulse produces a toroidal magnetic field around the conducting wire and in the magnetostrictive waveguide tube 2012. When the toroidal magnetic field encounters the magnetized area of the magnetostrictive waveguide tube 2012, a helical sonic return signal is produced in the waveguide tube 2012. The transducer 2016 senses the helical return signal and produces an electrical signal to a meter (not shown) or other indicator as an indication of the position of the magnet assembly 2014 and, thus, the position of the elastomeric diaphragm 362.

The magnetostrictive LDT 2011 thus described is similar to the magnetostrictive LDT disclosed in U.S. Pat. Nos. 5,407,172 and 5,320,325 to Kenneth Young et al., assigned to Hydril Company. The magnetostrictive LDT 2011 allows absolute position of the elastomeric diaphragm 362 within the pressure vessel 356 to be measured. This absolute position measurements can be reliably related to the volumes within the hydraulic power chamber 370 and the mud chamber 372. This volume information can be used to efficiently control the pump hydraulic drive (not shown) and the activated pump suction and discharge valves (not shown). It will be understood that other means besides the magnetostrictive LDT may be employed to measure the absolute position of the elastomeric diaphragm 362 within the spherical vessel 356, including linear variable differential transformer and ultrasonic measurement. It will be further understood that the diaphragm pumping element 355 can be employed in different applications as a pulsation dampener provided that the hydraulic power chamber 370 is filled with a compressible fluid, such as nitrogen gas, rather than hydraulic fluid. In a pulsation dampener application, means to measure the absolute position of the elastomeric diaphragm 362 within the spherical pressure vessel 356 can provide important information about pulsation and surges in hydraulic systems. The magnetostrictive LDT 2011 may also be used with the piston pumping element 390 (shown in FIG. 9B) to track the position of the piston 398 as the piston moves within the pressure vessel 392

Hydraulic drive Circuits for the Subsea Mud Pump

Figure 10A:
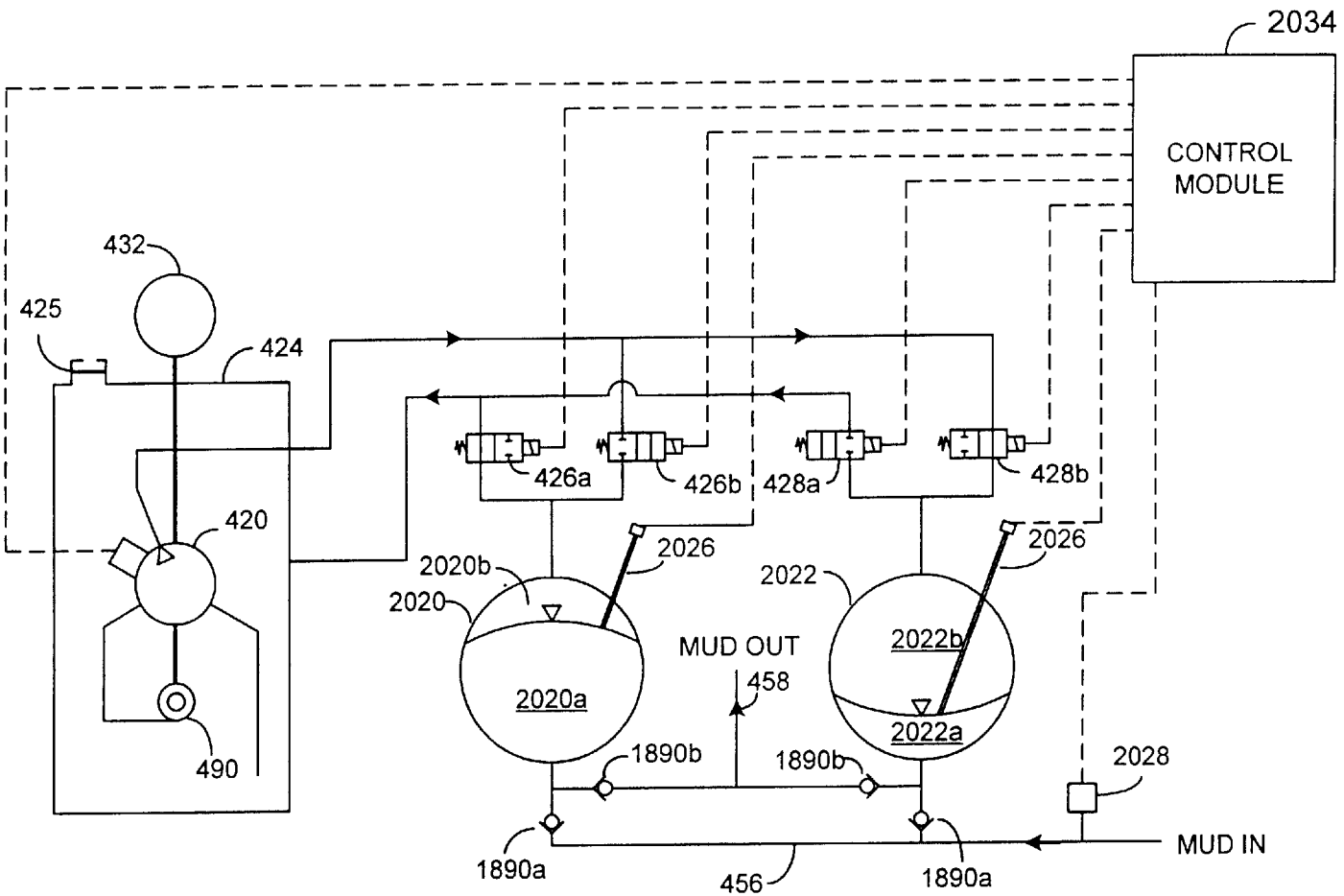
FIG. 10A illustrates an open-circuit hydraulic drive for the subsea mud pump shown in FIG. 8.

FIG. 10A shows an open-circuit diagram for the hydraulic drive 352 (shown in FIG. 8). As shown, the open-circuit hydraulic drive includes a variable-displacement, pressure-compensated pump 420 and an auxiliary pump 490. The pumps 420 and 490 are submersed in a pressure-balanced, hydraulic fluid reservoir 424. Alternately, the pumps 420 and 490 may be located external to the reservoir 424. The hydraulic fluid in the reservoir 424 may be oil or other suitable fluid power transmission media. The pump 420 is driven by an electric motor 432 which receives electricity from the drilling vessel. The electric motor 432 represents the electric motor 354 which was previously illustrated in FIG. 8. The pump 490 is coupled to the pump 420 and driven by the electric motor 432. The pump 490 may also be driven by another source, such as its own electric motor.

The pump 420 draws hydraulic fluid from the reservoir 424 and discharges pressurized fluid to the hydraulic power chambers 2020*b* and 2022*b* of the pumping elements 2020 and 2022 through the valves 426*b* and 428*b*, respectively. The positions of the valves 426*b* and 428*b* are determined by the control logic in the control module 2034. The pump 490 draws fluid from the reservoir 424 and pumps the fluid through the bearings (not shown) in pump 420. A volume compensator 425 is provided on the reservoir 424 to compensate for volume fluctuations in the reservoir that arise when the rate at which fluid is pumped out of the reservoir 424 is different from the rate at which fluid is returned to the reservoir through the valves 426*a* and 428*a*. The positions of the valves 426*a* and 428*a* are also determined by the control logic in the control module 2034. The valves 426*a*, 426*b*, 428*a* and 428*b* are two-way, solenoid-actuated, spring-return, two-position valves. However, other directional control valves can also be used to control hydraulic flow in and out of the hydraulic power chambers 2020*b* and 2022*b*.

Each of the pumping elements 2020 and 2022 have position indicators 2026, which transmit signals to the control module 2034. The indicators 2026 measure the volume of mud in the mud chambers 2020*a* and 2022*a*. The mud chambers 2020*a* and 2022*a* of the pumping elements 2020 and 2022, respectively, are connected to the conduit 456 through suction valves 1890*a* and to the conduit 458 through discharge valves 1890*b*. The valves 1890*a* and 1890*b* are check valves which permit mud to flow from the conduit 456 into the mud chambers 2020*a* and 2022*a* and from the mud chambers into the conduit 458, respectively. Although individual valves 1890*a* and 1890*b* are shown, it would be understood that these valves can be replaced with a three-way valve that would permit alternating connection of the mud chambers 2020*a* and 2022*a* to the conduits 456 or 458. In operation, the conduit 456 may be hydraulically connected to the flow outlet 125 in the flow tube 104 of the mud lift module 40 (shown in FIG. 2B), and the conduit 458 may be hydraulically connected to the mud return lines 56 and 58 (shown in FIG. 1).

In the circuit of FIG. 10A, the hydraulic power chamber 2022*b* is being filled with hydraulic fluid while the mud chamber 2022*a* is discharging mud. Also, the mud chamber 2020*a* is being filled with mud while the hydraulic power chamber 2020*b* is discharging hydraulic fluid. The timing sequence of filing one power chamber with hydraulic fluid while discharging hydraulic fluid from the other power chamber or discharging mud from one mud chamber while filling the other mud chamber with mud is such that the total mud flow from the pumping elements 2020 and 2022 is relatively free of pulsation. The pumping elements 2020 and

2022 are depicted as diaphragm pumping elements, e.g., diaphragm pumping elements 355, but the pumping elements 2020 and 2022 may be of other pumping element type, e.g., piston pumping element 390. One or more pumping elements may also be added to the pumping elements 2020 and 2022 to change the output of the subsea mud pump.

Figure 10B:
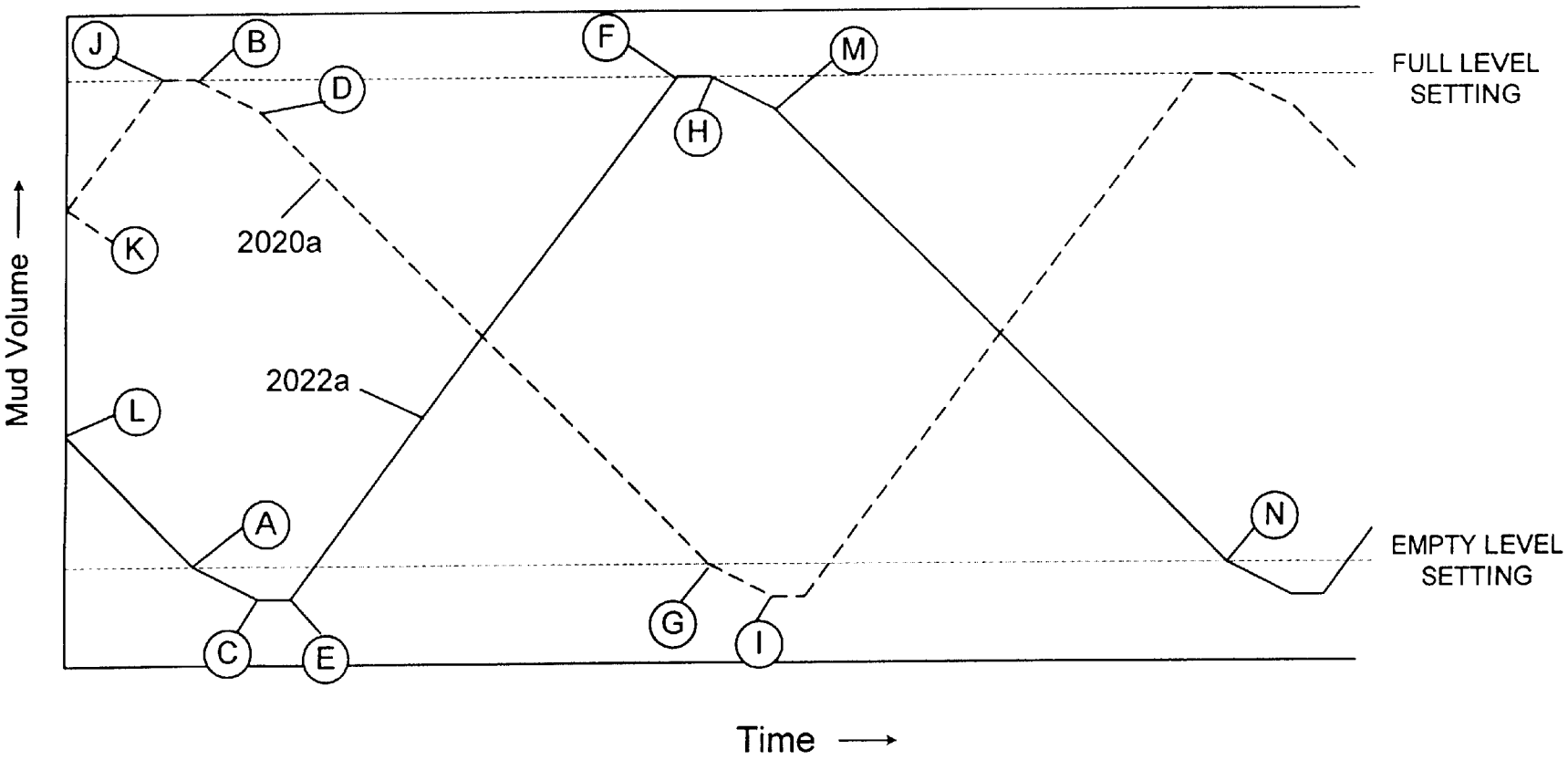
FIG. 10B is a graph illustrating output characteristics of the open-circuit hydraulic drive shown in FIG. 10A.

FIG. 10B depicts the time and position relationship between the mud chambers 2020*a* and 2022*a* as the pumping action takes place. At the start of the chart, the mud volume in mud chamber 2022*a* is decreasing while the mud volume in mud chamber 2020*a* is increasing. The flow rate into the mud chamber 2020*a* is greater than the flow rate out of the mud chamber 2022*a*. Mud flows into the mud chamber 2020*a* as a result of the positive pressure differential which is maintained between the mud in the conduit 456 and the hydraulic fluid contained in the reservoir 424.

This positive pressure differential required to fill the mud chamber 2020*a* may be created in several ways. When the pumping system is used subsea, the pump suction is connected to the well annulus 66 (shown in FIG. 1) through the port 125 in the flow tube 104 (shown in FIG. 2B). The pressure of the mud in the well annulus 66 (shown in FIG. 1) varies depending on the rate at which mud is pumped from the surface mud pumps (not shown) on the drilling rig 20 through the drill string 60 into the well annulus 66 and the rate at which the subsea pumps remove the mud from the well annulus. A pressure sensor 2028 measures the pressure differential between the mud in the well annulus and the seawater surrounding the reservoir 424. The output of the pressure sensor 2028 is transmitted to the control module 2034 which, in turn, sends a rate control signal to the variable-displacement pump 420 (shown in FIG. 10A). The well annulus pressure can, therefore, be increased or decreased by the control module 2034 such that it is maintained higher than the ambient seawater pressure. This control mode insures that the rate at which the mud chamber 2020*a* is filled, indicated by segment KJ, will exceed the discharge flow rate of mud chamber 2022*a*, indicated by segment LA.

The control logic contained in the control module 2034 (shown in FIG. 10A) provides for the pumping cycle depicted in FIG. 10B. As discussed above, the mud fill cycle of the mud chamber 2020*a* is finished when the volume in the mud chamber 2020*a* reaches point J. At this point, the control module 2034 shifts the position of valve 426*a* to stop the flow of hydraulic fluid out of the hydraulic power chamber 2020*b* and, thus, flow of mud into the mud chamber 2020*a*. The condition of the hydraulic power chamber 2020*b* is maintained until the mud being discharged from mud chamber 2022*a* reaches point A. At that moment in time, the valve 426*b* is shifted to a flow condition, allowing hydraulic fluid to flow into the hydraulic power chamber 2020*b* to displace mud from the chamber 2020*a* at the same time that mud is being displaced from the mud chamber 2022*a*. The hydraulic flow from the variable-displacement pump 420 remains constant, but is split between the two hydraulic power chambers 2020*b* and 2022*b*. The total mud flowing into the conduit 458 remains constant.

When the mud volume in the mud chamber 2022*a* reaches point C, the hydraulic fill valve 428*b* is shifted by the control module 2034 to a blocked position, stopping the mud flow out of the mud chamber 2022*a*. After a time delay represented by segment CE, the control module 2034 shifts the hydraulic discharge valve 428*a* to the flow position, allowing hydraulic fluid to be displaced from the hydraulic power chamber 2020*b* to the reservoir 424 as mud fills the mud chamber 2022*a*. The rate at which mud fills the mud chamber 2022*a* exceeds the rate at which hydraulic fluid is supplied to the hydraulic fluid chamber 2020*b* by the pump 420 and, thus, the rate at which mud is discharged out of the mud chamber 2020*a*. The fill cycle for mud chamber 2022*a*, represented by the line segment EF, stops when the mud volume in 2022*a* reaches point F. At this point, the control module 2034 shifts the valve 428*a* to a blocked position, stopping the flow of hydraulic fluid from the hydraulic fluid chamber 2022*b* to the reservoir 424.

The "full" condition of mud chamber 2022*a* is maintained until the position indicator 2026 attached to the pumping element 2020 indicates that the mud volume in 2020*a* has reached the "empty" point G. The control module 2034 then actuates the valve 428*b* to allow hydraulic fluid to flow into the hydraulic power chamber 2022*b* to displace the mud in the mud chamber 2022*a* into the conduit 458. Again, the flow from the pump 420 is split between the hydraulic fluid chambers 2022*b* and 2020*b* until the volume in mud chamber 2020*a* reaches I. This flow split is indicated by the two segments IM and GI on FIG. 10B. When the volume in the mud chamber 2020*a* reaches I, the control module 2034 signals the valve 426*a* to shift into a blocked condition, stopping mud flow out of mud chamber 2020*a*. The full flow of the pump 420 is then used to discharge the mud from the mud chamber 2022*a* at the rate indicated by the line segment MN.

The flow analysis shows that the mud discharge from the mud chambers 2020*a* and 2022*a* is uninterrupted. The starting flow rate of mud being discharged from 2022*a* is defined by the segment LA. The next segment is the combination of the segments BD (from mud chamber 2020*a*) and AC (from mud chamber 2022*a*), which equals the flow rate of segment LA. The following segment of mud being displaced from mud chamber 2020*a* is DG which is the same rate as LA. The flow is then split between mud chambers 2022*a* and 2020*a* as shown by segments HM and GI, respectively. The sum of the flow rates of segments HM and GI is equal to the flow rate of segment LA. The mud flow from the mud chamber 2022*a* continues in segment MN, which, again, is the same as the initial segment LA. The sequence then repeats.

The pumping flow rate that is indicated by the line segments MN and DG would be the maximum flow rate for the subsea mud pump, based on the fill rate established by the mud pressure in the conduit 456. If the mud flow into the well annulus starts to decrease, the pressure in the well annulus would also decrease. The control module 2034 would sense the change in the pressure sensor 2028, and reduce the flow rate from pump 420, which in turn would reduce the volume of hydraulic fluid discharged by the pump 420 to the hydraulic power chambers 2020*b* and 2022*b*. This reduced rate of mud flow from the well annulus would reestablish the required mud pressure in the conduit 456.

The control module 2034 includes all of the input and output (I/O) devices as necessary to accept signals from the various points shown in FIG. 10B and to provide control signals to the control valves 426*a*, 426*b*, 428*a*, and 428*b*. This control device would have a resident computer (not shown) which is connected to the I/O devices, or a communications linkage with a surface computer (not shown) to the I/O devices. The control for the scaling of sensor inputs and the logic to create the control signals anticipated in FIG. 10A is part of the software that is provided for the computer. This control module 2034 would be used whether the mud pump was operating subsea or on the surface.

Figure 10C:
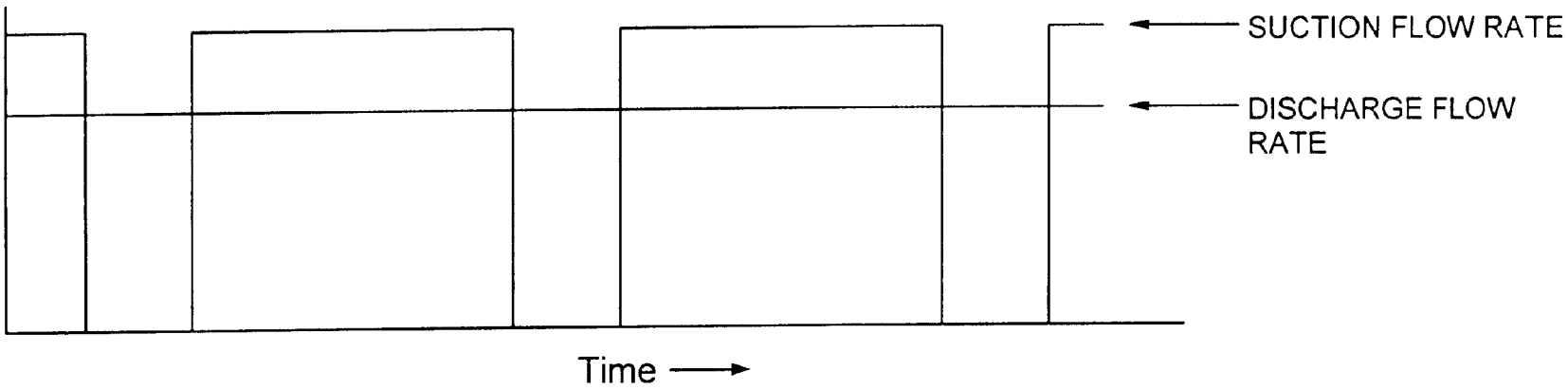
FIG. 10C illustrates the performance of the open-circuit hydraulic drive shown in FIG. 10A.

FIG. 10C illustrates the performance of the pump circuit shown in FIG. 10A using the control method described in FIG. 10B. As shown, the mud discharge rate is constant with no observable pulsation. However, the suction flow rate is formed by a series of flow pulses. This requires that some type of suction pulsation dampener be provided. The subsea pumping system provides this feature, i.e., reduction of pressure variations in the well annulus, in the pressure-balanced mud tank 42 shown in FIG. 2C or as shown in FIG. 7A when bypass valve 1824 is open to allow mud to move between the riser 52 and the well annulus. Alternatively, one or more additional pumping elements which operate out of phase with the pumping elements 2022*a* and 2020*a* may be used to create mud suction that is free of pulsation while maintaining the mud discharge that is free of pulsation.

The pumping rate required to lift mud from the seafloor to the surface when drilling at a water depth of 10,000 feet is estimated to be as high as 1,600 gallons per minute. For example, if the duration of the discharge stroke of each pumping element is six seconds, each pumping element would complete five discharge strokes in one minute. If the pumping elements have a nominal capacity of 40 gallons, the volume of mud that would be discharge from one pumping element in one minute would be 200 gallons. To deliver 400 gallons of mud in one minute, the pump 420 should have a pumping rate of at least 400 gallons per minute. Of course, to reach the estimated pumping rate of 1,600 gallons per minute required in a water depth of 10,000 feet, four pump modules would be needed.

Figure 11A:
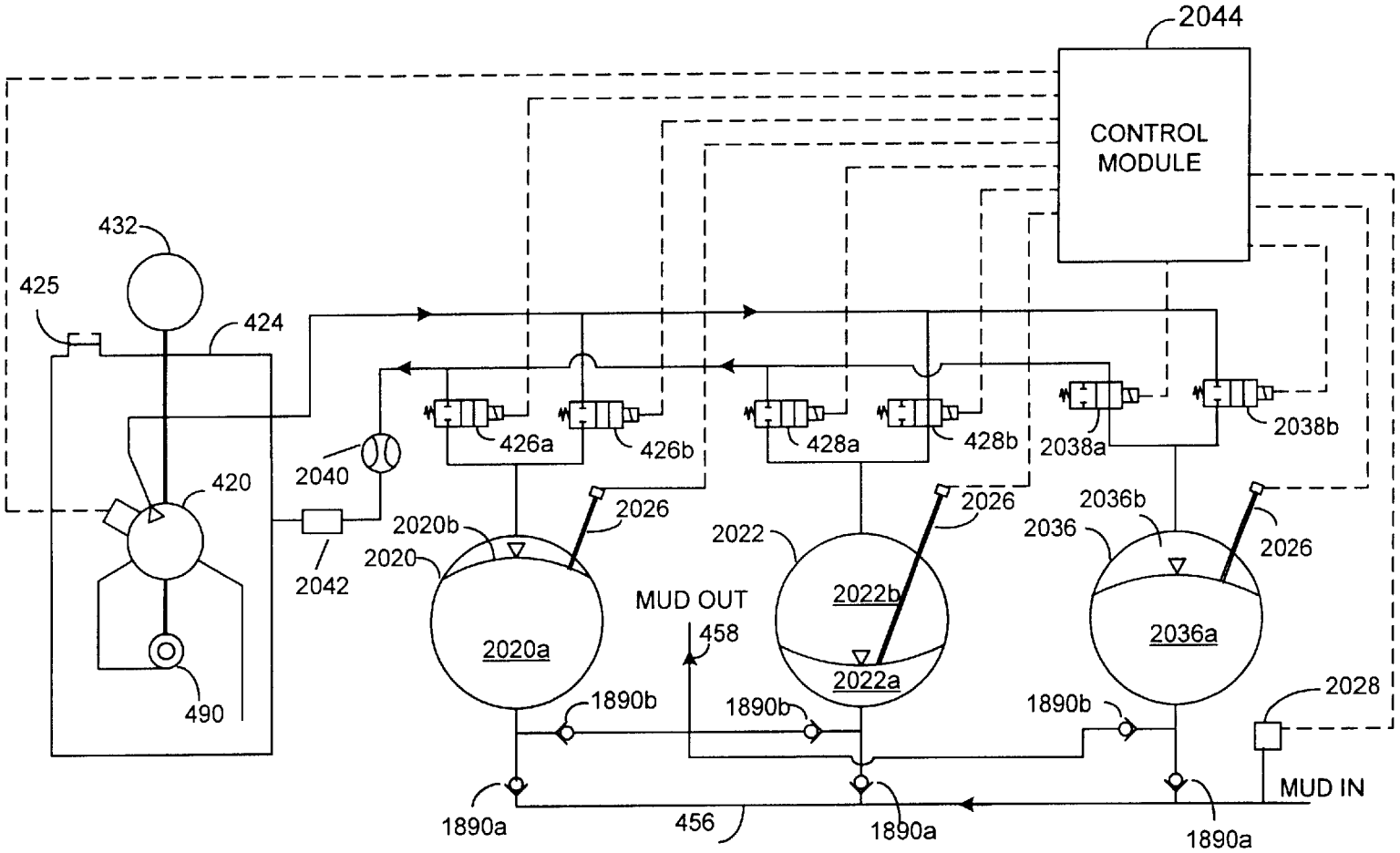
FIG. 11A illustrates an open-circuit hydraulic drive for a subsea mud pump which employs three pumping elements.

FIG. 11A illustrates an open-circuit hydraulic drive, similar to the one shown in FIG. 10A, but with addition of a third pumping element 2036 and a flow control valve 2042 and a flow meter 2040 located in the hydraulic return line connecting the hydraulic power chambers 2020*b*, 2022*b*, and 2036*b* to the reservoir 424. Additional flow algorithms must be added to the control module 2044 to coordinate the pumping cycle for this system.

Figure 11B:
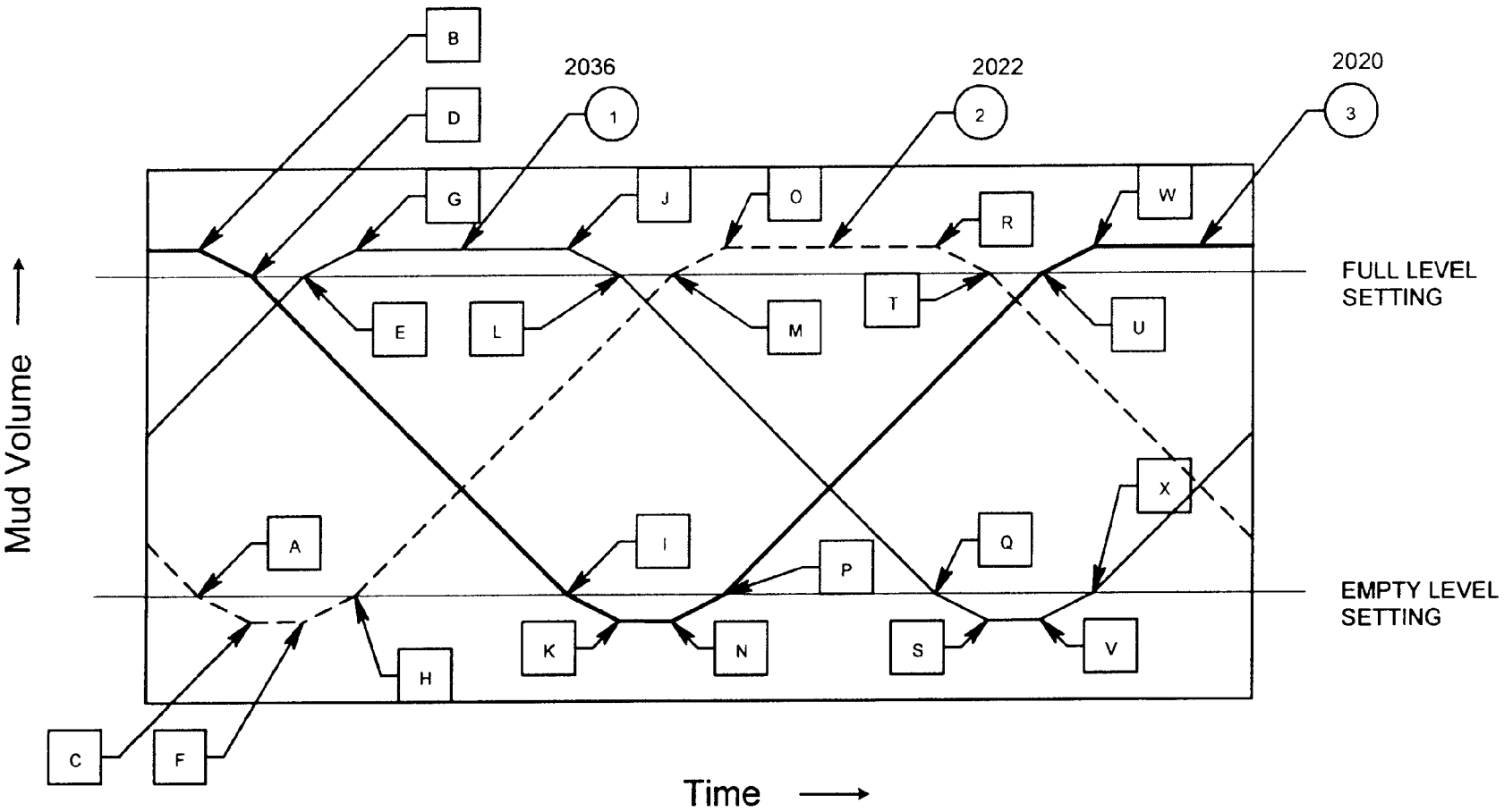
FIG. 11B is a graph illustrating output characteristics of the open-circuit hydraulic drive shown in FIG. 11A.

The rate at which mud flows out of the mud chambers 2020*a*, 2022*a*, and 2036*a* is controlled as described above for FIG. 10A. The flow rate sequencing for the pumping system of FIG. 11A is shown in FIG. 11B. The plot is similar to the one shown in FIG. 10B, but includes the pumping curve 1 for the third pumping element 2036 added to the pumping curves 2 and 3 for the pumping elements 2022 and 2020, respectively. At the start of the chart, pumping element 2020 is filled with mud and both of the hydraulic control valves 426*a* and 426*b* have been placed in the blocked position by the control module 2044, as shown in FIG. 11A. Mud is being discharged from the mud chamber 2022*a* into the conduit 458 while hydraulic fluid is filling the hydraulic power chamber 2022*b* with the control valve 428*b* in the flow position and the control valve 428*a* in a blocked position. Mud is filling the mud chamber 2036*a*, displacing the hydraulic fluid in the hydraulic fluid chamber 2036*b* through the control valve 2038*a*.

The first control action is initiated when the mud volume in the mud chamber 2022*a* reaches point A (empty level setting). The position indicator 2026 tracks the volume of mud in the pumping element 2022 and transmits this signal to the control module 2044. The control module 2044 initiates flow control action to start hydraulic fluid flowing into the hydraulic power chamber 2020*b* by shifting the control valve 426*a* from the blocked position to the flow position. As hydraulic fluid flows into the hydraulic power chamber 2020*b*, mud is discharged out of the mud chamber 2020*a* into the conduit 458 through the corresponding check valve 1890*b*. The flow from the pump 420 is split between the hydraulic power chambers 2020*b* and 2022*b* for the flow segments BD and AC. The mud flow out of the mud chamber 2022*a* is stopped when the volume reaches point C and all of the output of the pump 420 flows through the pumping element 2020. The mud fill cycle for the pumping element 2036 continues and point E is detected by control module 2044 from the output of the position indicator 2046. This initiates a control output from the control module 2044 to shift the control valve 428*a* to a flow position. Mud enters the mud chamber 2022*a*, forcing the hydraulic fluid from the hydraulic power chamber 2022*b* to flow through the control valve 428*a* and the flow meter 2040 and flow control valve 2042. Hydraulic fluid is also being displaced from the hydraulic power chamber 2036*b* through the same flow path. The combined flow rate of the hydraulic fluid returning to the reservoir 424 is controlled by the flow control valve 2042 to match the discharge flow rate of the hydraulic pump 420. The flow meter 2040 provides the necessary flow measurements for the flow control valve 2042. The hydraulic flow rate is controlled by a signal from the control module 2044 to the variable-displacement control mechanism attached to the pump 420.

When the control point G is reached, the flow control valve 2038*a* is shifted to a blocked position. This stops the flow of mud into the mud chamber 2036*a* and all of the mud flow from the conduit 456 goes into the mud chamber 2022*a*. The flow control valve 2042 maintains the rate at which mud is flowing into the pumping elements equal to the rate at which hydraulic fluid is discharged from the pump 420. The control points, the flow valves controlled, and the resulting flow conditions for the hydraulic drive shown in FIG. 11A is summarized in the FIG. 11C.

The control scheme is based on initiating the mud discharge of the full pumping element when the corresponding pumping element in the final stage of discharge reaches the empty level. The process described above continues, with the pumping rate set by the flow rate required from the pump 420 to keep the pressure of the mud flowing into the pumping elements at the required set point measured by the pressure sensor 2028 and transmitted to the control module 2044. The flow rates of mud into and out of the pump using the hydraulic drive circuit shown in FIG. 11A are always the same value and proceed without pulsation. This pulsationless flow results from overlapping both the fill and discharge cycles of the three pumping elements as described above. Because the pulsation in the mud suction section of the pump is eliminated, there is no need for a suction pulsation device.

The control module 2044 includes all of the input and output (I/O) devices necessary to accept signals from the various points shown in FIG. 11A and to provide control signals to the control valves in FIG. 11A. This control module would have a resident computer (not shown) which is connected to the I/O devices, or a communications linkage with a surface computer (not shown) to the I/O devices. The control for the scaling of sensor inputs and the logic to create the control signals anticipated in FIG. 11A is part of the software that is provided for the computer. The control module 2044 would be used whether the pump was operating subsea or on the surface. The software in the control module 2044 would also contain a logic module which would monitor the flow rates of the hydraulic fluid being pumped from the pump 420 and the hydraulic fluid being returned to the reservoir 424. Control signals to the flow control valve 2042 would keep the flow rate returning to the reservoir 424 equal to the flow rate being pumped from the pump 420 in response to the signal to the pump from the control module 2044. An additional control module would monitor the time elapsed between valve actuation signals being transmitted to the valves 426*a*, 426*b*, 428*a*, 428*b*, 2038*a*, and 2038*b* and would provide minor adjustments to the flow control valve 2042 to keep these time elapsed values at predetermined values based on the pumping rate of pump 420. This would overcome the obvious control problem of using only the flow rate measurements mentioned above to keep the pumping sequence in sync as anticipated in FIG. 10B.

Figure 12:
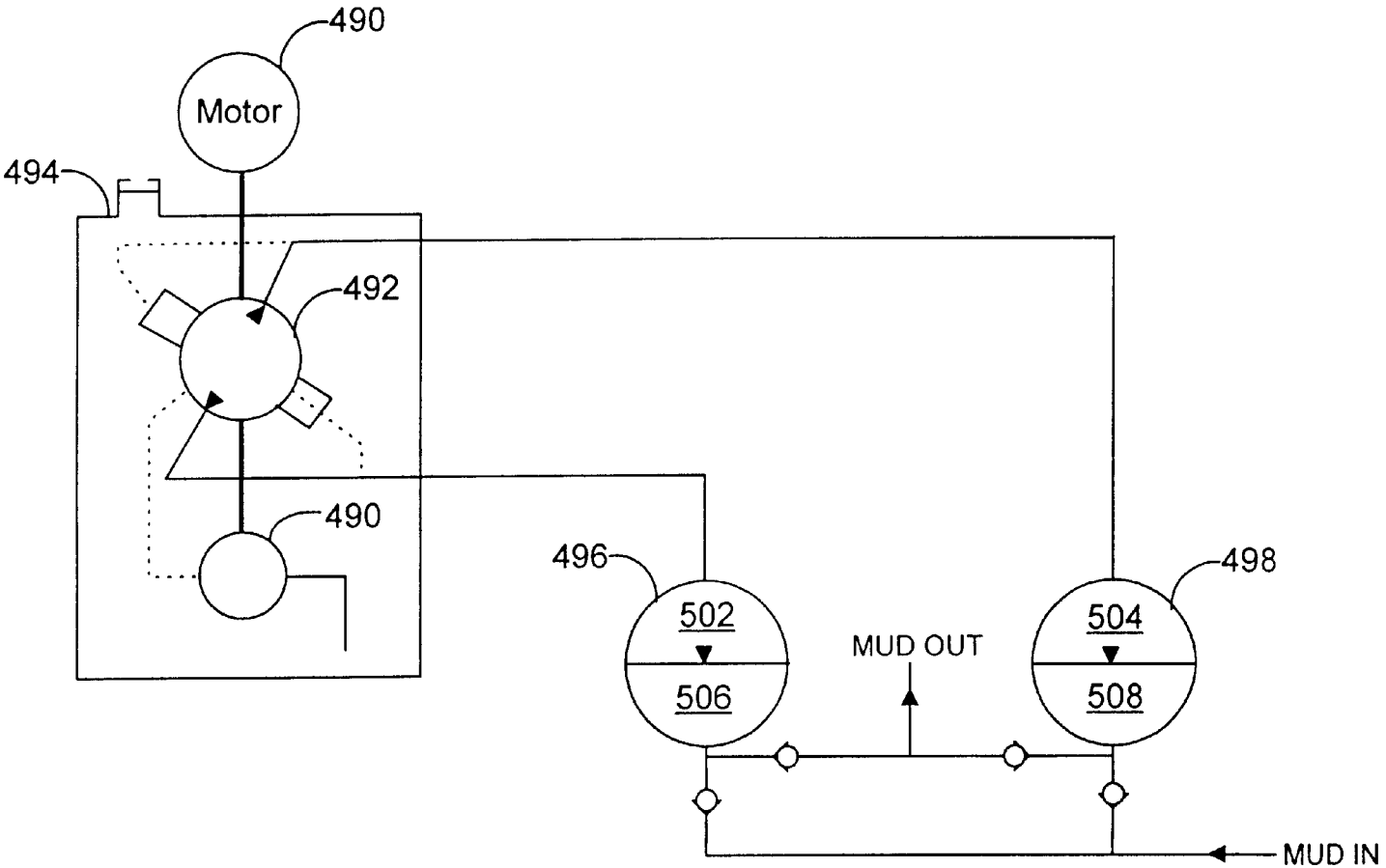
FIG. 12 illustrates a closed-circuit hydraulic drive for the subsea mud pump shown in FIG. 8.

FIG. 12 shows a closed-circuit diagram for the hydraulic drive 352 which was previously illustrated in FIG. 8. The closed-circuit hydraulic drive includes an electric motor 490 which drives a variable-displacement pressure-compensated, reversing-flow pump 492. Again, the electric motor 490 represents the electric motor 354 which was previously illustrated in FIG. 8. The pump 492 is shown as being submersed in a pressure-balanced hydraulic reservoir 494, but it may be located external to the reservoir 494. A pumping element 496 is connected to a first pumping port of the pump 492 and a pumping element 498 is connected to second pumping port of the pump 492. A boost pump 490 is coupled with the pump 492. The boost pump 490 provides bearing flushing fluid and make-up fluid to the pump 492.

During the first half of a pumping cycle, the pump 492 discharges fluid to the hydraulic power chamber 502 of the pumping element 496 while receiving fluid from the hydraulic power chamber 504 of the pumping element 498. The mud chamber 506 of pumping element 496 is discharging mud while the mud chamber 508 of pumping element 498 is filling up with mud. Flow is reversed for the second half the pumping cycle, so that the pump 492 discharges fluid to the hydraulic power chamber 504 of pumping element 498 while receiving fluid from the hydraulic power chamber 502 of pumping element 496. The mud chamber 508 of pumping element 498 now discharges mud while the mud chamber 506 of pumping element 496 is being filled with mud.

The pump 492 discharges the same amount of fluid as it receives, so that there is no volume variation in the hydraulic reservoir 494. This eliminates the need for a volume compensator for the reservoir 494. There will be pulsation before and after each suction stroke and discharge stroke of the pumping elements due to the time required for the pump 492 to reverse its flow direction. This means that pulsation dampeners may be required on the suction and discharge ends of the pumping elements to allow the pump to work efficiently. As previously mentioned, the pressure-balanced mud tank 42 or the riser may double up as a pulsation dampener on the suction end of the pumping elements.

The subsea mud pumps 102 emulate positive-displacement, reciprocating pumps. Reciprocating pumps, as well as other positive-displacement pumps, are effective in handling highly viscous fluids. At constant speeds, they produce nearly constant flow rate and virtually unlimited pressure rise or head increase. However, it should be clear that the present invention is not limited to the use of positive-displacement, reciprocating pumps for lifting mud from the well to the surface. For instance, centrifugal pumps that may be seawater or electrically powered or a water jet pump may be used. Other positive-displacement pumps, such as a progressive cavity pump or Moyno pump, may also be used.

Suction/Discharge Valve

Figure 13A:
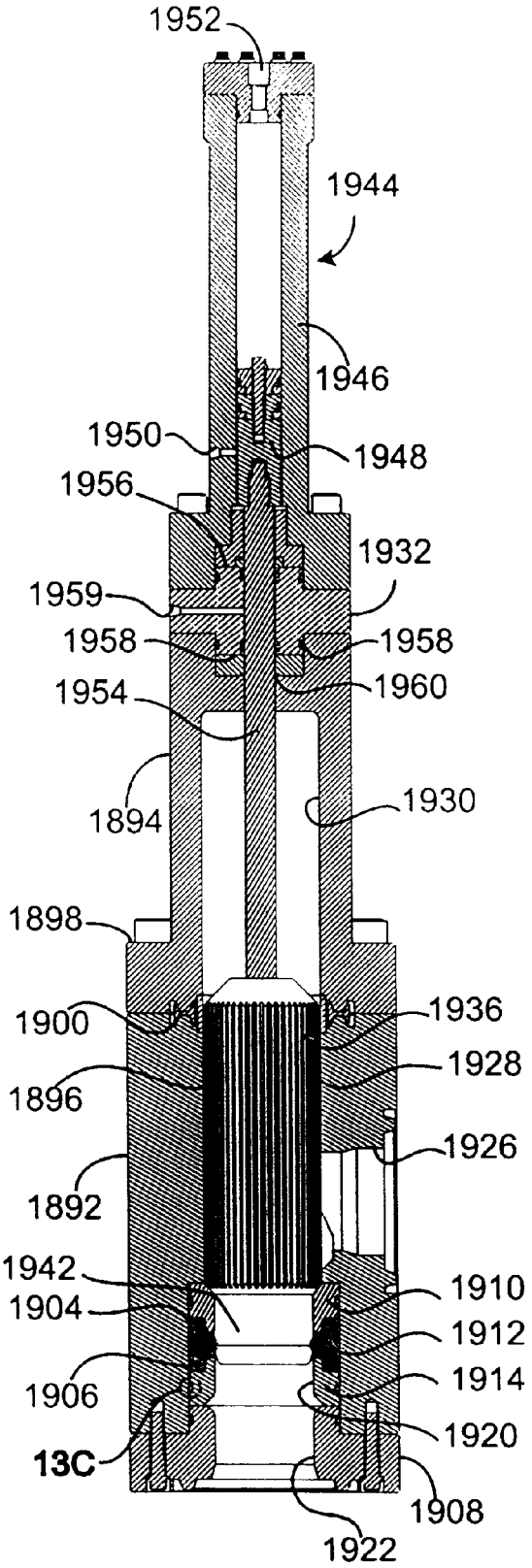
FIGS. 13A and 13B are cross sections of a suction/discharge valve.
Figure 13C:
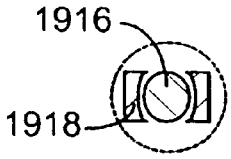
FIG. 13C is an enlarged view of the o-ring seal and backup seal rings between the valve and the seat of the nonrotating subsea diverter shown in FIG. 13A.

The subsea mud pumps 102 require suction and discharge valves to work. FIG. 13A shows a vertical cross section of a valve 1890 which may function as a suction or discharge valve. The valve 1890 comprises a body 1892 and a bonnet 1894. The body 1892 is provided with a vertical bore 1896. The bonnet 1894 has a flange 1898 which mates with the upper end of the body 1892. A metal seal ring 1900 provides a seal between the flange 1898 and the body 1892. A seal assembly 1904 is arranged in an annular recess 1906 in the body 1892 and secured in place by an inlet plate 1908. The seal assembly 1904 includes an upper seal seat 1910, an elastomer seal 1912, and a lower seal seat 1914. The seal 1912 is sandwiched between and supported by the seal seats 1910 and 1914. An o-ring seal 1916 and back-up seal rings 1918 seal between the body 1892 and the seal seats 1910 and 1914. The upper seal seat 1910, the seal 1912, and the lower seal seat 1914 define a bore 1920 which allows communication between a port 1922 in the inlet plate 1908 and a port 1926 in the body 1892.

A plunger 1928 is positioned for movement within the bore 1896 in the body 1892 and the bore 1930 in the bonnet 1894. The upward travel of the plunger 1928 is limited by a seal gland 1932 at the upper end of the bonnet 1894, and the downward travel of the plunger 1928 is limited by the seal assembly 1904 in the body 1892. An upper portion of the plunger 1928 includes spaced ribs 1936 which allow passage of fluid from the bore 1896 in the body 1892 to the bore 1930 in the bonnet 1894. A lower portion of the plunger 1928 includes a sealing surface 1942 which engages the seal 1912 when the plunger 1928 is extended into the bore 1920.

Figure 13B:
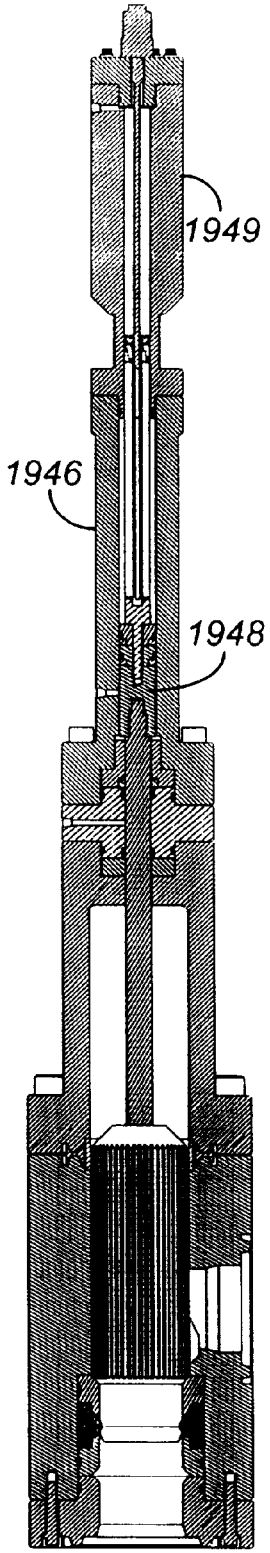

An actuator 1944 which is provided to move the plunger 1928 within the between the body 1892 and bonnet 1894 is mounted on the seal gland 1932. In the illustrated embodiment, the actuator 1944 includes a cylinder 1946 which houses a piston 1948. The piston 1948 moves within the cylinder 1946 in response to fluid pressure between an opening chamber 1950 and a closing chamber 1952. A rod 1954 connects the piston 1948 to the plunger 1928 and transmits motion of the piston 1948 to the plunger 1928. The rod 1954 passes through a bore 1956 in the seal gland 1932. Seals 1958 seal between the seal gland 1932 and the rod 1954, the bonnet 1894, and the cylinder 1946, thereby preventing fluid communication between the cylinder 1946 and the bonnet 1894. Scrapers 1960 are provided between the rod 1954 and seal gland 1932 to wipe the rod 1954 as it moves back and forth through the bore 1956. The seal gland 1932 includes a vent 1959 through for bleeding pressure and fluid out. As shown in FIG. 13B, a piston position locator 1949, which is similar to the diaphragm position locator 2011 (shown in FIG. 9C), may be provided to track the position of the piston 1948 in the cylinder 1946.

Other means, as previously described for the diaphragm pumping element 355 in FIG. 9C, can also be used to track the position of the piston 1948 within the cylinder.

When the valve 1890 is used as a suction valve, the port 1926 in the body 1892 communicates with the mud chamber of the pumping element, e.g., mud chamber 372 of the diaphragm pumping element 355 (shown in FIG. 9A), and the port 1922 in the inlet plate 1908 communicates with the well annulus 66 (shown in FIG. 1). When the valve 1890 is used as a discharge valve, the port 1922 communicates with the mud chamber of the pumping element and the port 1926 communicates with the mud return line 56 and/or 58 (shown in FIG. 1).

In operation, when the plunger 1928 is extended into the bore 1920, fluid pressure above the upper seal seat 1910 and/or below the lower seal seat 1914 acts on the seal seats to extrude the seal 1912. The extruded seal 1912 engages and seals against the sealing surface 1942 of the plunger 1928. When it is desired to draw fluid into the bore 1896, hydraulic fluid is applied to the opening chamber 1950 at a pressure higher than the fluid pressure in the closing chamber 1952. This causes the piston 1948 and the plunger 1928 to move upwardly. As the piston 1948 moves up, fluid flows into the bore 1896. The fluid in the bore 1896 exits the body 1892 through the port 1926. The fluid entering the bore 1896 is also communicated to the bore 1930 through the passages between the spaced ribs 1936. This has the effect of equalizing the pressure in the body 1892 with the pressure within the bonnet 1894. The passages between the spaced ribs 1936 are very small so that solid particles in the fluid below the plunger 1928 are prevented from moving above the plunger.

When it is desired to stop flowing fluid into the bore 1896, fluid pressure is applied to the closing chamber 1952 at a pressure higher than the fluid pressure in the opening chamber 1950. This causes the piston 1948 and the plunger 1928 to move downwardly. The plunger 1928 moves down until it is again extended into the bore 1920. Because pressure is equalized throughout the bonnet 1894 and body 1892, the plunger 1928 closes against a very small differential force.

Solids Control

When working with solids, such as those present in the mud returns, the suction and discharge valves, as well as other components in the pumping system, must be tolerant of such solids. The upper limit for the size of the solids is set by the diameter of the mud return lines. As such, there is a limit to the size of solids that can be tolerated by the pumping system. However, the suction and discharge valves should not be the size limiting components in the pumping system. Thus for situations where large chunks of formation or cement are trapped in the mud returns, it is important to provide means through which the large solid chunks can be reduced to smaller pieces or retained in the well until reduced to smaller pieces by the drill string or bit.

Rock Crusher

Figure 14A:
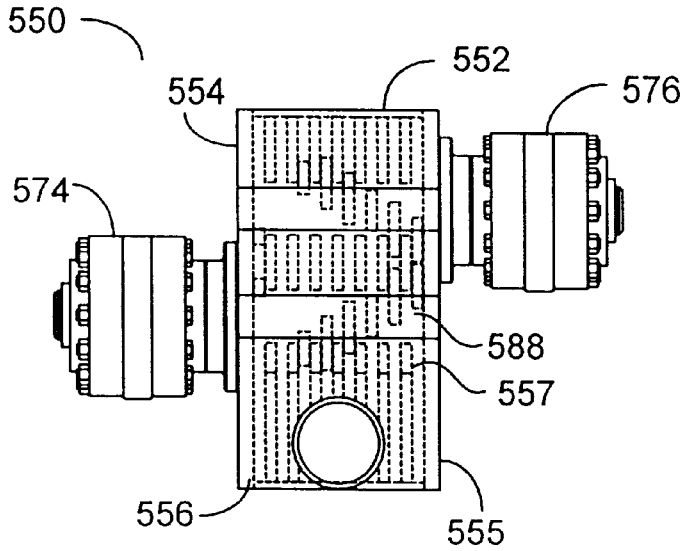
FIG. 14A is an elevation view of a rock crusher.
Figure 14B:
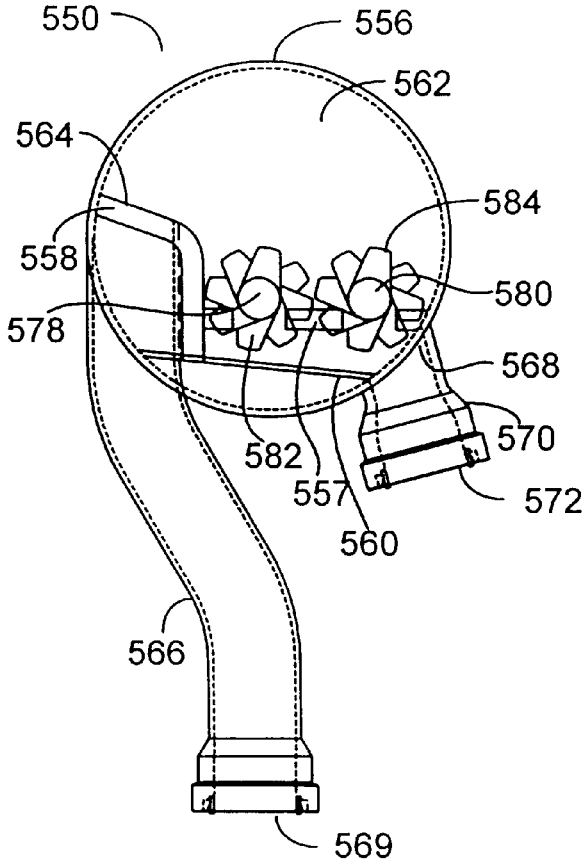
FIG. 14B is a cross section of the rock crusher shown in FIG. 14A.

FIGS. 14A and 14B illustrate a rock crusher 550 that may be provided at the suction ends of the subsea pumps 102 to reduce large solid chunks to smaller pieces. As shown in FIG. 14A, the rock crusher 550 includes a body 552 having end walls 554 and 555 and peripheral wall 556. As shown in FIG. 14B, plates 558 and 560 are mounted inside the body 552. The plates 558 and 560 together with the walls 554 and 556 define a crushing chamber 562 inside the body 552. The crushing chamber 562 has a feed port 564 which is connected to a conduit 566 and a discharge port 568 which is connected to a conduit 570. The conduit 566 has an inlet port 569 for receiving mud from the well annulus 66 and the conduit 570 has an outlet port 572 for discharging processed mud from the crushing chamber 562. The rock crusher 550 may be integrated with the pumping elements in the subsea pumps 102 by connecting the inlet port 380 of the pumps 350 (shown in FIG. 8) to the port 572 of the rock crusher. The port 569 of the rock crusher 550 would then be connected to the flow outlet 125 (shown in FIG. 2B) in the flow tube 104.

Rotors 574 and 576 (shown in FIG. 14A) are mounted on the end walls 554 and 555, respectively. The rotors 574 and 576 are connected to shafts 578 and 580, respectively, which extend through the crushing chamber 562. The rotors 574 and 576 rotate the shafts 578 and 580 in opposite directions. A blade assembly 582 is supported on the shaft 578 and a blade assembly 584 is supported on the shaft 580. The blade assemblies 582 and 584 include blades which are staggered around their respective supporting shafts. A grid 557 is disposed in the crushing chamber. The grid 557 includes spaced grid elements 588 which are just wide enough to allow the blades on the blade assemblies 582 and 584 to pass through them. The blades are arranged to rotate between the grid elements 588, thus forcing the solid chunks to be crushed against the grid 557.

In operation, mud enters the rock crusher 550 through the port 569 and is advanced into the crushing chamber 562 through the port 564. The rotating blade assemblies 578 and 580 advance the mud towards the fixed grid 557 while crushing the solid chunks in the mud into smaller pieces. Pieces of rocks that are small enough to pass through the grid elements 588 of the fixed grid 557 are pushed through the grid elements 588 by the action of the rotating blades. The mud with the smaller solid pieces exits the crusher 550 through the ports 568 and 572.

Excluder

Figure 15A:
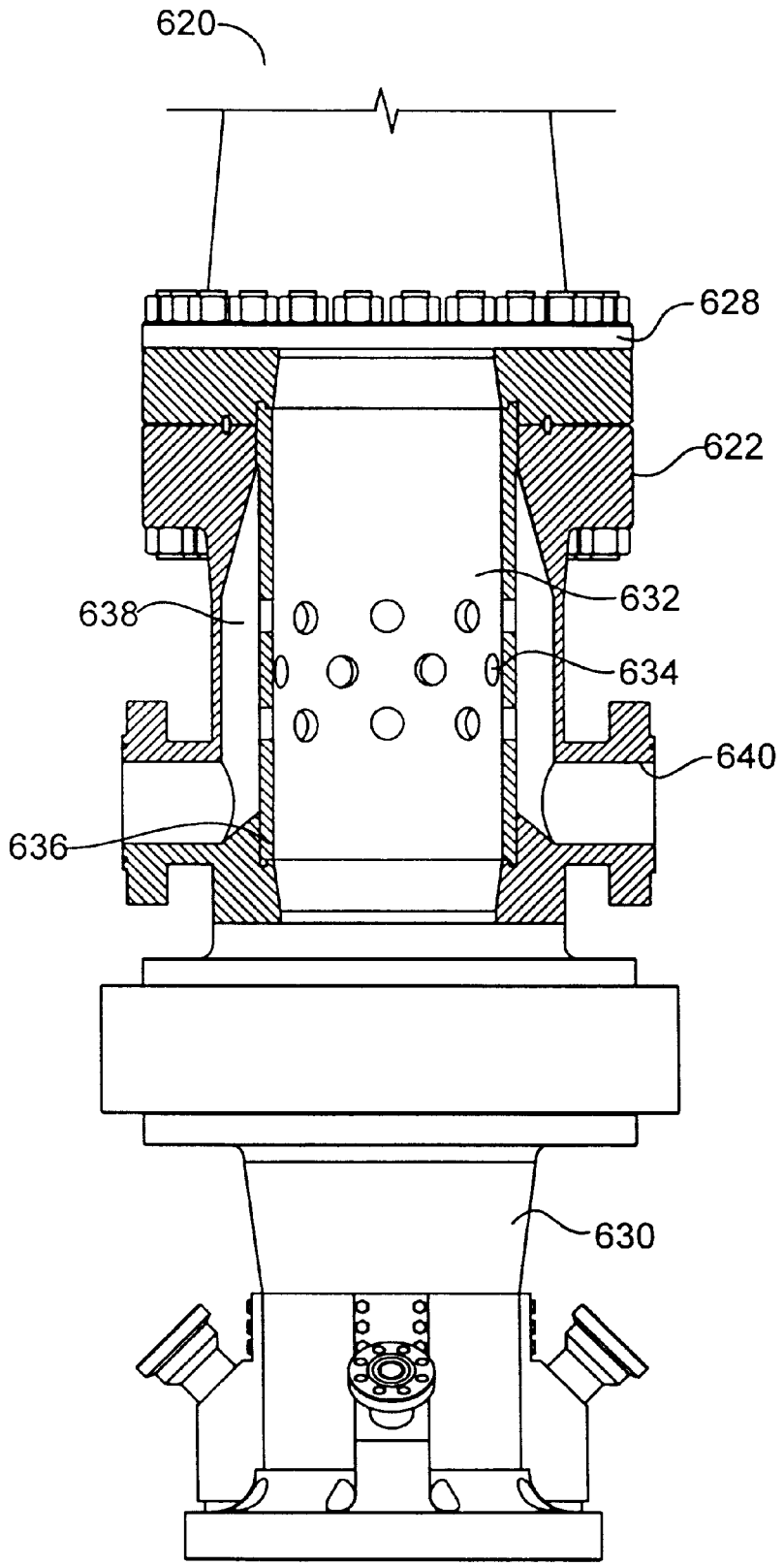
FIG. 15A is an elevation view of a solids excluder.

FIG. 15A shows a solids excluder 620 that may be used to exclude large solid chunks in mud returns leaving the well annulus to the suction ends of the subsea pumps 102 (shown in FIG. 2B). The solids excluder 620 includes a vessel 622. The connector 630 at the lower end of the vessel 622 may mate with the connector 114 at the upper end of the flexible joint 94 (shown in FIG. 2A). A perforated barrel 632 with rows of holes 634 is disposed within the vessel 622. The lower end of the barrel 632 sits in a groove 636 in the vessel 622 and a mating flange 628 holds the barrel 632 in place inside the vessel 622. A flow passage 638 is defined between the vessel 622 and the barrel 632. Ports 640 are provided through which fluid received in the flow passage 638 may flow out of the vessel 622. The ports 640 may be connected to the suction ends of the subsea mud pumps 102 (shown in FIG. 2B).

In operation, mud from the well annulus enters the barrel 632 through a flow passage in the connector 630 and flows through the holes 634 into the flow passage 638. Mud exits the flow passage 638 through the ports 640. Solid chunks that are larger than the diameter of the holes 640 will not be able to pass through the holes 634 and will return to the well annulus to be reduced to smaller pieces by the drill string or bit. The excluder 620 may be used in conjunction with or in place of the rock crusher 578 (shown in FIGS. 14A and 14B) to control the size of the solids in the pumping system.

Solids Excluder/Subsea Diverter

Figure 15B:
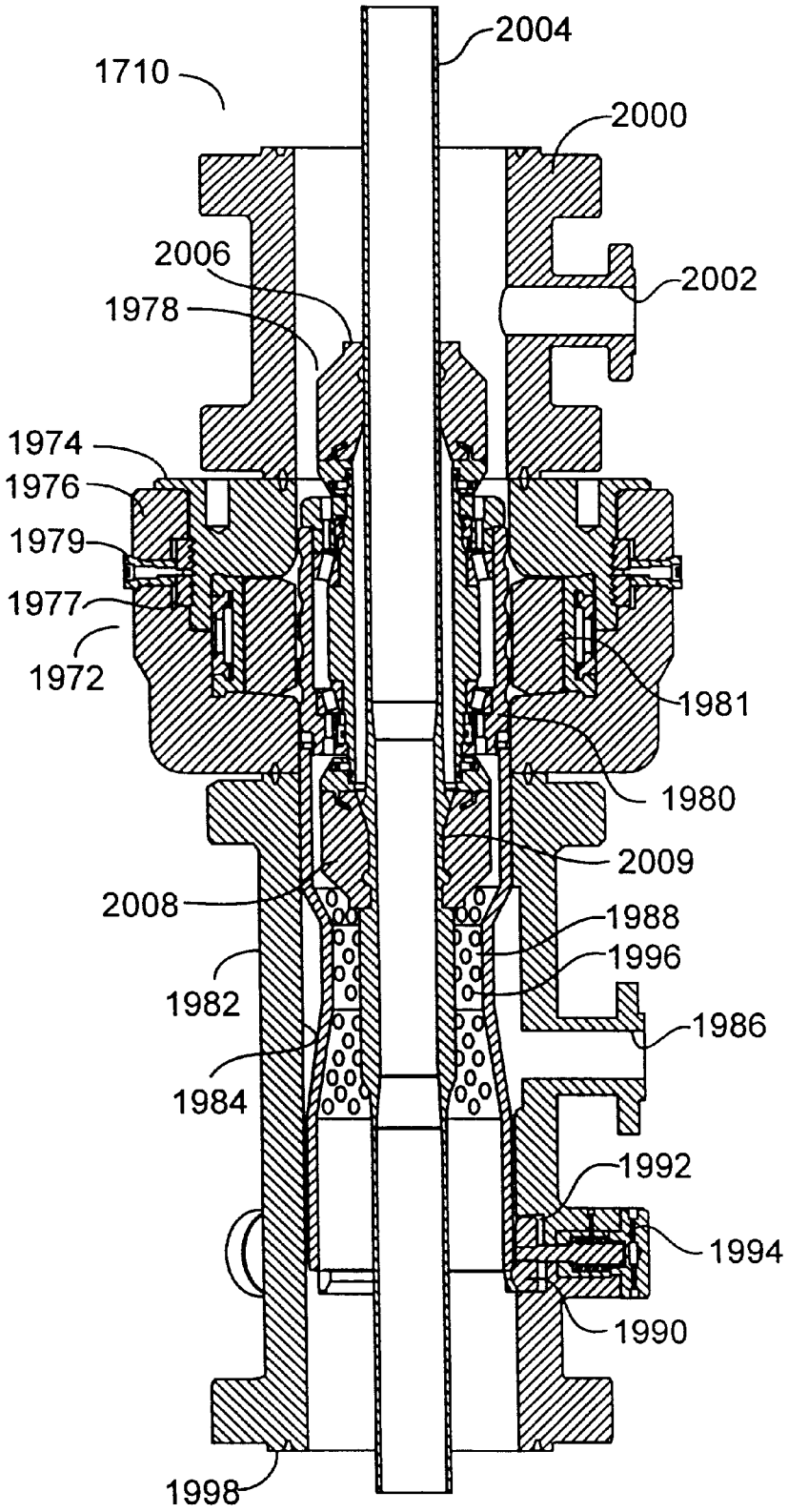
FIG. 15B is a cross section view of a combined rotating subsea diverter and solids excluder.

FIG. 15B shows a rotating subsea diverter 1970 which is adapted to exclude large solid chunks in mud returns flowing from the well annulus 66 to the suction ends of the subsea mud pumps 102. The rotating subsea diverter 1970 has a diverter housing 1972 which includes a head 1974 and a body 1976. The head 1974 and body 1976 are held together by a radial latch 1977, similar to the radial latch 1720, and locks 1979, similar to the locks 1722. A retrievable spindle assembly 1978 is disposed in the diverter housing 1972. The spindle assembly 1978 is similar to the spindle assembly 1740 and includes a spindle housing 1980 that is secured to the body 1976 by an elastomer clamp 1981, similar to the elastomer clamp 1744.

An excluder housing 1982 is attached to the lower end of the body 1976. The excluder housing 1982 has a bore 1984 and a flow outlet 1986. A perforated barrel or screen 1988 is disposed in the bore 1984. The upper end of the perforated barrel 1988 is coupled to the spindle housing 1980, and the lower end of the perforated barrel 1988 is supported on a retractable landing shoulder 1990. The landing shoulder 1990 may be retracted into the cavity 1992 in the excluder housing 1982 or extended into the bore 1984 by a hydraulic actuator 1994, which is similar to the hydraulic actuator 1782. The perforated barrel 1988 includes rows of holes 1996 which are positioned adjacent the flow outlet 1986 when the lower end of the barrel 1988 is supported on the landing shoulder 1990.

The lower end 1998 of the excluder housing 1982 and the riser connector 2000 on the head 1972 allow the rotating subsea diverter 1970 to be interconnected in a wellhead stack, e.g., wellhead stack 37. In one embodiment, the rotating subsea diverter 1970 replaces the flow tube 104 and the subsea diverters 106 and 108 (shown in FIG. 2B) in the mud lift module 40. In this embodiment, the lower end 1998 of the excluder housing 1982 would then mate with the riser connector 114 (shown in FIG. 2A) at the upper end of the flexible joint 94, and the riser connector 2000 on the head 1972 may be connected to the riser connector 115 (shown in FIG. 2C) at the lower end of the pressure-balanced mud tank 42 or directly to the riser connector 262 (shown in FIG. 2C) at the lower end of the riser 52. The flow outlet 1986 in the excluder housing 1982 would then be connected to the suction ends of the subsea mud pumps 102 (shown in FIG. 2B). If the pressure-balanced mud tank 42 is eliminated as previously described, the flow outlet 1986 in the excluder housing may also be connected to the flow outlet 2002 in the riser connector 2000. In this way, fluid from the well annulus 66 can be diverted into the riser 52 as necessary.

During a drilling operation, a drill string 2004 extends through the spindle assembly 1978 and perforated barrel 1988 into the well. The packers 2006 and 2008 engage and seal against the drill string 1998. Mud in the well annulus 66 flows into the barrel 1988 through the inlet end of the excluder housing 1982 but is prevented from flowing through the diverter housing 1972 by the packers 2006 and 2008. The mud exits the barrel 1988 through the holes 1996 and flows into the suction ends of the subsea mud pumps 102 through the flow outlet 1986 in the excluder housing 1982. Solid chunks that are larger than the diameter of the holes 1996 will not be able to pass through the holes 1996 into the suction ends of the subsea mud pumps and will return to the well annulus to be reduced to smaller pieces by the drill string or bit.

Mud Circulation System

Figure 16:
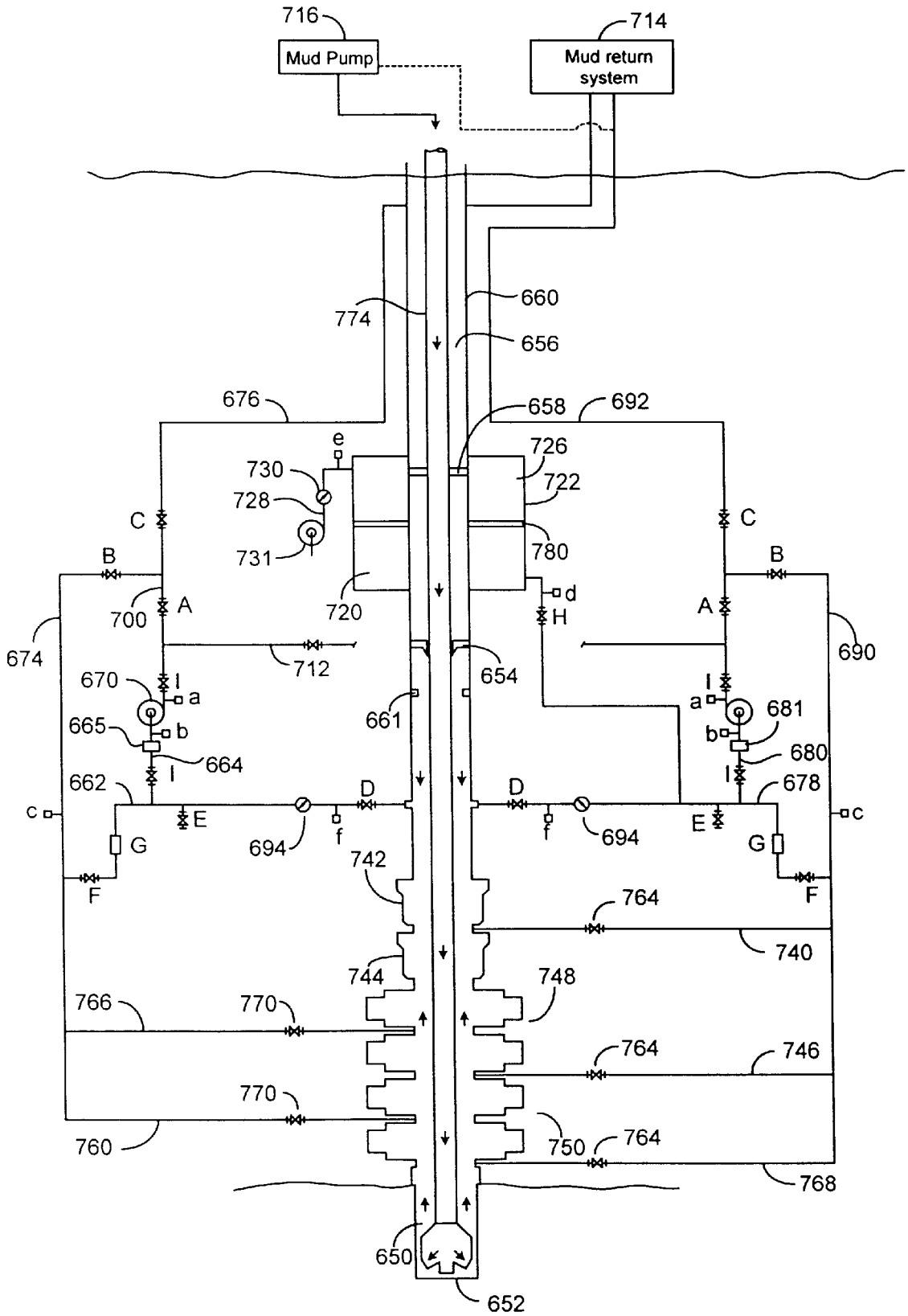
FIG. 16 is a diagram of a mud circulation system for the offshore drilling system shown in FIG. 1.

FIG. 16 shows a mud circulation system for the previously described offshore drilling system 10. As shown, the mud circulation system includes a well annulus 650 which extends from the bottom of the well 652 to the wiper 658. A riser annulus 656 extends from the wiper 658 to the top end of the riser 660. Below the wiper 658 is a rotating diverter 654 and a non-rotating diverter 661. The diverter 661 is opened to permit mud flow from the bottom of the well 652 to the diverter 654. The diverter 661 may be closed when the diverter 654 and wiper 658 are retrieved to the surface.

A conduit 662 extends outwardly from the well annulus 650 and branches to a conduit 664, which runs to the inlet of a subsea mud pump 670. A rock crusher 665 is disposed in the conduit 664. The conduit 662 also connects to a choke/kill line 674, which runs to a mud return line 676. Similarly, a conduit 678 extends outwardly from the well annulus 650 and branches to a conduit 680, which runs to the inlet of a subsea mud pump 686. A rock crusher 681 is disposed in the conduit 680. The conduit 678 also connects to a choke/kill line 690, which runs to a mud return line 692. Flow meters 694 are situated in the conduits 662 and 678 to measure the rate at which mud flows out of the well annulus 650.

A conduit 700 connects the outlet of the subsea pump 670 to the mud return line 676. Similarly, a conduit 708 connects the outlet of the subsea pump 686 to the mud return line 692. The conduits 700 and 708 are linked by a conduit 712, thus permitting flow to be selectively channeled through the return lines 676 and 692 as desired.

The mud return lines 676 and 692 run to the drilling vessel (not shown) on the surface, where they are connected to a mud return system 714. The mud return lines 676 and 692 may also be used as choke/kill lines when necessary. The mud chamber 720 of the pressure-balanced mud tank 722 is connected to the well annulus 650 by a flow conduit 724. Seawater is fed to or expelled from the seawater chamber 726 through the flow line 728. A flow meter 730 in the flow line 728 measures the rate of flow of seawater into and out of the seawater chamber 726, thus providing the information necessary to determine the volume of mud in the mud chamber 720. The flowline 728 is connected to the seawater or optionally to a pump 731 which maintains a pressure differential between the mud in the well annulus 650 and the seawater in the riser annulus 656.

A flow conduit 740 is connected at one end to a point between the annular preventers 742 and 744 and at the other end to the choke/kill line 690. A flow conduit 746 is connected at one end to a point below the blind/shear rams in ram preventer 748 and at the other end to the choke/kill line 690. A flow conduit 768 is connected at one end to a point below the pair of ram preventers 750 and at the other end to the choke/kill line 690. The flow conduits 740, 746, and 768 include valves 764, which, when open, permit controlled mud flow from the well annulus 650 to the choke/kill line 690 or from the choke/kill line 690 to the well annulus 650. A flow conduit 760 is connected at one end to a point between the pair of ram preventers 750 and at the other end to the choke/kill lines 674. A flow conduit 766 is connected at one end to a point between the ram preventers 748 and 750 and at the other end to the choke/kill line 674. The flow conduits 766 and 760 include valves 770, which permit controlled flow into and out of the well annulus 650. A similar piping arrangement is used with other combinations of blowout preventers.

Pressure transducers (a) are positioned strategically to measure mud pressure at the discharge ends of the pumps 670 and 686. Pressure transducers (b) measure mud pressure at the inlet ends of the pumps 670 and 686. Pressure transducers (c) measure pressures in choke/kill lines 674 and 690. Pressure transducer (d) measures pressure at inlet of mud chamber 720 of mud tank 722. Pressure transducer (e) measures seawater pressure in the flow line 728. Other pressure transducers are appropriately located to measure ambient seawater pressure and well annulus pressure as needed.

The various bypass and isolation valves, which are required to define the flow path in the mud circulation system, are identified by characters A through I.

Valves A isolate the discharge manifolds of the subsea pumps 670 and 686 from the mud return lines 676 and 692, thus allowing the mud return lines 676 and 692 to be used as choke/kill lines. Valves B isolate the choke/kill lines 674 and 690 from the mud return lines 676 and 692. When valves B are closed, mud can be pumped from the well annulus 650 to the surface through the mud return lines 676 and 692.

When valves B are open and valves C are closed, mud from the subsea pumps 670 and 686 can be discharged to the well annulus 650 through the choke/kill lines 674 and 690.

Valves D isolate the well annulus 650 from the inlet of the subsea pumps 670 and 686. Valves E permit flow to be dumped from the well annulus 650 onto the seafloor. Valves F isolate the choke/kill lines 674 and 690 from the inlet of the subsea pumps 670 and 686. Valves G are subsea chokes that allow controlled mud flow from the choke/kill lines 674 and 690 to the flow conduits 662 and 678. Valve H isolates the pressure15 balanced mud tank 722 when the inlets of the subsea mud pumps are being operated at pressures above the pressure rating of the mud tank or when it is desired to prevent mud from entering the mud chamber 720 of the mud tank 722. Valves I isolate individual pumps from the piping system.

Mud is pumped into the bore of the drill string 774 from a surface mud pump 716. Mud flows through the drill string 774 to the bottom of the well 652. As more mud is pumped down the bore of the drill string 774, the mud at the bottom of the well 652 is pushed up the well annulus 650 towards the diverter 654. The valves 764 and 770 are closed so that mud does not flow into the choke/kill lines 674 and 690. The isolation valves A, C, D, I, and H are open. Isolation valves B, E, and F are closed. This allows the mud in the well annulus 650 to be directed to the inlets of the of the subsea pumps 670 and 686. The subsea pumps 670 and 686 receive the mud from the well annulus 650 and discharge the mud into the mud return lines 676 and 692 at a higher pressure. The mud return lines 676 and 692 carry the mud to the mud return system 714.

In the mud tank 722, a floating piston 780, which separates the mud chamber 720 from the seawater chamber 726, moves in response to pressure differential between the chambers 720 and 726. The piston 780 is at an equilibrium position inside the mud tank 722 when the pressure in the seawater chamber 726 is essentially equal to the pressure in the mud chamber 720. If the mud pressure at the inlet of the mud chamber 720 exceeds the pressure in the seawater chamber 726, the piston moves upwardly from the equilibrium position to exhaust seawater from the seawater chamber 726 while allowing mud to enter the mud chamber 720. If the pressure in the mud chamber 720 falls below the pressure in the seawater chamber 726, the piston moves downwardly from the equilibrium position to force mud out of the mud chamber 720 while allowing seawater to fill the seawater chamber 726.

While circulating mud, the volume of the subsea pumps 670 and 686, which are responsible for boosting the pressure of the return mud column, is controlled to maintain a near constant pressure gradient in the well annulus 650. Alternatively, the subsea pumps 670 and 686 may be controlled to maintain the mud level in the mud tank 722, i.e. maintain the piston 780 at an equilibrium position inside the mud tank 722. The flow rates registered from the flow meter 730 may be used as control set points to adjust the pumping rates of the subsea pumps. As an alternative, the position of the piston inside the mud tank 722 may be tracked using a piston locator (not shown). If the piston moves from an established equilibrium position, the piston locator indicates how far the piston moves. The readings from the piston locator can then used as control set points to adjust the pumping rates of the subsea pumps.

Figure 17:
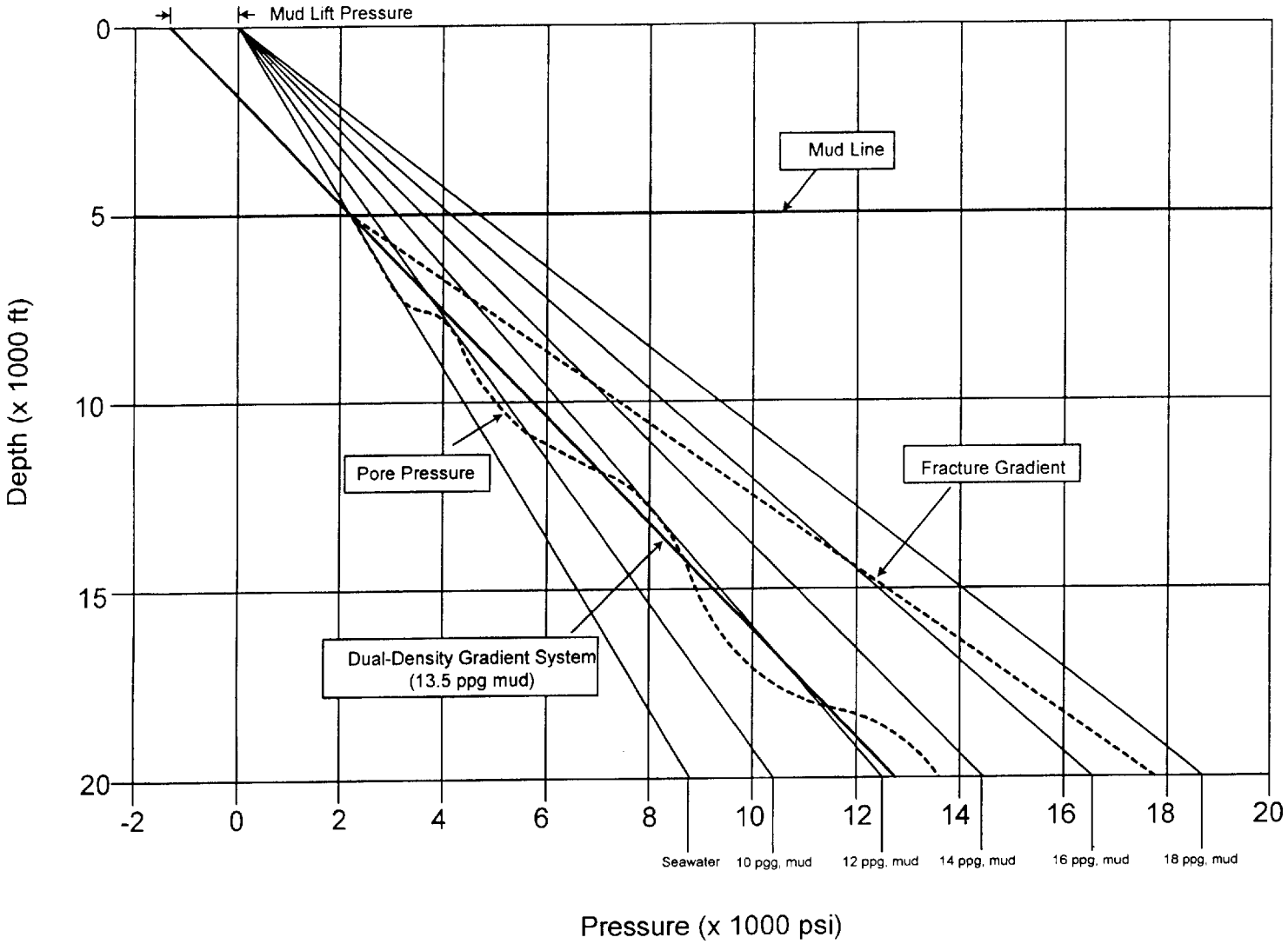
FIG. 17 is a graph of depth versus pressure for a well drilled in a water depth of 5,000 feet for both a single-density mud gradient system and a dual-density mud gradient system.

The mud circulation system shown in FIG. 16 provides a dual-density mud gradient system which consists of the mud column extending from the bottom of the well 652 to the mudline or suction point of the subsea pumps 670 and 686 and seawater pressure maintained at the mudline by using the subsea mud pumps 670 and 686 to boost the return mud column pressure. FIG. 17 compares this dual-density mud gradient system with a single-density mud gradient system for a 15,000-foot well in a water depth of 5,000 feet. Mud pressure lines are shown for the single-density gradient system for ud weights ranging from 10 lb/gal to 18 lb/gal. The weight of the seawater (or mud) above the mudline for the dual-density mud gradient system is 8.56 lb/gal while the weight of mud below the mudline is 13.5 lb/gal.

The pressure lines for the single-density gradient system start with 0 psi at the water surface and increase linearly to the bottom of the well. To achieve a mud pressure equal to the formation pore pressure at the mudline with the single-density mud gradient system, the mud weight would have to be roughly equal to 8.56 lb/gal. However a mud weight of 8.56 lb/gal underbalances formation pore pressures. To overbalance formation pore pressures, a mud weight higher than 8.56 lb/gal is needed. As shown, higher mud weights lead to mud pressures that exceed fracture gradients for long lengths of the well.

Unlike the single-density mud gradient system, the dual-density mud gradient system of the invention has a seawater gradient above the mudline and a mud gradient which better matches the natural pore pressures of the formation. This is possible because the subsea pumps 670 and 686 boost the return line mud column pressure to maintain a pressure in the well equal to a seawater pressure at the mudline combined with a mud gradient in the well. Because the dual-density overbalances formation pressures without exceeding fracture gradients for long lengths of the well, the number of casing strings required to complete the drilling of the well is minimized. In the example shown, the pressure line for the high-density leg of the pressure line for the dual-density mud gradient system of the invention crosses the zero depth axis at −1284 psi.

Mud Free-Fall

During drilling operations, from time to time, it is necessary to break out connections in the drill string. Before breaking out a connection, the surface pump 716 (shown in FIG. 16) is stopped. The mud column in the drill string exerts a greater hydrostatic pressure than the sum of the hydrostatic pressure of the mud column in the well annulus 650 and the seawater column in the riser annulus 656. When the surface pump 716 is stopped, mud free-falls from the drill string into the well until the hydrostatic pressure of the mud column in the drill string is equalized with the hydrostatic pressures of the mud column in the well annulus and the seawater column in the riser annulus. If the mud in the drill string is restricted by isolating the mud tank or by not pumping the mud out, excessive pressure will exist at the bottom of the well, thus possibly fracturing the formation.

Mud free-fall phenomenon does not normally occur while circulating mud because a balance is maintained between the mud pumped into the drill string 774 and out of the well annulus 650. When mud free-fall is taking place in the drill string 774, the excess mud falling into the well annulus 650 is diverted to the mud chamber 720 of the mud tank 722 and/or to the inlets of the subsea pumps 670 and 686. The subsea pumps slow down as mud free-fall in the drill string subsides.

As the drill string is pulled to the surface, the well 652 is filled with mud volume equal to the volume of the drill string removed from the well. Filling the well 652 with mud ensures the proper mud column hydrostatic pressure to maintain well control. The mud filling the well 652 may come from the mud chamber 720 of the mud tank 722. The volume of mud filling the well is determined from the flow rates registered by the flow meter 730 or from readings from a piston locator for the piston 780. If the mud volume that fills the well is less than the volume of the drill string, a kick may have occurred in the well and appropriate actions must be taken. If the mud level in the mud tank 722 becomes low while filling the well 650 with mud, the surface pump 716 is started to pump mud into the mud tank 722 through the return line 676 and/or 692 and the choke/kill line 690. When pumping mud into the mud tank 722, the valves B, C, F, and H are open and valves A, D, and I are closed.

When the drill string is run into the well, mud may be pumped to partially fill the drill string. As the drill string is run to the bottom of the hole, mud volume equal to the volume of the drill string is pushed into the mud tank 722 or is pumped out of the well 650 by the subsea pumps 670 and 686. The volume of mud entering the mud tank 722 or pumped from the well 650 is measured and recorded to ensure that the volume of mud displaced from the well 650 is equal to the volume of the drill string. If the volume of mud displaced is less than the volume of the drill string, then mud may have seeped into the formation and appropriate actions must be taken. If the mud tank 722 gets nearly full while the drill string is being run into the well, the subsea pumps 670 and 686 are operated to pump mud from the mud tank 722 to the mud return system 714.

A well may kick while drilling and circulating mud or while pulling a drill string out of the well. During drilling and mud circulation, formation fluid influx is first indicated when a pressure rise in the well 650 is detected. Other indications of formation fluid influx may be increased flow rate registered by the subsea flow meters 694, sudden large volume increases in the mud chamber 720 of the mud tank 722, and large volume increase in the mud return system as the output of the subsea pumps 670 and 686 increase. When formation fluid influx is detected, the subsea pumps 670 and 686 are controlled to maintain seawater pressure plus a well control margin in the well. The well control margin is determined from a pressure integrity test (PIT). A PIT is normally conducted after a new casing is run and cemented into the well to establish a safe, maximum well bore pressure that will not fracture the formation.

When the pressure in the well is maintained at seawater pressure plus a well control margin, the annular blowout preventer 742 is closed and the valve 764 in the flow conduit 740 is opened. The valve H is closed to isolate the mud tank 722 from the mud circulation system and the surface mud pump 776 is started in preparation for circulation of the formation fluid influx out of the well. When circulating formation fluid influx out of the well, mud is pumped into the well annulus 650 through the drill string at a constant, predetermined kill rate while adjusting the speed of the subsea pumps 670 and 686 to maintain the required back pressure on the returning mud stream. The pressure transducers (a) at the discharge ends of the subsea pumps 670 and 686 provide the choke operator at the surface with instantaneous pressure values of the pump discharge pressure. The choke operator adjusts one or more surface chokes to control flow from the return lines to the surface and to prevent wide variations of back pressure on the subsea pump.

In the event of a kick or formation fluid influx while pulling the drill string out of the well, the well is shut-in by closing one or more of the blowout preventers. This prevents the formation fluid influx in the well from propagating to the drilling vessel on the surface of the water. The shut-in casing pressure (SICP), the shut-in drill pipe pressure (SIDP), and the volume gained are recorded. Then the drill string is stripped to the bottom of the well while maintaining a constant bottom hole pressure by bleeding the proper volume of mud into the mud tank 722. The drill string is first stripped into the well without bleeding mud from the well until casing pressure increases to SICP plus a factor of safety, e.g., 100 psi, and drill string penetration pressure increase. The drill string penetration pressure increase is the annular pressure resulting from a gas bubble lengthening when the drill string penetrates into it. Then, the subsea valves 764 and 770 are lined out to bleed mud through the chokes G into the mud chamber 720 of the mud tank 722.

As the drill string is further stripped into the well, mud is bled from the well in precisely measured quantities to offset the volume of drill string that is stripped into the well. A piston locator used to track the position of the piston in the mud tank or the flow meter 730 provides information for precisely measuring the bleed volume. Additional mud may be bled from the well to allow for gas expansion as a gas bubble percolates up the well. Controlled bleeding of mud from the well allows the proper well pressure to be maintained at the closed blowout preventer so that neither additional fluid influx nor lost circulation occurs. If the mud chamber 720 of the mud tank 722 becomes fill, the stripping operation is stopped temporarily and the mud level in the mud tank is reduced by using the subsea mud pumps to pump mud from the mud tank to the surface. When the drill string is stripped to the bottom of the well, a kill operation is started to circulate out the formation fluid influx.

The mud lift system of the invention permits overbalance changes to be made by temporarily closing the valve H to the mud tank 722 and adjusting the speed of the subsea pumps 670 and 686 to control the mud lift boost pressure. Overbalance is the difference between formation pore pressure and the mud column pressure, where the formation pore pressure is higher than the mud column pressure. With the mud lift system, it is practical to use a mud density that is high enough to provide hydrostatic pressure well in excess of formation fluid pressures for tripping operations and, subsequently, adjust the subsea boost pressure to drill with an underbalance, or minimum overbalance, which increases the drilling rate and reduces formation damage. The mud lift system depends on the rotating diverter 654 and/or non-rotating diverter 661 to hold pressure. A rotating blowout preventer may also be used to hold pressure.

The invention is equally applicable to shallow water and land operations where the mud lift system boosts the pressure from a depth below the surface such that a dual-density mud gradient system is achieved to permit the overbalance to be adjusted by changes in the boost pressure of the mud lift system. For example, a mud lift system and an external return line can be attached to the outside of a casing string when the casing string is run in the well. Then, when drilling resumes below the casing string, mud may be pumped from the subsurface depth of the mud lift system up through the return line to the surface, thereby reducing the overbalance to increase drilling rate and decrease formation change.

Drill String Valve

Figure 18:
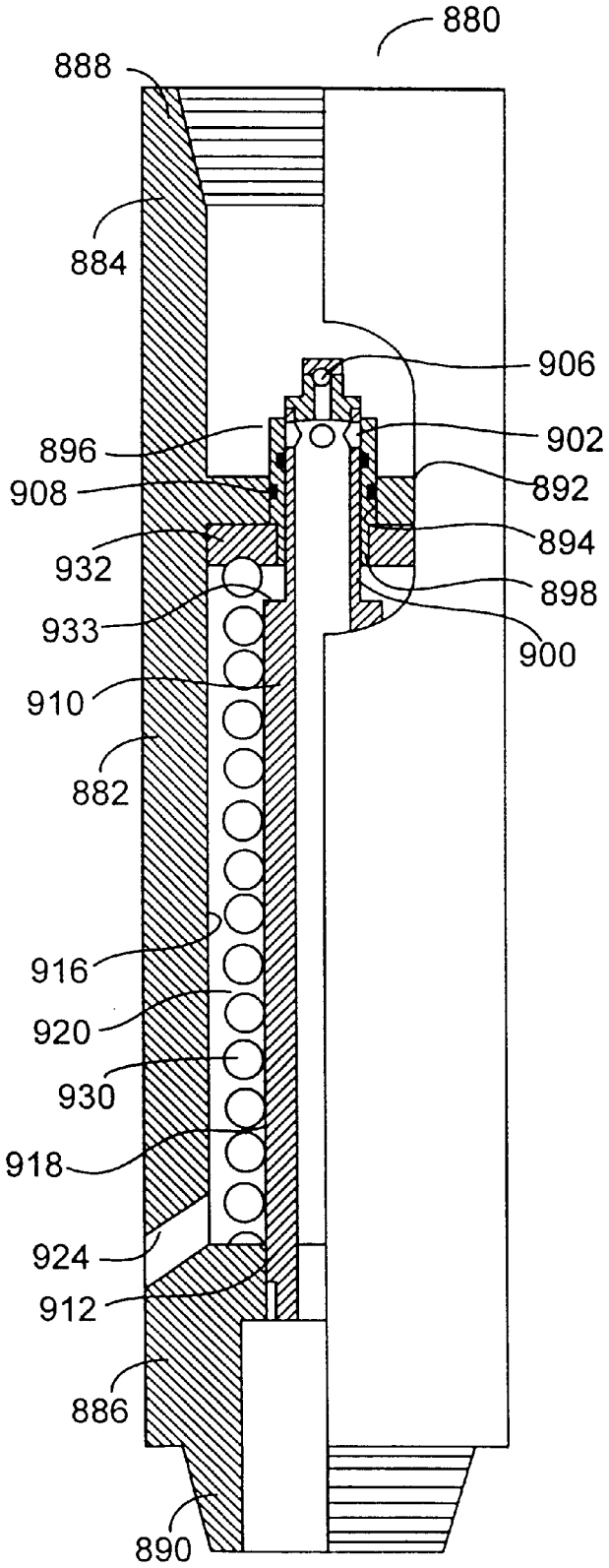
FIG. 18 is a partial cross section of a drill string valve.
Figure 19A:
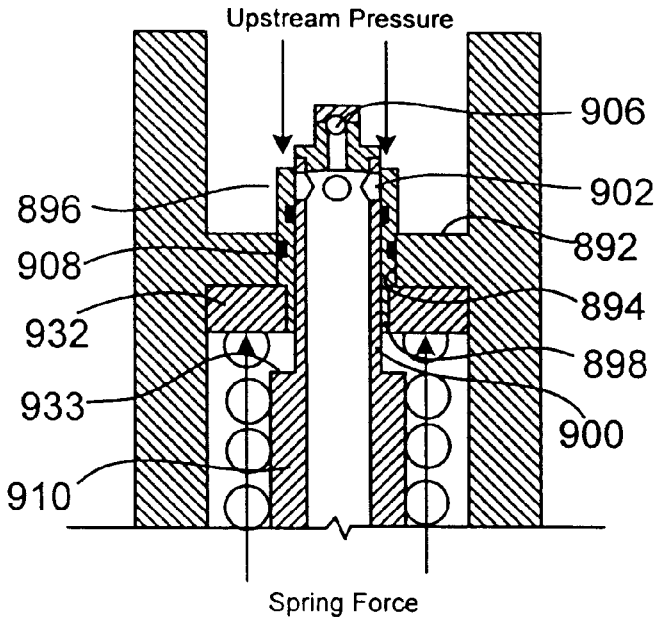
FIGS. 19A and 19B illustrate closed and open positions, respectively, of the drill string valve shown in FIG. 18.
Figure 19B:
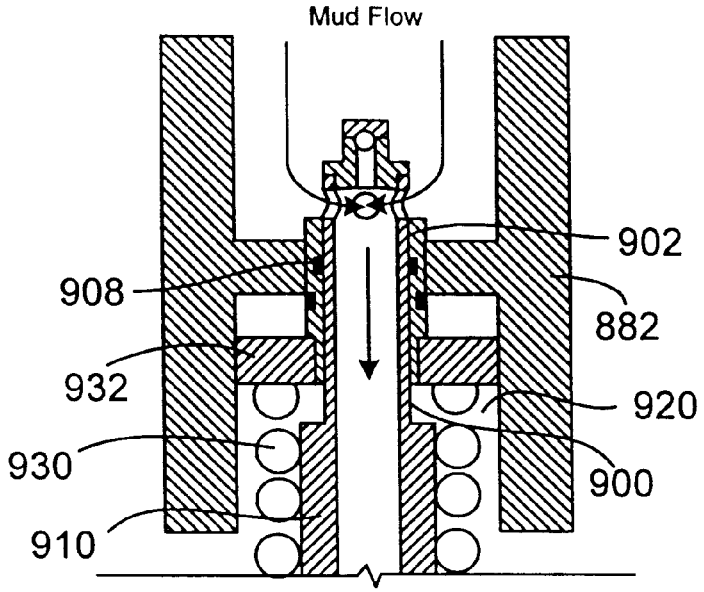

FIGS. 18, 19A, and 19B illustrate a drill string valve 880 which may be disposed in a drill string to prevent mud from free-falling in the drill string. The drill string valve 880 includes an elongated body 882 with an upper end 884 and a lower end 886. A threaded box 888 is formed at the upper end 884 and a threaded pin 890 is formed at the lower end 886. The threaded box 888 and pin 890 facilitate installation of the valve in the drill string.

The body includes a protruding member 892, which defines an aperture 894 for receiving a pressure-actuated flow choke 896. Enlarged views of the flow choke 896 in the open and closed positions are shown in FIGS. 19A and 19B, respectively. The flow choke 896 includes a flow cone 898 and a flow nozzle 900, which is disposed inside the flow cone 898. The flow nozzle 900 has multiple ports 902 arranged in diametrically opposed pairs about the circumference of the nozzle 900. In the closed position of the valve, the ports 902 are covered by the flow cone 898. At the upper end of the flow nozzle 900 is a check valve 906 which may permit flow from the well annulus into the drill string if the well pressure is sufficient to overcome the hydrostatic pressure of the mud column in the drill string. The check valve 906 may be replaced with a blind pipe so that flow from the well annulus into the drill string does not occur. The flow cone 898 is slidable inside the aperture 894 of the protruding member 892 and includes dynamic seals 908 for sealing between the protruding member 892 and the flow nozzle 900.

A flow tube 910 formed at the lower end of the flow nozzle 900 extends to the lower end of the body 882. The lower end 912 of the flow tube 910 is attached to the lower end 886 of the body 882. The outer diameter of the flow tube 910 is larger than the outer diameter of the flow nozzle 900, thus forming a stroke stop for the flow cone 898 as the flow cone 898 reciprocates axially inside the body 882.

The internal wall 916 of the body 882 and the external wall 918 of the flow tube 910 define an annular spring chamber 920. The spring chamber 920 is sealed at the top by the dynamic seals 908 on the flow cone 898. The body 882 includes one or more ports 924 which establish communication between the well annulus and the spring chamber 920.

Inside the spring chamber 920 is a spring 930. One end of the spring 930 reacts against a stopper bar 932 and the other end of the spring 930 reacts against the lower end 886 of the body 882. The stopper bar 932 is attached to the lower end of the flow cone 898. The spring 930 is pre-compressed to a predetermined value and arranged to upwardly bias the stopper bar 932 to contact the protruding member 892. When the stopper bar 932 is in contact with the protruding member 892, the flow ports 902 are fully closed by the flow cone 898.

In operation, the valve 880 may be arranged in a drill string or located at the upper end of a drill bit. When mud is pumped down the bore of the drill string to the flow choke 896, the upper end of the flow cone 898 is acted on by mud pressure in the drill string while the lower end of the flow cone 898 is acted on by the spring 930 and the well annulus pressure in the spring chamber 920. When there is sufficient pressure differential acting on the flow cone 898, the flow cone 898 starts to move downwardly to open the ports 902. As the ports 902 are opened, mud flows into the flow nozzle 900 and the flow tube 910. The mud entering the flow tube 910 flows through the drill bit nozzles into the well annulus.

As the flow rate in the drill string is increased, the differential pressure acting on the flow cone increases and the flow cone 898 is moved further down to increase the exposed flow area of the ports 902. The flow area of the ports 902 is at the maximum when the stopper bar contacts the top end of the flow tube 910, as shown in FIG. 19*b*. When the surface mud pump is shut down, the pressure differential acting across the flow cone 898 decreases and allows the flow cone 898 to move upwardly to close the ports 902.

When pulling the drill string with the valve 880 out of the well, the valve 880 prevents mud from dropping out of the drill string. A dart or ball actuated drain valve (not shown) may be installed in the drill string and operated to allow the drill string to drain as it is pulled out of the well. Alternatively, a mud bucket (not shown) may be installed at the surface to collect mud from the drill string as the drill string is pulled to the surface. As the drill string is pulled from the well, mud is introduced into the well as described previously to maintain well control.

Figure 20A:
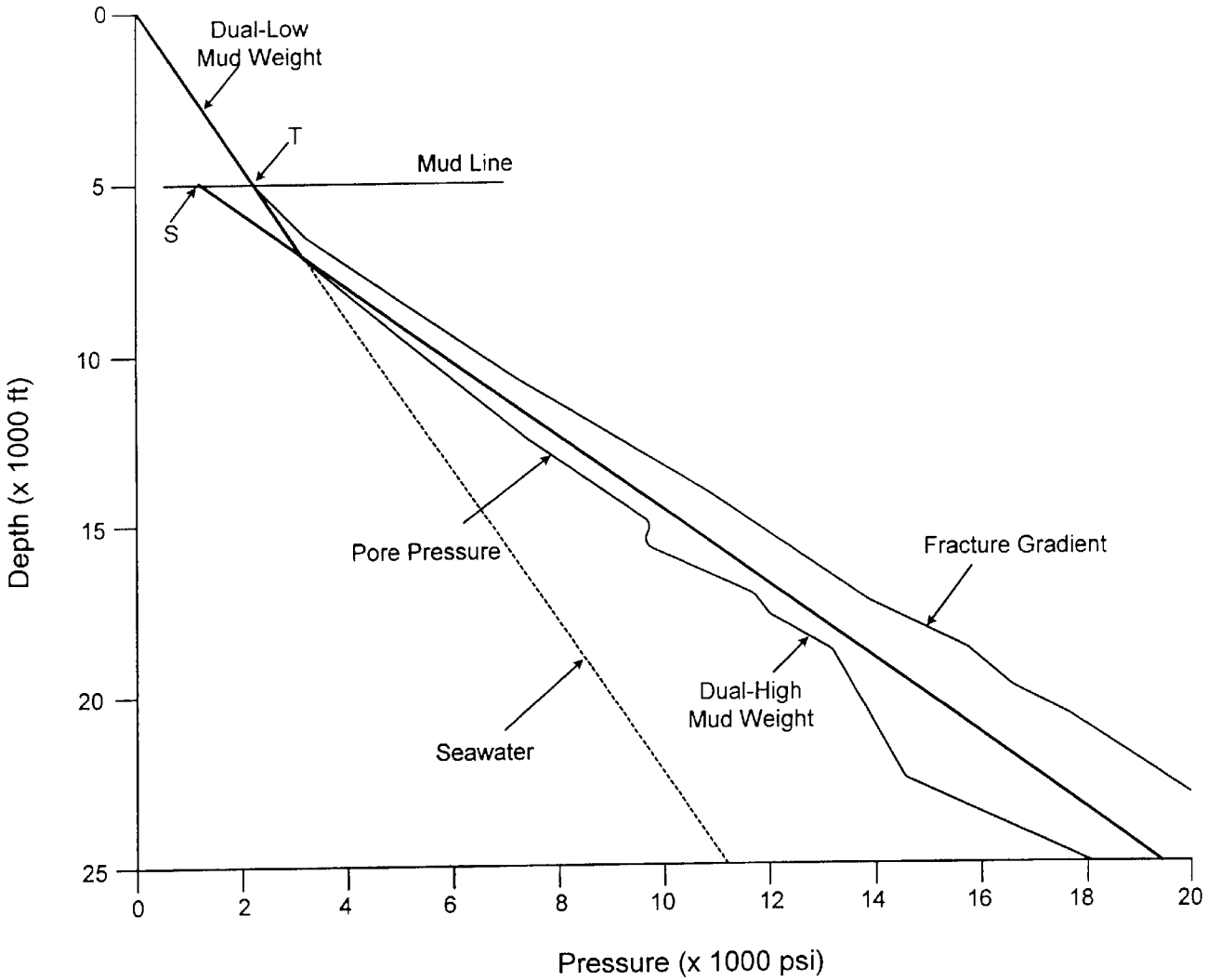
FIG. 20A is a graph of depth versus pressure for a well drilled in a water depth of 5,000 feet for a dual-density mud gradient system which has a mudline pressure less than seawater pressure.
Figure 20B:
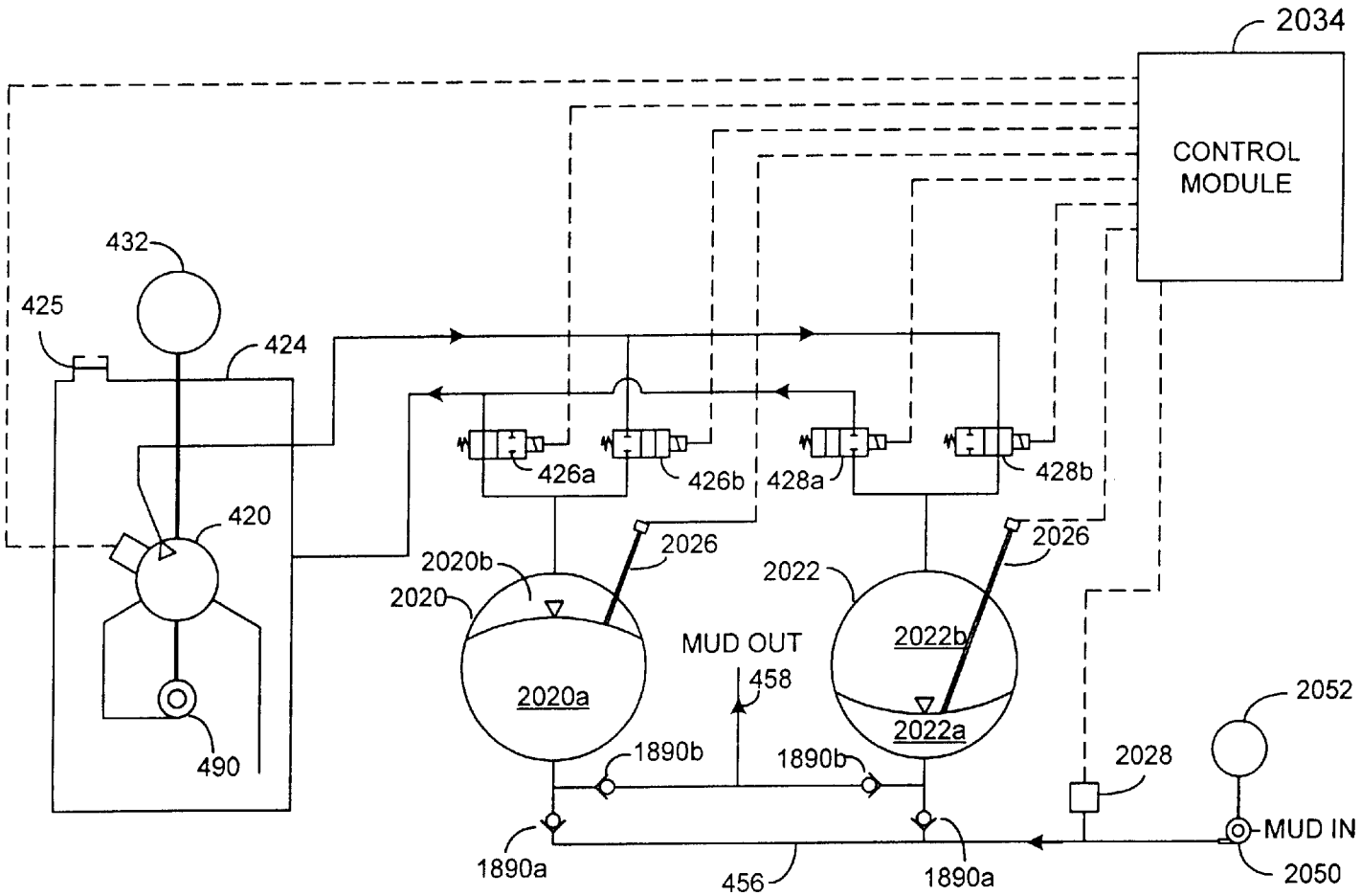
FIG. 20B shows the open-circuit hydraulic drive of FIG. 10A with a mud charging pump in the mud suction line.

In the discussion on the hydraulic drive for the subsea mud pump, it was mentioned that the suction pressure of the pumping elements is maintained at seawater pressure. However, it may be desirable to make the well annulus pressure at the suction point of the pumping elements less than seawater pressure. As shown in FIG. 20A, after the shallow water formations are cased off, the fracture pressure gradients and pore pressure gradients are best intersected by a mud column gradient in combination with an annulus or mudline pressure that is unequal to seawater pressure. Addition of a booster pump to create the necessary pressure differential for filling the pump with mud is a way to provide this lower annulus pressure. FIG. 20B shows the addition of a mud charging pump 2050 powered by a separate electric motor 2052. The pump 2050 would boost the lower annulus pressure to a higher pressure sufficient to operate the subsea mud pumps.

Figure 20C:
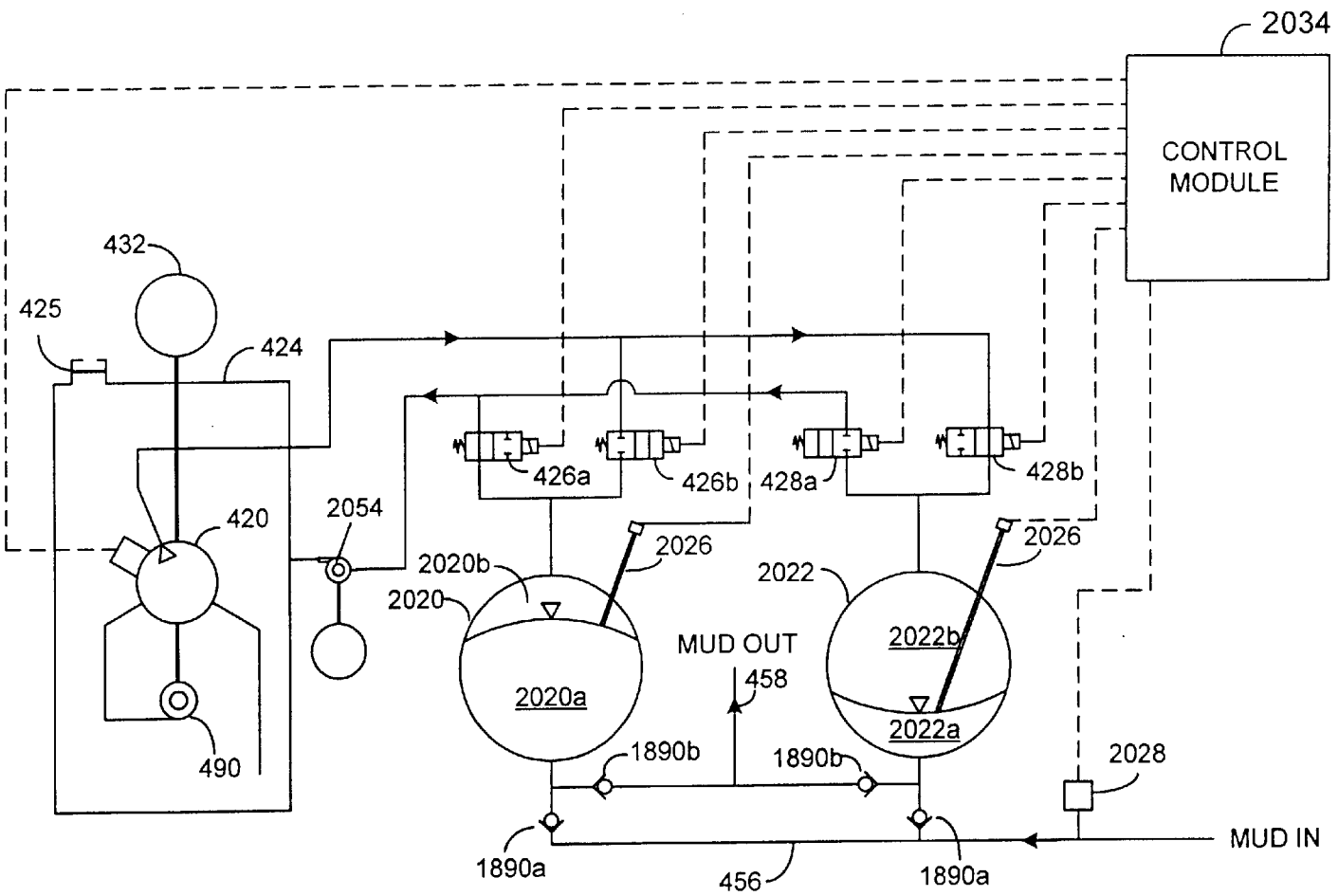
FIG. 20C shows the open-circuit hydraulic drive of FIG. 10B with a boost pump in the hydraulic fluid discharge line.

Another method to effectively increase the pressure differential between the mud chambers of the pumping elements, e.g., mud chambers 2020*a* and 2022*a*, and their respective hydraulic power chambers, i.e., hydraulic power chambers 2020*b* and 2022*b*, is to add a booster pump 2054, as shown in FIG. 20C, which takes suction from the hydraulic chambers and discharges to the reservoir 424. This effectively lowers the hydraulic pressure in the hydraulic power chambers when the corresponding hydraulic control valves open a flow path between the hydraulic power chambers and the suction of the booster pump 2054. The pressure of the mud flowing into the mud chambers can be lowered by the amount of the boost pressure provided by the boost pump 2054. The effect of making the annulus or mudline pressure less than seawater pressure, as illustrated in FIG. 20A, is a dual gradient system which has a low gradient leg that is defined by a mudline pressure (S). In the example shown, the mudline pressure (S) is approximately 1,000 psi less than the seawater pressure (T) at the mudline. Seawater pressure at the mudline is sealed from the lower pressured mud column by the diverter(s). Rotating blowout preventers that seal from either direction may also be used to seal seawater pressure at the mudline.

Other Embodiments of the Offshore Drilling System

Figure 21:
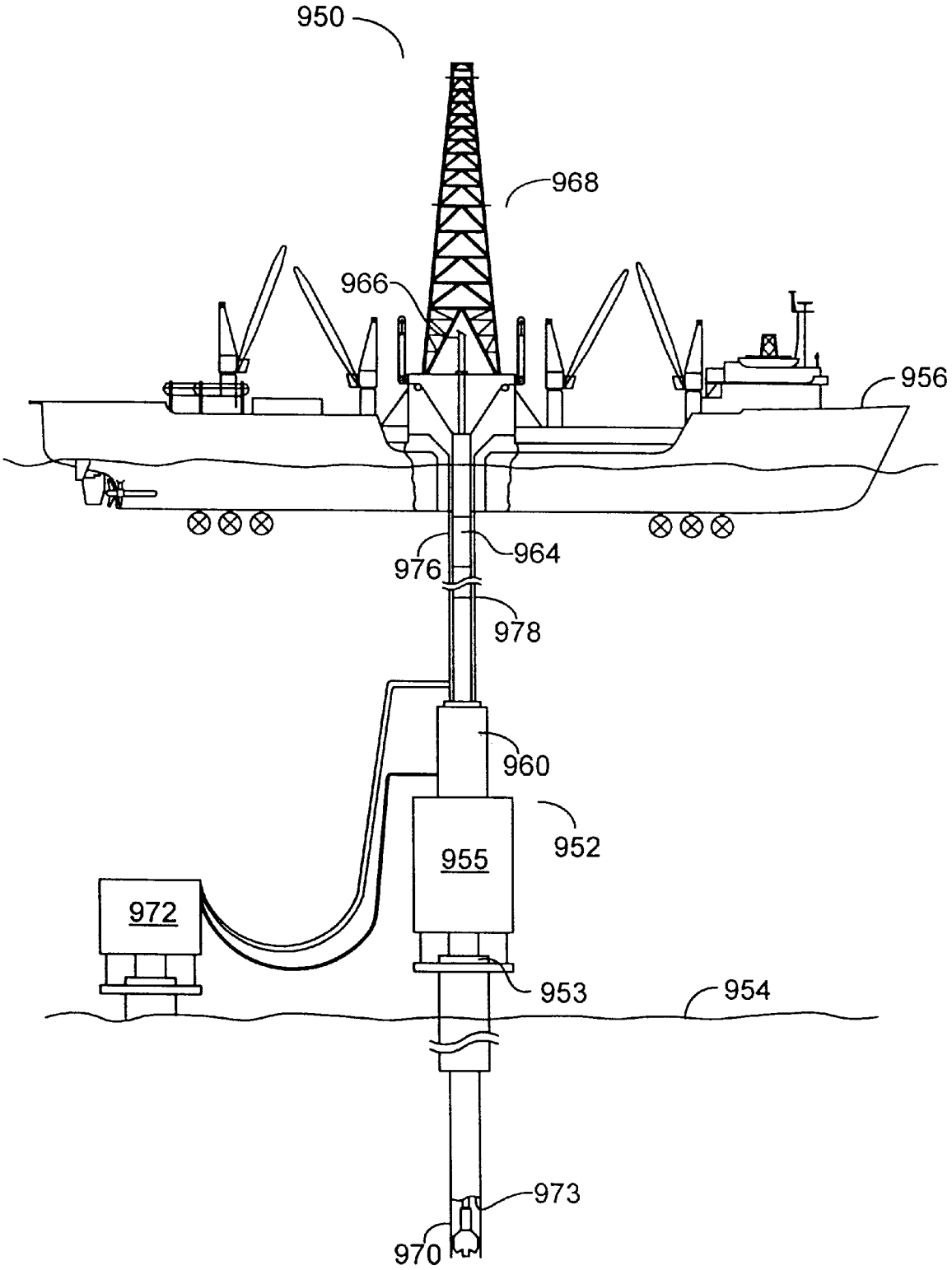
FIG. 21 illustrates the offshore drilling system of FIG. 1 with a mud lift module mounted on the seafloor.

FIG. 21 illustrates another offshore drilling system 950 which includes a wellhead stack 952 that is mounted on a wellhead 953 on a seafloor 954. The wellhead stack 952 includes a well control assembly 955 and a pressure-balanced mud tank 960. The wellhead stack 952 is releasably connected to the drilling vessel 956 by a marine riser 964. A drill string 966, which is supported by a rig 968 on the drilling vessel 956, extends into the well 970 through the wellhead stack 952. The drilling system 950 includes a mud lift module 972 which is mounted on the seafloor 954. The mud lift module 972 is connected to the well annulus 973 through a suction umbilical line 974. The mud lift module 972 is also connected to the mud return lines 976 and 978 through discharge umbilical lines 980 and 981. Power and control lines to the mud lift module 972 may be incorporated into the umbilical lines or may be carried by separate umbilical lines.

Figure 22A:
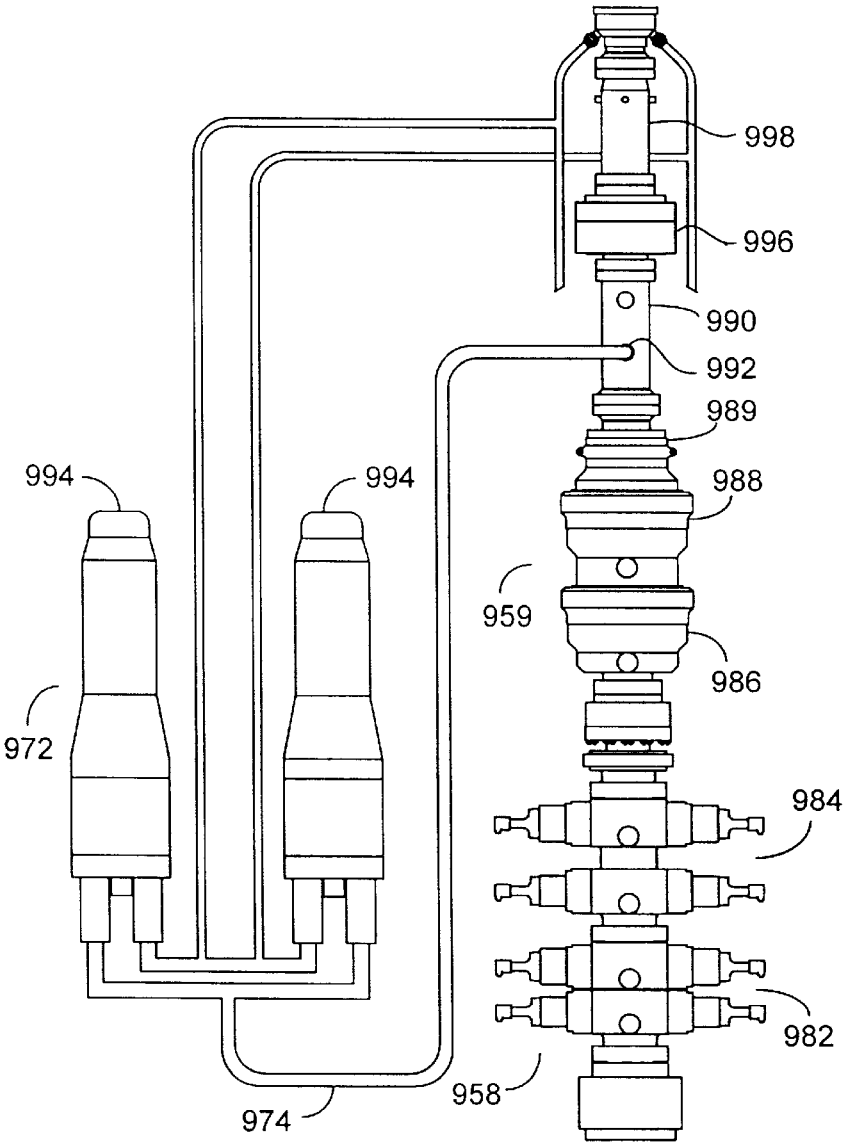
FIGS. 22A and 22B are elevation views of retrievable subsea components of the offshore drilling system shown in FIG. 21.
Figure 22B:
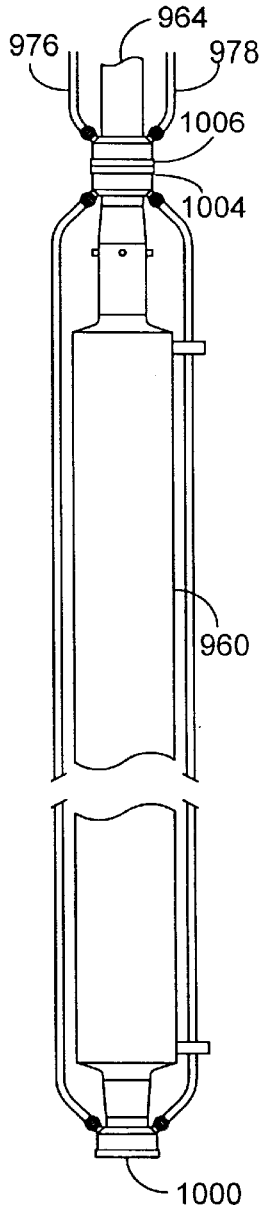

As shown in FIG. 22A, the well control assembly 955 includes a subsea BOP stack 958 and a lower marine riser package (LMRP) 959. The subsea BOP stack 958 includes ram preventers 982 and 984. The LMRP 959 includes annular preventers 986 and 988 and a flexible joint 989. A flow tube 990 is mounted on the annular preventer 988. The flow tube 990 has flow ports 992 that are connected to the suction ends of the subsea pumps through a flow conduit in the suction umbilical line 974. A diverter 996 is mounted on the flow tube 990, and a diverter 998 is mounted on the diverter 996. The diverter 996 may be a non-rotating diverter, similar to any of the non-rotating diverters shown in FIGS. 3A and 3B. The diverter 998 may be a rotating diverter, similar to any of the rotating diverters shown in FIGS. 4A–4C. As shown in FIG. 22B, the pressure-balanced mud tank 960, which is similar to the mud tank 42, includes a connector 1000 that is arranged to mate with the connector 1002 on the diverter 998. The mud tank 960 also includes a connector 1004 that mates with a riser connector 1006 at the lower end of the marine riser 96.

Figure 23:
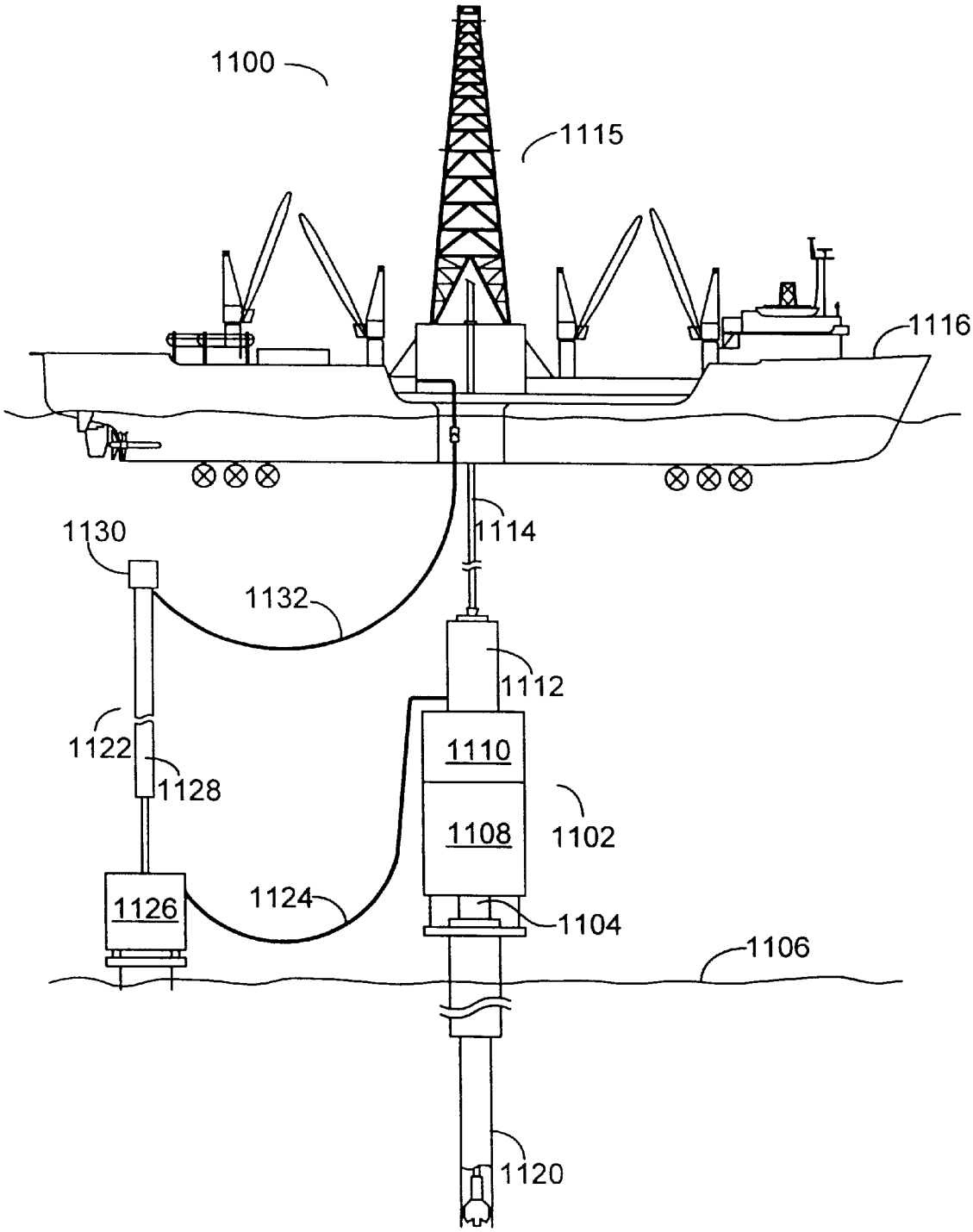
FIG. 23 illustrates the offshore drilling system of FIG. 1 without a marine riser.

Thus far, the invention has been described in the context of a marine riser connecting a wellhead stack on a seafloor to a drilling vessel on a body of water. However, the invention is equally applicable in riserless drilling configurations. FIG. 23 illustrates shows a riserless drilling system 1110 which includes a wellhead stack 1102 that is mounted on a wellhead 1104 on a seafloor 1106. The wellhead stack 1102 includes a well control assembly 1108, a mud lift module 1110, and a pressure-balanced mud tank 1112. A drill string 1114 extends from a rig 1115 on a drilling vessel 1116 through the wellhead stack 1102 into the well 1120.

A return line system 1122 connects a mud return system (not shown) on the drilling vessel 1116 to the discharge ends of subsea mud pumps (not shown) in the mud lift module 1110. The return line system 1122 also provides a connection for hydraulic and electrical power and control between the wellhead stack 1102 and the drilling vessel 1116. The return line system 1122 includes a lower umbilical line 1124, a latch connector 1126, a return line riser 1128, a buoy 1130, and an upper umbilical line 1132. Mud discharged from the subsea mud pumps (not shown) of the mud lift module 1110 flows through the lower umbilical line 1124, the latch connector 1126, the return line riser 1128, and the upper umbilical line 1132 into a mud return system on the drilling vessel 1116. The return line riser 1128 is maintained in a vertical orientation in the water by the buoy 1130.

Figure 24A:
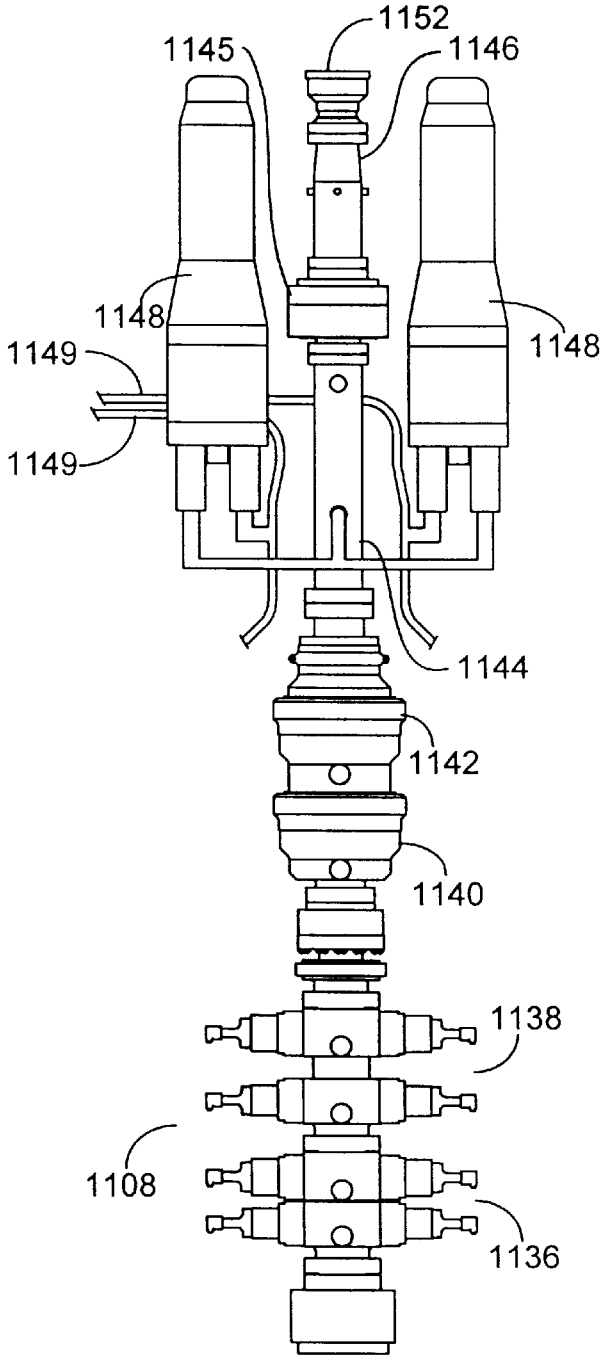
FIGS. 24A and 24B show elevation views of the retrievable subsea components of the offshore drilling system shown in FIG. 23.
Figure 24B:
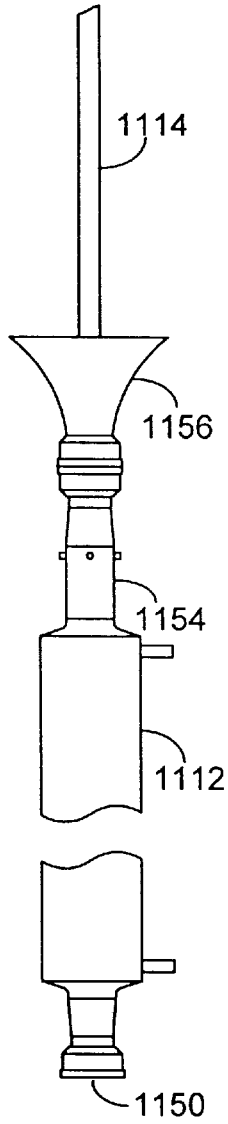

FIGS. 24A and 24B show the components of the well control assembly 1108 which was previously illustrated in FIG. 23. As shown, the well control assembly 1108 includes ram preventers 1136 and 1138 and annular preventers 1140 and 1142. A flow tube 1144 is mounted on the annular preventer 1140. A non-rotating diverter 1145 is mounted on the flow tube 1144 and a rotating diverter 1146 is mounted on the diverter 1145. The diverter 1145 may be any of the diverters shown in FIGS. 3A and 3B. The diverter 1146 may be any of the diverters shown in FIGS. 4A–4C. The mud lift module 1110 includes subsea mud pumps 1148 which have suction ends that are connected to the return line riser 1128 by flow conduits 1149 in the lower umbilical line 1124.

The mud tank 1112 includes a connector 1150 which is arranged to mate with a similar connector 1152 on the diverter 1146. The mud tank 1112 is similar to the mud tank 42. A wiper 1154 provided on the mud tank 42 includes a wiper element, similar to wiper element 234 (shown in FIG. 5), which provides a low-pressure pack-off against a drill string received in the bore of the mud tank. A guide horn 1156 is provided on top of the wiper 1154 to help guide drilling tools from the drilling vessel 1116 into the well 1120.

Figure 25:
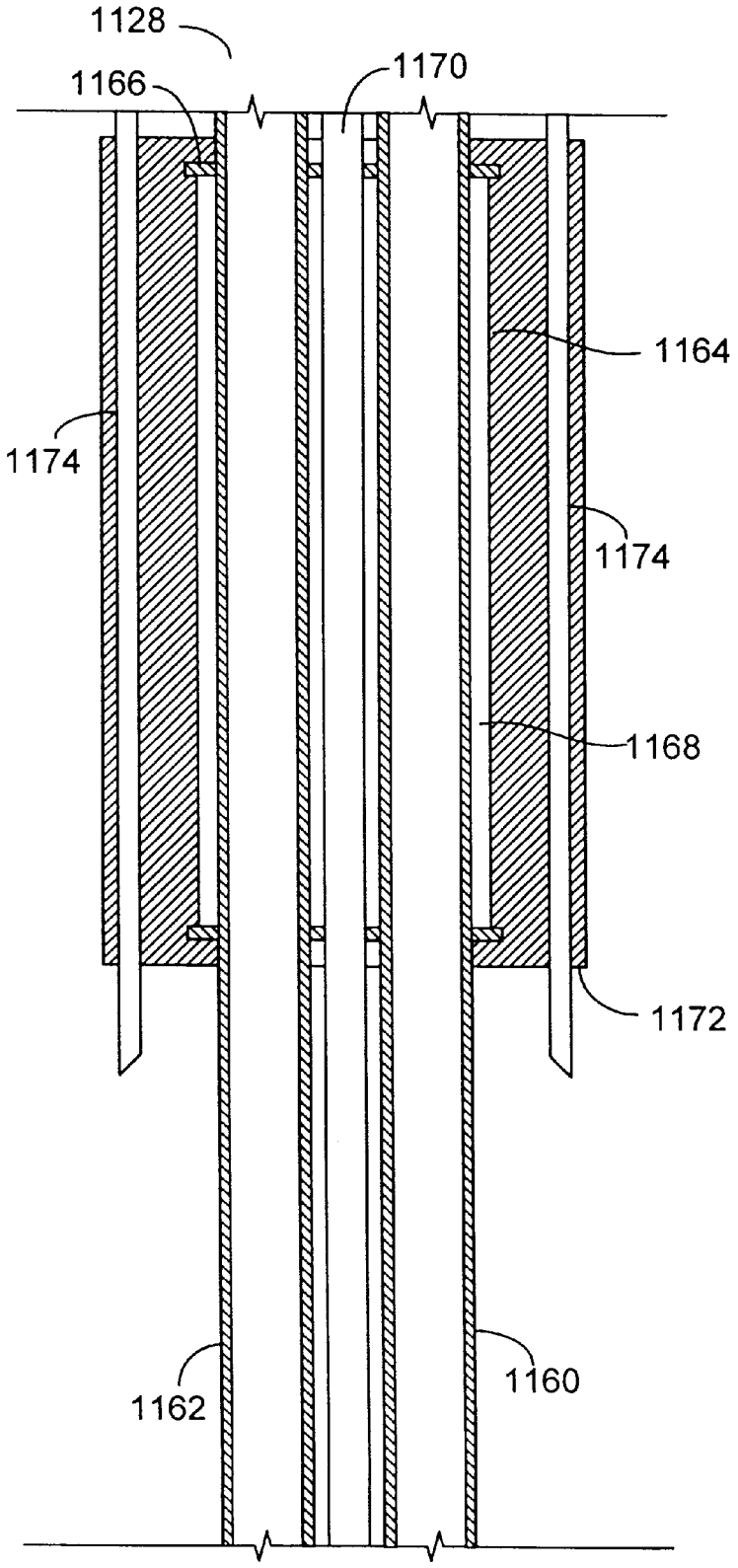
FIG. 25 is a cross section of one embodiment of the return line riser shown in FIG. 23.

FIG. 25 shows a vertical cross section of the return line riser 1128 which was previously illustrated in FIG. 23. As shown, the return line riser 1128 includes a first return line 1160 and a second return line 1162 that are disposed within a support structure 1164. The support structure 1164 includes a pair of vertically spaced plates 1166 that are held together by tie rods 1168. The plates have aligned apertures for receiving the return lines 1160 and 1162. The plates also have an aperture for receiving a hydraulic fluid line 1170. The hydraulic fluid line 1170 supplies hydraulic fluid to the wellhead stack 1102.

A buoyancy module 1172 surrounds the support structure 1164, the return lines 1160 and 1162, and the hydraulic fluid line 1170. Power cables 1174 are disposed within the buoyancy module 1172. The power cables 1174 supply power to components in the mud lift module 1110. The return lines 1160 and 1162, the hydraulic fluid line 1170, and the power cables 1174 are connected to the wellhead stack 1102 through the latch connector 1126 (see FIG. 23). The buoyancy module 1172 is shown as extending across an upper portion of the return lines 1160 and 1162. It should be clear that the buoyancy module may completely encase the return lines 1160 and 1162, including the hydraulic fluid line 1170 and the power cables 1174.

Figure 26:
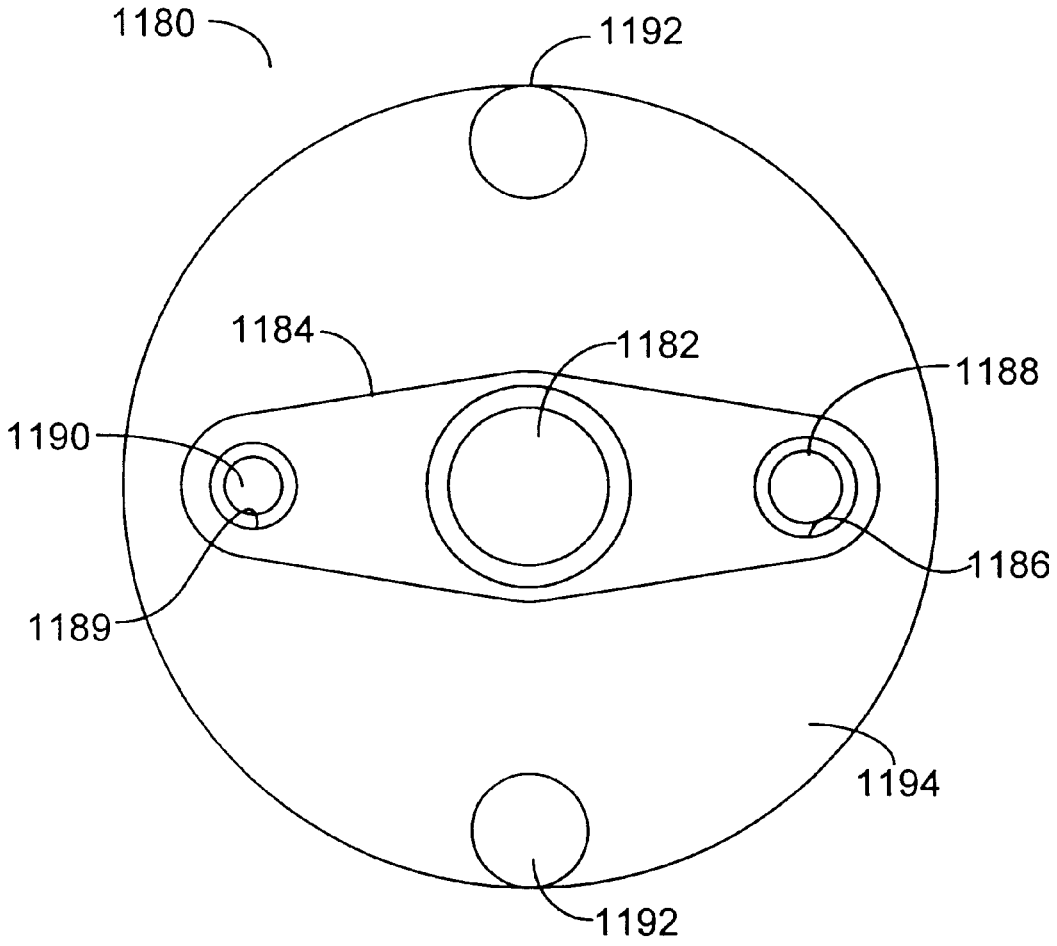
FIG. 26 is a top view of another embodiment of the return line riser shown in FIG. 23.

FIG. 26 shows an alternate return line riser 1180 that may be used in place of the return line riser 1128 illustrated in FIG. 25. The return line riser 1180 includes a return line 1182 with a flanged structure 1184 affixed to its upper end. The flanged structure 1184 includes aperture 1186 for receiving a second return line 1188 and aperture 1189 for receiving a hydraulic supply line 1190. The return lines 1182 and 1188, the hydraulic supply line 1190, and the power cables 1192 are disposed within a buoyancy module 1194. The buoyancy module 1194 may extend over a portion of the lengths of the return lines or completely encase the return lines.

While the return line risers 1128 and 1180 show two return lines, it should be clear that one return line or more than two return lines may be used. More than two power cables and more than one hydraulic supply line may also be included in the return line riser system. The return line riser system 1122 should be positioned far from the wellhead stack 1102 to prevent interference between the return line riser 1128 and the drill string 1114.

Figure 27:
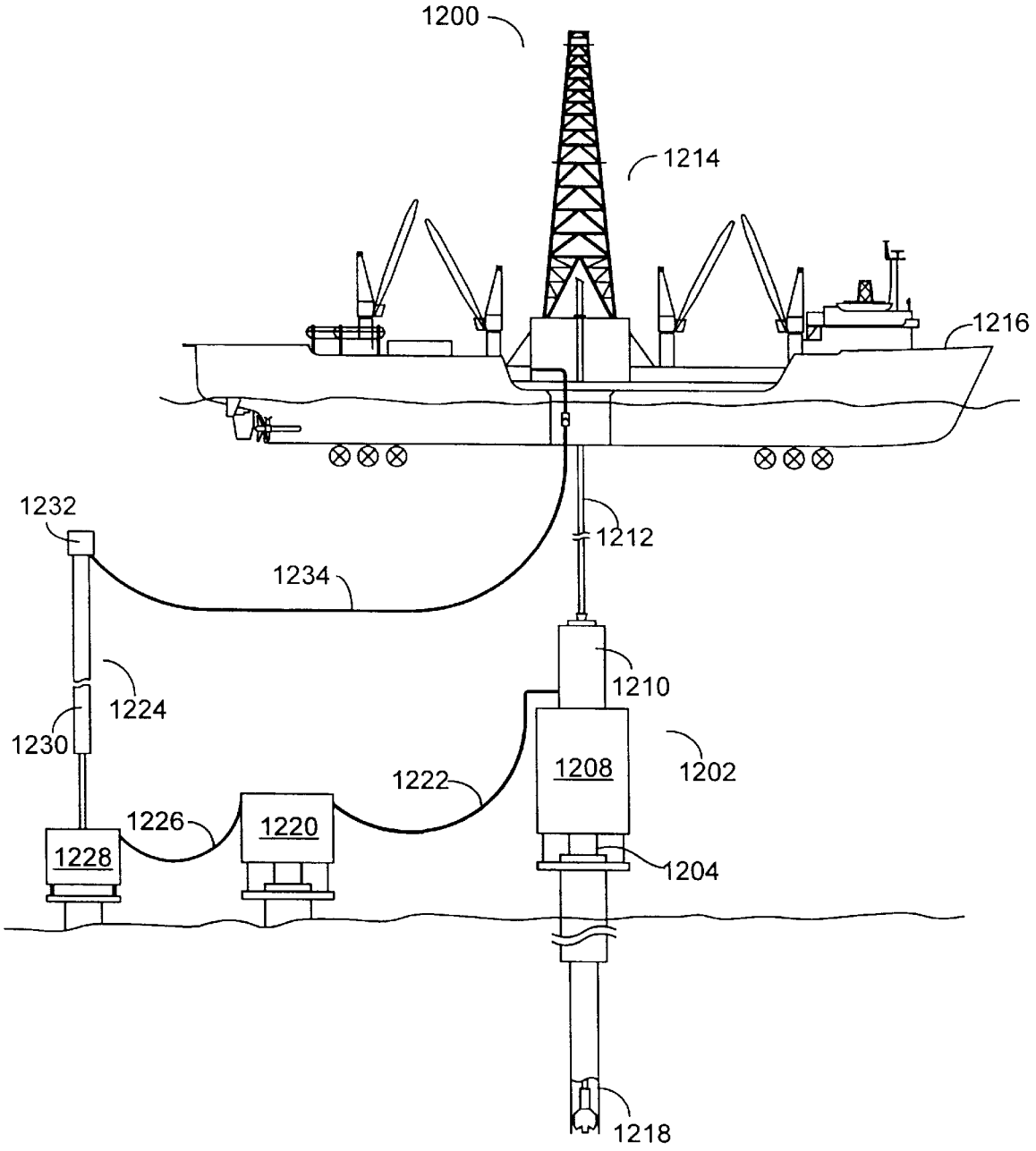
FIG. 27 illustrates the offshore drilling system of FIG. 1 without a marine riser and with a mud lift module mounted on the seafloor.

FIG. 27 illustrates another offshore drilling system 1200 which includes a wellhead stack 1202 that is mounted on a wellhead 1204 on a seafloor 1206. The wellhead stack includes a well control assembly 1208 and a pressure-balanced mud tank 1210. A drill string 1212, which is supported by a rig 1214 on a drilling vessel 1216, extends through the wellhead stack 1202 into a well 1218. The drilling system includes a mud lift module 1220 which is mounted on the seafloor 1206. The mud lift module is connected to the well annulus through suction umbilical lines. The mud lift module is also connected to a return line riser system, similar to return line riser system 1122, as shown in FIG. 23, through discharge umbilical lines.

Figure 28:
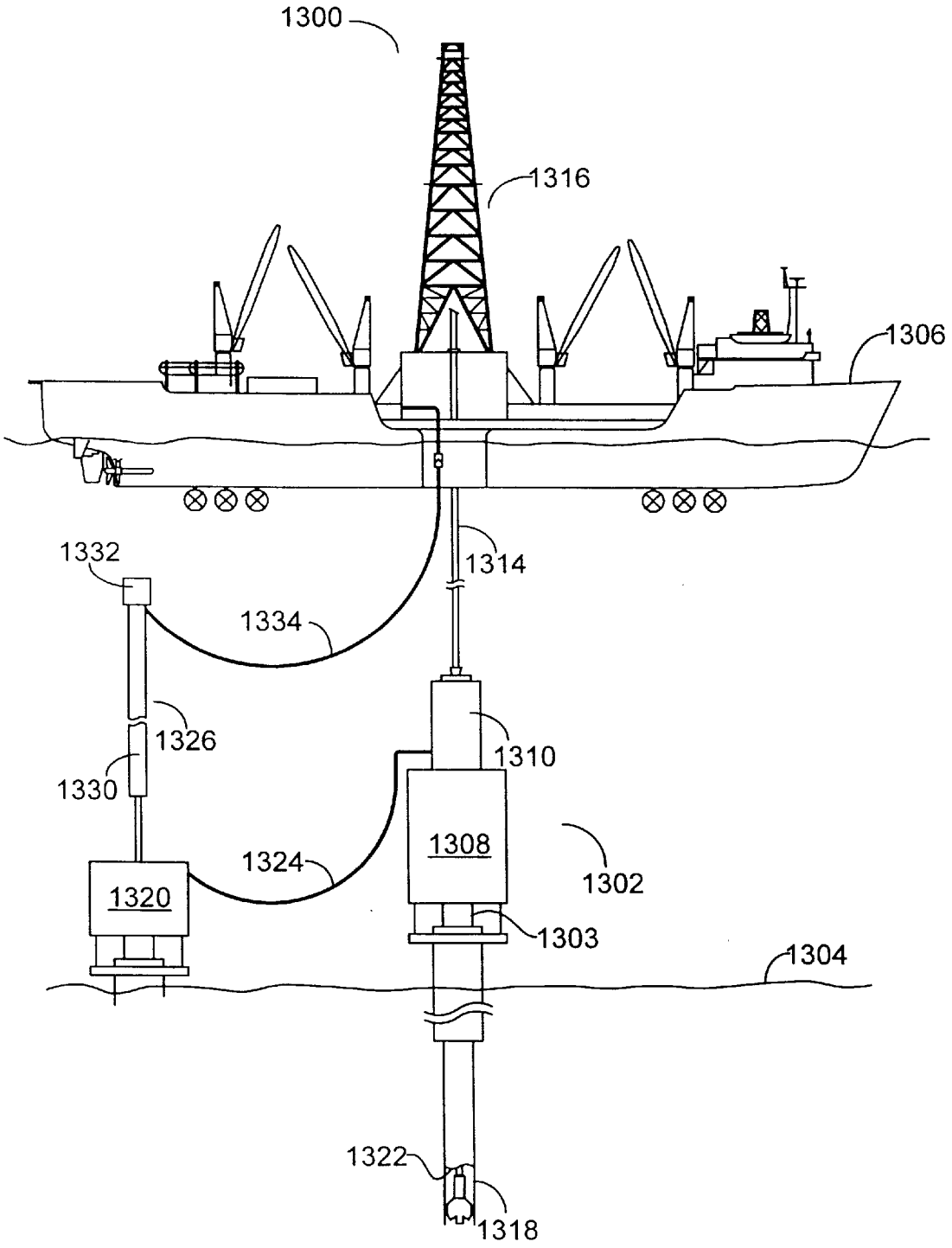
FIG. 28 illustrates the offshore drilling system of FIG. 1 without a marine riser and with a return line riser extending from a mud lift module.

FIG. 28 illustrates another offshore drilling system 1300 which includes a wellhead stack 1302 that is positioned on a wellhead 1303 on a seafloor 1304. The wellhead stack 1302 includes a well control assembly 1308, a pressure-balanced mud tank 1310, and a wellhead 1312. A drill string 1314, which is supported by a rig 1316 on the drilling vessel 1306, extends into the well 1318. The drilling system 1306 includes a mud lift module 1320 which is mounted on the seafloor 1304. The mud lift module 1320 is connected to the well annulus 1322 through suction umbilical lines 1324.

A return line riser system 1326 extends from the mud lift module 1328 to the drilling vessel 1306. The return line riser system 1326 includes a return line riser 1330, a buoy 1332, and an upper umbilical line 1334. The discharge ends of the subsea pumps 1336 are connected to the lower end of the return line riser 1330. The upper umbilical line 1334 connects the upper end of the return line riser 1330 to a mud return system (not shown) on the drilling vessel 1306. The buoy 1332 is arranged to keep the return line riser 1330 vertical. The return line riser 1330 should be positioned far away from the drill string 1314 to prevent interference.

Figure 29A:
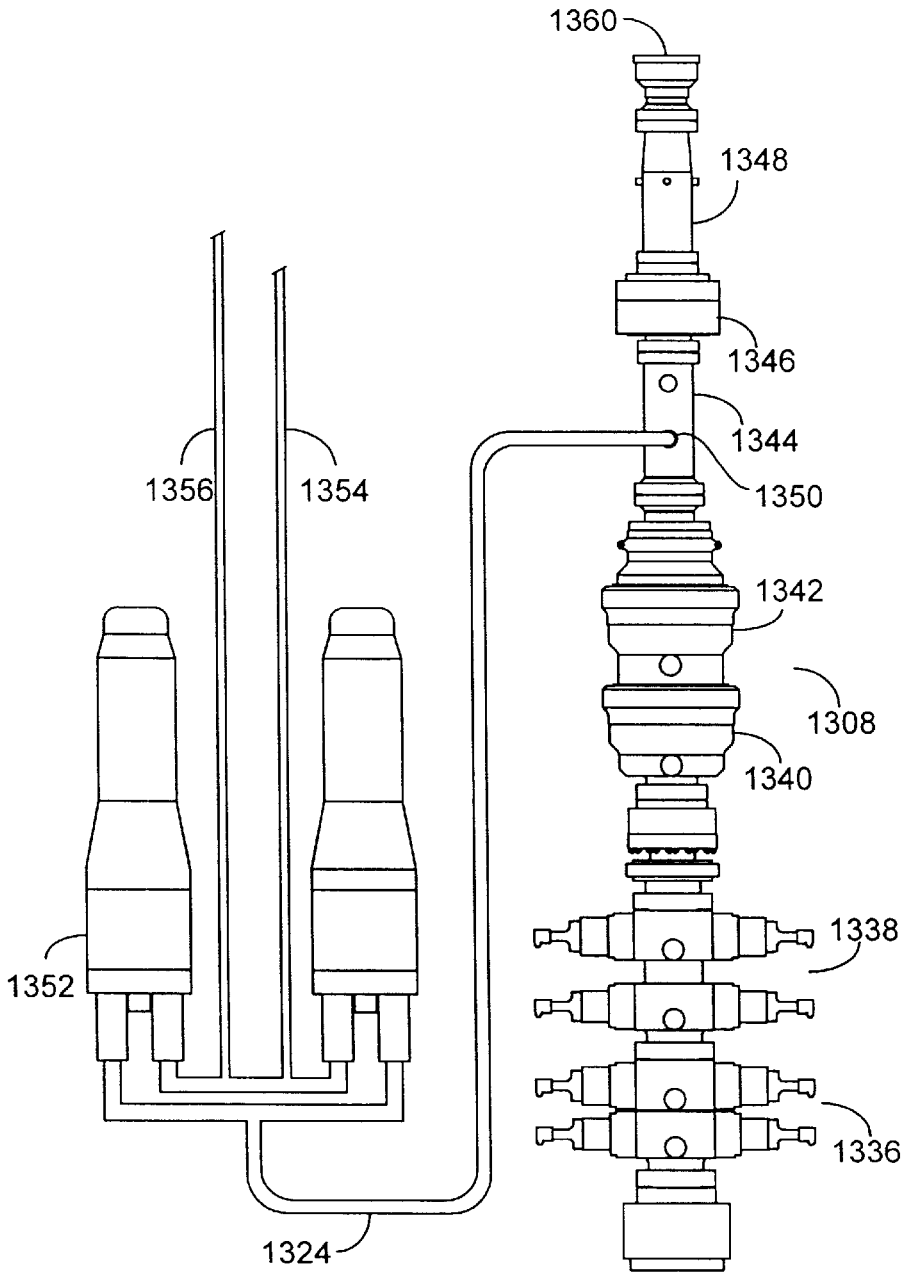
FIGS. 29A and 29B show elevation views of the retrievable subsea components of the offshore drilling system shown in FIG. 28.
Figure 29B:
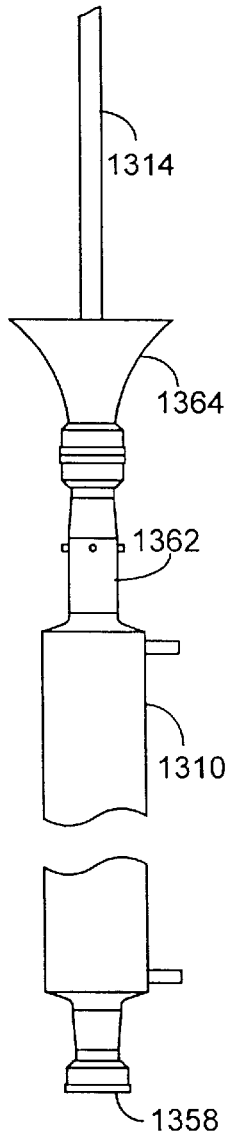

As shown in FIG. 29, the well control assembly 1308 includes ram preventers 1336 and 1338 and annular preventers 1340 and 1342. A flow tube 1344 is mounted on the annular preventer 1342. The flow tube 1344 has an outlet 1350 that is connected to the suction ends of the subsea mud pumps 1352 of the mud lift module 1328 by a conduit 1324. The discharge ends of the subsea mud pumps 1352 are connected to return lines 1354 and 1356 in the return line riser 1330. A non-rotating diverter 1346 is mounted on the flow tube 1344 and a rotating diverter 1348 is mounted on the diverter 1346. The diverters 1346 and 1348 are arranged to divert flow from the well annulus to the flow conduit 1324.

Figure 30:
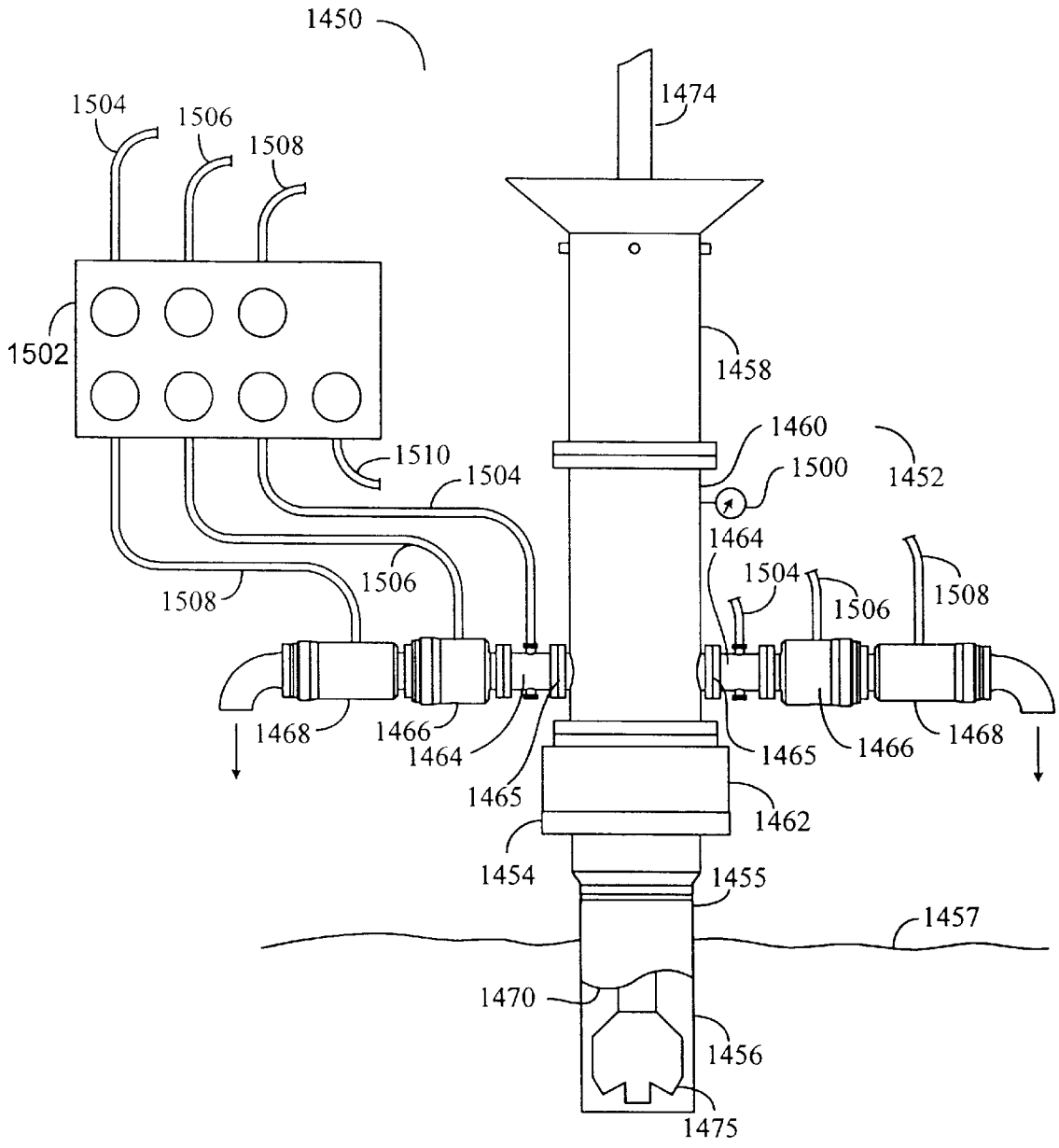
FIG. 30 illustrates an offshore drilling system with a subsea flow assembly.

FIG. 30 illustrates a shallow water drilling system 1450 which may be used to drill an initial section of a well. The shallow water drilling system 1450 includes a flow assembly 1452 mounted on a conductor housing 1454. The conductor housing 1454 is attached to the upper end of a conductor casing 1455 which extends into a well 1456 in the seafloor 1457. The flow assembly 1452 includes a rotating diverter 1458 which is mounted on a flow tube 1460. The flow tube 1460 is connected to the conductor housing 1454 by the connector 1462. Flow meters 1464 are mounted at outlets 1465 of the flow tube 1460. Valves 1466 are mounted at the outlet of the flow meters 1464 and adjustable chokes 1468 are mounted at the outlet of valves 1466.

The rotating diverter 1458 may be any of the rotating diverters shown in FIGS. 4A–4C. A non-rotating diverter, such as any of the diverters shown in FIGS. 3A and 3B, may also be disposed between the rotating diverter 1458 and the connector 1462. The diverter 1458 is arranged to divert drilling fluid, which may be seawater, from the well annulus 1470 to the outlets 1465 of the flow tube 1460.

A drill string 1474 extends from a drilling vessel (not shown) at the surface to the well 1456. During drilling, the drilling fluid pumped into the drill string 1474 rises up the well annulus 1470 to the outlets 1465 of the flow tube 1460. The fluid exits the outlets 1465 and enters the flow meters 1464. The flow meters 1464 are, for example, full-bore, non-restrictive type flow meters. Fluid exits the flow meters 1464 into the valves 1466. The valves 1464 provide positive shut off of the flow passage. Fluid exits the valves 1466 and enters the chokes 1468. The fluid entering the chokes 1468 is discharged to the seafloor.

The choke 1468 is similar to a mud saver valve disclosed in U.S. Pat. No. 5,339,864 assigned to Hydril Company. The chokes 1468 provide a means of regulating flow resistance, thus allowing control of the back pressure in the well annulus 1470. This makes it possible to drill with lighter drilling fluids, such as seawater, while maintaining adequate pressure on the formation to resist the influx of formation fluids into the well.

A pressure transducer 1500 measures fluid pressure in the well annulus 1470. The pressure transducer 1500 is monitored by a remote operated vehicle (ROV) 1502 through the control line 1510. The control lines 1504, 1506, and 1508 connect the flow meters 1464, the valves 1466, and the chokes 1468, respectively, to the ROV 1502. The ROV 1502 monitors the flow rates in the flow meters 1464 and operates the valves 1466 and chokes 1468. The readings from the flow meters 1464 and the pressure transducer 1500 are used as control set-points for adjusting the chokes 1468.

Figure 31:
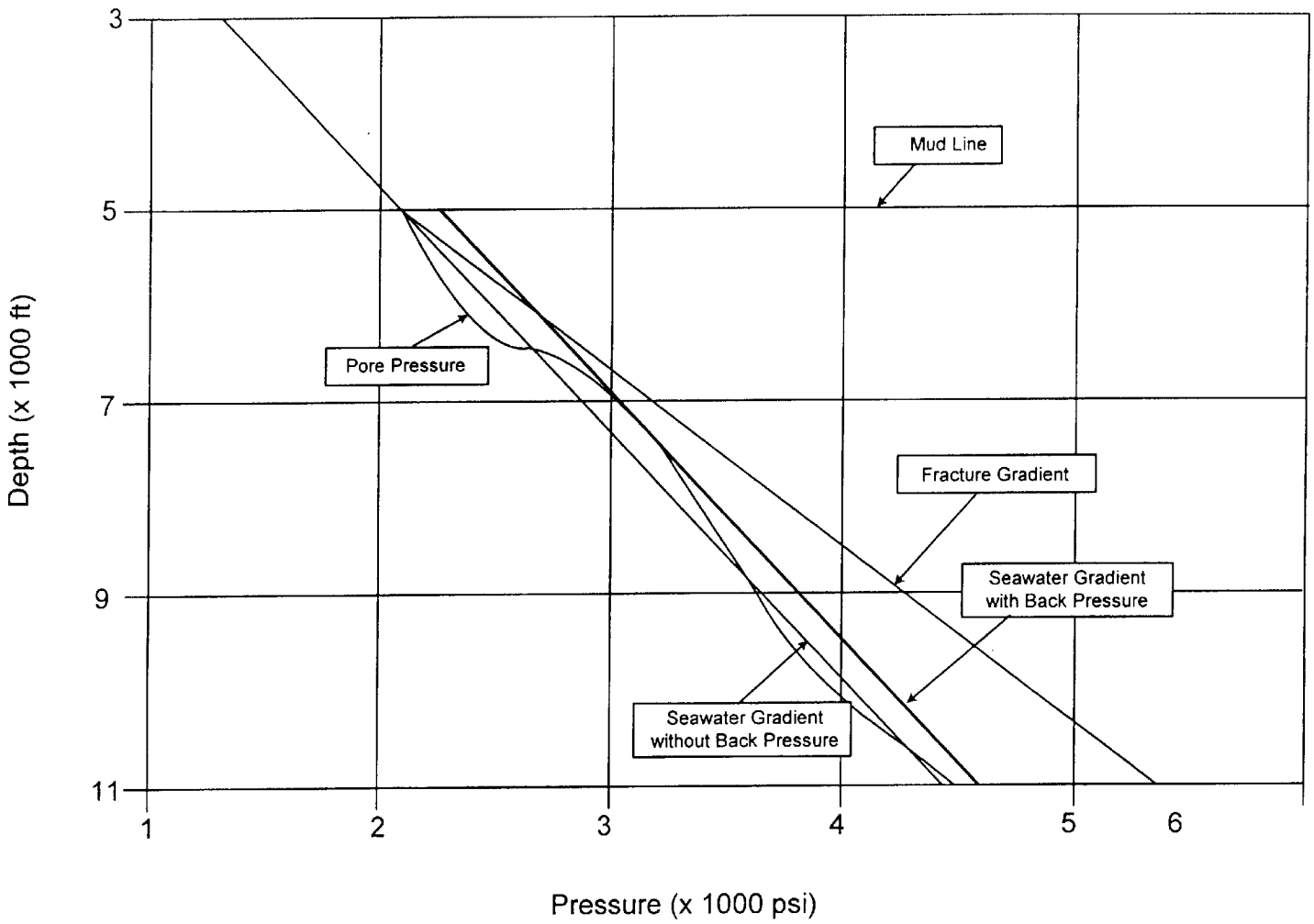
FIG. 31 is a graph of depth versus pressure for the initial section of well drilled in a water depth of 5,000 feet using the subsea flow assembly shown in FIG. 30.

The drilling systems 1450 provides a dual-density drilling fluid gradient system which consists of the drilling fluid column extending from the bottom of the well to the mudline or seafloor and the back pressure maintained at the mudline by using the chokes to regulate the discharge flow. FIG. 31 compares this dual-density drilling fluid gradient system with a single-density drilling fluid gradient system for a well in a water depth of 5,000 feet. As shown, maintaining a back pressure at the mudline has the effect of shifting the mud pressure line in the well to the right. This shifted mud pressure line better matches the pore pressure and fracture gradient of the formation.

Figure 32:
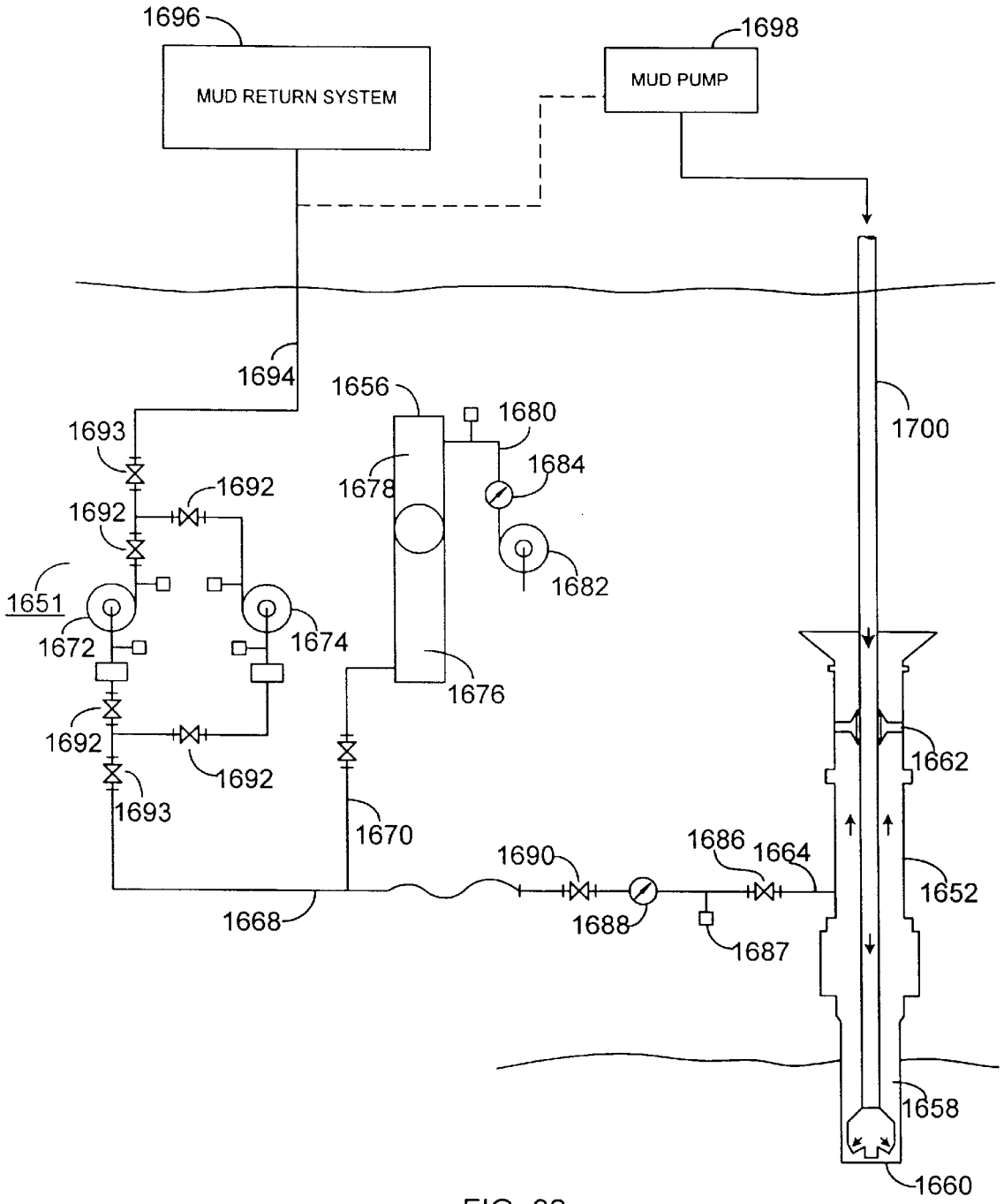
FIG. 32 shows a diagram of a mud circulation system for an offshore drilling system which includes a subsea flow assembly and a mud lift module.

FIG. 32 shows a mud circulation system for a drilling system which incorporates a mud lift module, e.g., mud lift module 1651, with a flow assembly, e.g., flow assembly 1652 (shown in FIG. 30). A well annulus 1658 extends from the bottom of the well 1660 to the diverter 1662. A conduit 1664 extends outwardly from the well annulus 1658 and branches off to flow conduits 1668 and 1670. The valve 1686 in the conduit 1664 may be opened to allow fluid to flow from the well through the conduit 1664 or may be closed to prevent fluid from flowing through the conduit 1664 from the well. The flow meter 1686 measures the rate at which fluid flows out of the flow assembly 1652.

Flow conduit 1668 runs to the suction ends of the subsea pumps 1672 and 1674. Isolation valves 1692 and 1693 are provided to isolate the pumps 1672 and 1674 from the piping system when necessary. Flow conduit 1670 runs to the mud chamber 1676 of the mud tank 1656. A flow line 1680 allows seawater to be supplied to or exhausted from the seawater chamber 1678. A pump 1682 arranged in the flow line 1680 may be operated to maintain the pressure in the seawater chamber 1678 at, above, or below the ambient seawater pressure. The flow meter 1684 measures the rate at which seawater enters or leaves the seawater chamber.

A drill string 1700 extends through the flow assembly 1652 into the well 1660. The drill string 1700 conveys drilling fluid from the mud pump 1698 to the well annulus 1658. The discharge ends of the subsea mud pumps 1672 and 1674 are linked to a return line 1694 which runs to the mud return system 1696.

In operation, fluid pumped down the bore of the drill string 1700 enters the well 1660 and rises up the well annulus 1658. The fluid in the well annulus enters the flow conduit 1664 and passes through the valve 1686, the flow meter 1688 and the valve 1690 into the suction end of the subsea pumps 1672 and 1674. The fluid pressure is discharged into the return line 1694 and the return line 1694 carries the fluid to the mud return system at the surface.

The pumping rates of the subsea pumps 1672 and 1674 are controlled to maintain the desired amount of back pressure in the well 1660. The amount of back pressure can be set to achieve a balanced, underbalanced, or overbalanced drilling condition.

While the invention has been described with respect to a limited number of embodiments, those skilled in the art will appreciate numerous variations therefrom without departing from the spirit and scope of the invention. The appended claims are intended to cover all such modifications and variations which occur to one of ordinary skill in the art.

What is claimed is:

1. A system for drilling a subsea well from a rig through a subsea wellhead below the rig, comprising:

a wellhead stack mounted on the subsea wellhead, the wellhead stack comprising at least a subsea blowout preventer stack and a subsea diverter;

a drill string extending from the rig through the wellhead stack into the well, the drill string for conducting drilling fluid from the rig to a drill bit in the well;

a riser having one end coupled to the wellhead stack and another end coupled to the rig, the riser internally receiving the drill string such that a riser annulus is defined between the drill string and the riser;

a well annulus extending from the bottom of the well to the subsea diverter, the well annulus being separated from the riser annulus by the subsea diverter and adapted to conduct fluid away from the drill bit; and a pump having a suction side in communication with the well annulus and a discharge side in communication with the rig, the pump being operable such that a selected pressure gradient is maintained in the well annulus, the pump comprising a first chamber in communication with the well annulus, the first chamber being provided to selectively receive fluid from and dispense fluid to the well annulus wherein the first chamber is defined in a vessel having a second chamber defined therein and a movable member disposed between the first and second chambers, the movable member being arranged to move within the vessel in response to pressure differential between the first and second chambers.

2. The system of claim 1, wherein the riser is filled with seawater.

3. The system of claim 1, wherein the pressure of the fluid flowing out of the well annulus is maintained at ambient seawater pressure.

4. The system of claim 1, wherein the first chamber is defined in the riser.

5. The system of claim 1, wherein pumping rate of the pump is controlled to maintain a predetermined amount of fluid in the first chamber such that the selected pressure gradient is maintained in the well annulus.

6. The system of claim 3, further comprising a boost pump for boosting the pressure of the fluid flowing into the suction side of the pump.

7. The system of claim 1, wherein pumping rate of the pump is controlled to maintain the movable member at a pre-selected position in the vessel.

8. The system of claim 7, wherein the pre-selected position corresponds to a condition when the pressures in the first and second chambers are substantially equal to the ambient seawater pressure.

9. The system of claim 7, wherein the pre-selected position corresponds to a condition when a selected pressure differential exists between the well annulus and the surrounding seawater.

10. The system of claim 1, further comprising a pressure sensor for monitoring pressure in the first chamber and a valve for preventing fluid flow from the well annulus to the first chamber when the pressure measured by the pressure sensor exceeds the pressure rating of the vessel.

11. The system of claim 1, wherein the first chamber is connected to receive fluid from a fluid source on the rig through a valve.

12. The system of claim 1, further comprising a device for controlling size of solid particles in the fluid flowing from the well annulus to the suction side of the pump.

13. The system of claim 12, wherein the device for controlling size of solid particles includes a rock crusher having rotating blades for crushing solid particles.

14. The system of claim 12, wherein the device for controlling size of solid particles comprises:

a housing having a port hydraulically connected to the suction side of the pump; and a barrel disposed in the housing, the barrel having a bore hydraulically connected to the well annulus and a plurality of holes in fluid communication with the port, wherein solid particles having sizes larger than the holes are prevented from passing through the holes to the port.

15. The system of claim 1, further comprising a pressure-actuated valve disposed in the drill string for preventing drilling fluid from free-falling from the drill string into the well.

16. The system of claim 15, wherein the pressure-actuated valve comprises:

an elongated body having a bore running therethrough;

a flow nozzle disposed in the bore, the flow nozzle having at least one port for fluid communication between the drill string and the drill bit;

a flow cone interposed between the body and the flow nozzle, the flow cone being movable between an open position to permit fluid flow from the drill string to the port and a closed position to prevent fluid flow from the drill string to the port;

an orifice in the body for communicating pressure in the well annulus to the bore; and a biasing mechanism for normally urging the flow cone to the closed position;

wherein the flow cone moves from the closed position to the open position when the pressure of the fluid pumped through the drill string reaches a predetermined pressure and returns to the closed position when the pressure of the fluid pumped through the drill string falls below the predetermined pressure.

17. The system of claim 1, wherein the pump is a positive-displacement pump.

18. The system of claim 1, further comprising at least one choke/kill line for fluid communication between the well annulus and the rig.

19. The system of claim 18, wherein the choke/kill line hydraulically connects the discharge side of the pump to the rig.

20. The system of claim 19, wherein the choke/kill line is hydraulically connected to the suction side of the pump through a valve and choke.

21. A system for drilling a subsea well from a rig through a subsea wellhead below the rig, comprising:

a wellhead stack mounted on the subsea wellhead, the wellhead stack comprising at least a subsea blowout preventer stack and a subsea diverter;

a drill string extending from the rig through the wellhead stack into the well, the drill string for conducting drilling fluid from the rig to a drill bit in the well;

a well annulus extending from the bottom of the well to the subsea diverter, the well annulus for conducting fluid away from the drill bit; and a positive-displacement pump having a suction side in communication with the well annulus and a discharge side in communication with the rig, the pump being operable such that a selected pressure gradient is maintained in the well annulus, the pump comprising a first chamber in communication with the well annulus, the first chamber being provided to selectively receive fluid from and dispense fluid to the well annulus wherein the first chamber is defined in a vessel having a second chamber defined therein and a movable member disposed between the first and second chambers, the movable member being arranged to move within the vessel in response to pressure differential between the first and second chambers.

22. The system of claim 21, wherein a return line system for conducting fluid from a discharge end of the pump to the rig comprises:

a connector assembly affixed to the seafloor;

a return line extending from the connector assembly toward the rig;

a buoy coupled to the return line to keep the return line substantially vertical;

a first umbilical hydraulically connecting the return line to the rig; and a second umbilical hydraulically connecting the return line to the discharge end of the pump.

23. A system for drilling a subsea well from a rig through a subsea wellhead below the rig, comprising:

a subsea blowout preventer stack having a first end coupled to the subsea wellhead;

a drill string extending from the rig through the subsea blowout preventer stack and wellhead into the well, the drill string for conducting drilling fluid from the rig to a drill bit in the well;

a rotating subsea diverter coupled to a second end of the subsea blowout preventer stack and adapted to slidingly receive and sealingly engage the drill string;

a well annulus extending from the bottom of the well to the rotating subsea diverter, the well annulus for conducting fluid away from the drill bit; and a pump having a suction side in communication with the well annulus and a discharge side in communication with the rig, the pump being operable such that a selected pressure gradient is maintained in the well annulus, the pump comprising a device coupled to an inlet side thereof to control a size of solid particles entering the pump.

24. The system of claim 23, further comprising a pressure-actuated valve arranged in the drill string to prevent drilling fluid from free-falling from the drill string into the well.

* * * * *

UNITED STATES PATENT AND TRADEMARK OFFICE

CERTIFICATE OF CORRECTION

PATENT NO. : 6,325,159 B1 
DATED : December 4, 2001
INVENTOR(S) : Charles P. Peterman, Riley G. Goldsmith, Keith C. Mott, Kenneth L. Pelata and Kenneth W. Colvin It is certified that error appears in the above-identified patent and that said Letters Patent is hereby corrected as shown below:

Column 9,
Line 2, replaced “LMP” with -- LMRP --.

Column 13,
Line 65, replace “FIG. 1” with -- FIG. 2B --.

Column 17,
Line 13, replace “406” with -- 46 --.

Column 22,
Line 20, replace “IM” with -- HM --.

Column 31,
Line 11, replace “pressure 15 balanced” with -- pressure-balanced --.

Column 32,
Line 8, replace “ud” with -- mud --.

Column 34,
Line 26, replace “fill” with -- full --.

Signed and Sealed this

Thirteenth Day of August, 2002

*Attest:*

*Attesting Officer*

JAMES E. ROGAN
*Director of the United States Patent and Trademark Office*